US007004079B2

(12) United States Patent
Forbes

(10) Patent No.: US 7,004,079 B2
(45) Date of Patent: Feb. 28, 2006

(54) RAIL ROAD CAR AND TRUCK THEREFOR

(75) Inventor: James W. Forbes, Campbellsville (CA)

(73) Assignee: National Steel Car Limited, Hamilton (CA)

( * ) Notice: Subject to any disclaimer, the term of this patent is extended or adjusted under 35 U.S.C. 154(b) by 0 days.

(21) Appl. No.: 10/355,374

(22) Filed: Jan. 31, 2003

(65) Prior Publication Data

US 2003/0172838 A1 Sep. 18, 2003

Related U.S. Application Data

(63) Continuation-in-part of application No. 09/920,437, filed on Aug. 1, 2001, now Pat. No. 6,659,016, and a continuation-in-part of application No. 10/210,797, filed on Aug. 1, 2002, and a continuation-in-part of application No. 10/210,853, filed on Aug. 1, 2002.

(51) Int. Cl.
*B61F 15/00* (2006.01)

(52) U.S. Cl. ..... 105/223; 105/198.2; 105/174; 105/182.1; 105/190.1; 105/193; 105/206.1

(58) Field of Classification Search ..... 105/171, 105/174, 179, 182.1, 185, 187, 189, 355, 105/190.1, 192, 193, 197.2, 198, 198.2, 198.4, 105/202, 203, 206.1, 207, 223, 157.1, 165, 105/167, 168, 197.05
See application file for complete search history.

(56) References Cited

U.S. PATENT DOCUMENTS

| | | | |
|---|---|---|---|
| 895,157 | A | 8/1908 | Bush |
| 1,083,831 | A | 6/1914 | Holdaway et al. |
| 1,229,374 | A | 6/1917 | Youngblood |
| 1,316,553 | A | 9/1919 | Barber |
| 1,535,799 | A | 4/1925 | Adams |
| 1,608,665 | A | 11/1926 | Pehrson |
| 1,695,085 | A | 12/1928 | Cardwell |
| 1,745,322 | A | 1/1930 | Brittain, Jr. |
| 1,754,111 | A | 4/1930 | Latshaw |
| 1,841,066 | A | 1/1932 | Simming |
| 1,855,903 | A | 4/1932 | Brittain, Jr. |
| 1,894,534 | A | 1/1933 | Dolan |
| 1,902,823 | A | 3/1933 | Bender |
| 1,953,103 | A | 4/1934 | Buckwalter |
| 2,009,149 | A | 7/1935 | Pierce |
| 2,009,771 | A | 7/1935 | Goodwin |

(Continued)

FOREIGN PATENT DOCUMENTS

| | | |
|---|---|---|
| AT | 245610 | 3/1966 |

(Continued)

OTHER PUBLICATIONS

1980 Car and Locomotive Cyclopedia, pp. 669-750. Section 13 Trucks and Journal Bearings. pp. 669-670, 699-703, 706-709, 712-719, 734, 735.

(Continued)

*Primary Examiner*—Mark T. Le
(74) *Attorney, Agent, or Firm*—McCarthy Terault LLP

(57) ABSTRACT

An autorack rail road car is provided with a truck that includes a pair of sideframes supported on wheel sets with bearing adapters positioned therebetween. The bearing adapters and the sideframes have associated parts or surfaces with curvatures configured to permit lateral swinging of the sideframes. A bolster is supported by the sideframes, and sets of laterally arranged dampers are provided therebetween to control the relationship between the sideframes and the bolster.

31 Claims, 33 Drawing Sheets

U.S. PATENT DOCUMENTS

| | | | | |
|---|---|---|---|---|
| 2,053,990 | A | | 9/1936 | Goodwin |
| 2,129,408 | A | | 9/1938 | Davidson |
| 2,132,001 | A | | 10/1938 | Dean |
| 2,147,014 | A | | 2/1939 | Demarest |
| 2,155,615 | A | | 4/1939 | Rice |
| 2,257,109 | A | | 9/1941 | Davidson |
| 2,324,267 | A | | 7/1943 | Oelkers |
| 2,333,921 | A | | 11/1943 | Flesch |
| 2,352,693 | A | | 7/1944 | Davidson |
| 2,367,510 | A | | 1/1945 | Light |
| 2,404,278 | A | | 7/1946 | Dath |
| 2,408,866 | A | | 10/1946 | Marquardt |
| 2,424,936 | A | | 7/1947 | Light |
| 2,432,228 | A | | 12/1947 | DeLano |
| 2,434,583 | A | | 1/1948 | Pierce |
| 2,434,838 | A | | 1/1948 | Cottrell |
| 2,446,506 | A | | 7/1948 | Barrett |
| 2,456,635 | A | | 12/1948 | Heater |
| 2,458,210 | A | | 1/1949 | Schlegel |
| 2,497,460 | A | | 2/1950 | Leese |
| 2,528,473 | A | | 10/1950 | Kowalik |
| 2,551,064 | A | | 5/1951 | Spenner |
| 2,570,159 | A | | 10/1951 | Schlegel |
| 2,613,075 | A | | 10/1952 | Barrett |
| 2,650,550 | A | | 9/1953 | Pierce |
| 2,659,318 | A | | 11/1953 | Steins et al. |
| 2,661,702 | A | | 12/1953 | Kowalik |
| 2,669,943 | A | | 2/1954 | Spenner |
| 2,687,100 | A | | 8/1954 | Dath |
| 2,688,938 | A | | 9/1954 | Kowalik |
| 2,693,152 | A | | 11/1954 | Bachman |
| 2,697,989 | A | | 12/1954 | Shafer |
| 2,717,558 | A | | 9/1955 | Shafer |
| 2,727,472 | A | | 12/1955 | Forssell |
| 2,737,907 | A | | 3/1956 | Janeway |
| 2,751,856 | A | | 6/1956 | Maatman |
| 2,762,317 | A | | 9/1956 | Palmgren |
| 2,777,400 | A | | 1/1957 | Forssell |
| 2,827,987 | A | | 3/1958 | Williams |
| 2,853,958 | A | | 9/1958 | Neumann |
| 2,865,306 | A | | 12/1958 | Bock et al. |
| 2,883,944 | A | | 4/1959 | Couch |
| 2,911,923 | A | | 11/1959 | Bachman et al. |
| 2,929,339 | A | | 3/1960 | Schueder et al. |
| 2,959,262 | A | | 11/1960 | Parker et al. |
| 3,017,840 | A | | 1/1962 | Fairweather |
| 3,024,743 | A | | 3/1962 | Williams et al. |
| 3,026,819 | A | | 3/1962 | Cope |
| 3,099,230 | A | | 7/1963 | DePodesta |
| 3,102,497 | A | | 9/1963 | Candlin et al. |
| 3,119,350 | A | | 1/1964 | Bellingher |
| 3,173,382 | A | | 3/1965 | Ryan |
| 3,205,836 | A | | 9/1965 | Wojcikowski |
| 3,218,990 | A | | 11/1965 | Weber |
| 3,221,669 | A | | 12/1965 | Baker et al. |
| 3,230,900 | A | | 1/1966 | Ruprecht et al. |
| 3,240,167 | A | | 3/1966 | Podesta et al. |
| 3,274,955 | A | | 9/1966 | Thomas |
| 3,285,197 | A | | 11/1966 | Tack |
| 3,302,589 | A | * | 2/1967 | Williams ..... 105/222 |
| 3,323,472 | A | | 6/1967 | Boone et al. |
| 3,370,552 | A | | 2/1968 | Podesta et al. |
| 3,381,629 | A | | 5/1968 | Jones |
| 3,405,661 | A | | 10/1968 | Erickson et al. |
| 3,426,704 | A | | 2/1969 | Blunden |
| 3,461,814 | A | | 8/1969 | Weber et al. |
| 3,461,815 | A | | 8/1969 | Gedris et al. |
| 3,516,706 | A | | 6/1970 | Bruce |
| 3,547,049 | A | | 12/1970 | Sanders |
| 3,559,589 | A | | 2/1971 | Williams |
| 3,575,117 | A | | 4/1971 | Tack |
| 3,670,660 | A | | 6/1972 | Weber et al. |
| 3,678,863 | A | | 7/1972 | Pringle |
| 3,687,086 | A | | 8/1972 | Barber |
| 3,699,897 | A | | 10/1972 | Sherrick |
| 3,714,905 | A | * | 2/1973 | Baber ..... 105/198.4 |
| 3,802,353 | A | | 4/1974 | Korpics |
| 3,834,320 | A | | 9/1974 | Tack |
| 3,844,226 | A | | 10/1974 | Brodeur et al. |
| 3,855,942 | A | | 12/1974 | Mulcahy |
| 3,857,341 | A | | 12/1974 | Neumann |
| 3,871,276 | A | | 3/1975 | Allen |
| 3,880,089 | A | | 4/1975 | Wallace |
| 3,885,942 | A | | 5/1975 | Mulcahy |
| 3,897,736 | A | | 8/1975 | Tack |
| 3,901,163 | A | | 8/1975 | Neumann |
| 3,905,305 | A | | 9/1975 | Cope |
| 3,920,231 | A | | 11/1975 | Harrison |
| 3,927,621 | A | | 12/1975 | Skeltis et al. |
| 3,965,825 | A | | 6/1976 | Sherrick |
| 3,977,332 | A | | 8/1976 | Bullock |
| 3,995,563 | A | | 12/1976 | Blunden |
| 3,995,564 | A | * | 12/1976 | Cordani ..... 105/418 |
| 3,995,720 | A | | 12/1976 | Wiebe |
| 4,003,318 | A | | 1/1977 | Bullock et al. |
| 4,034,681 | A | | 7/1977 | Neumann et al. |
| 4,067,260 | A | | 1/1978 | Finsterwald |
| 4,072,112 | A | | 2/1978 | Wiebe |
| 4,078,501 | A | | 3/1978 | Neumann |
| 4,084,514 | A | | 4/1978 | Bullock |
| 4,103,623 | A | | 8/1978 | Radwill |
| 4,109,585 | A | | 8/1978 | Brose |
| 4,109,586 | A | | 8/1978 | Briggs et al. |
| 4,109,934 | A | | 8/1978 | Paton et al. |
| 4,111,131 | A | | 9/1978 | Bullock |
| 4,119,042 | A | | 10/1978 | Naves et al. |
| 4,119,043 | A | | 10/1978 | Naves et al. |
| 4,128,062 | A | | 12/1978 | Roberts |
| 4,148,469 | A | | 4/1979 | Geyer |
| 4,149,472 | A | | 4/1979 | Naves et al. |
| 4,151,801 | A | | 5/1979 | Scheffel et al. |
| 4,167,907 | A | | 9/1979 | Mulcahy et al. |
| 4,179,995 | A | | 12/1979 | Day |
| 4,186,914 | A | | 2/1980 | Radwill et al. |
| 4,191,107 | A | | 3/1980 | Ferris et al. |
| 4,192,240 | A | | 3/1980 | Korpics |
| 4,196,672 | A | | 4/1980 | Bullock |
| 4,230,047 | A | | 10/1980 | Wiebe |
| 4,233,909 | A | | 11/1980 | Adams et al. |
| 4,236,457 | A | | 12/1980 | Cope |
| 4,237,793 | A | | 12/1980 | Holden et al. |
| 4,239,007 | A | | 12/1980 | Kleykamp et al. |
| 4,242,966 | A | | 1/1981 | Holt et al. |
| 4,244,297 | A | | 1/1981 | Monselle |
| 4,254,712 | A | | 3/1981 | O'Neill |
| 4,254,713 | A | | 3/1981 | Clafford |
| 4,256,041 | A | | 3/1981 | Kemper et al. |
| 4,265,182 | A | | 5/1981 | Neff et al. |
| 4,274,339 | A | | 6/1981 | Cope |
| 4,274,340 | A | | 6/1981 | Neumann et al. |
| 4,276,833 | A | | 7/1981 | Bullock |
| 4,295,429 | A | | 10/1981 | Wiebe |
| 4,311,098 | A | | 1/1982 | Irwin |
| 4,316,417 | A | | 2/1982 | Martin |
| 4,332,201 | A | | 6/1982 | Pollard et al. |
| 4,333,403 | A | | 6/1982 | Tack et al. |
| 4,336,758 | A | | 6/1982 | Radwill |
| RE31,008 | E | | 8/1982 | Barber |
| 4,342,266 | A | | 8/1982 | Cooley |
| 4,351,242 | A | | 9/1982 | Irwin |
| 4,356,775 | A | | 11/1982 | Paton et al. |
| 4,357,880 | A | | 11/1982 | Weber |
| 4,363,276 | A | | 12/1982 | Neumann |
| 4,363,278 | A | | 12/1982 | Mulcahy |

4,370,933 A 2/1983 Mulcahy
4,373,446 A 2/1983 Cope
4,413,569 A 11/1983 Mulcahy
4,416,203 A 11/1983 Sherrick
4,426,934 A 1/1984 Geyer
4,434,720 A 3/1984 Mulcahy et al.
4,483,253 A 11/1984 List
RE31,784 E 1/1985 Wiebe
4,491,075 A 1/1985 Neumann
4,512,261 A 4/1985 Horger
4,526,109 A 7/1985 Dickhart et al.
4,537,138 A * 8/1985 Bullock ..... 105/168
RE31,988 E 9/1985 Wiebe
4,552,074 A 11/1985 Mulcahy et al.
4,554,875 A 11/1985 Schmitt et al.
4,574,708 A 3/1986 Solomon
4,590,864 A 5/1986 Przybylinski
4,637,319 A 1/1987 Moehling et al.
4,660,476 A 4/1987 Franz
4,671,714 A 6/1987 Bennett
4,674,411 A 6/1987 Schindehutte
4,674,412 A 6/1987 Mulcahy et al.
4,676,172 A 6/1987 Bullock
4,751,882 A 6/1988 Wheatley et al.
4,759,669 A 7/1988 Robertson et al.
4,765,251 A 8/1988 Guins
4,785,740 A 11/1988 Grandy
4,813,359 A 3/1989 Marulic et al.
4,825,775 A 5/1989 Stein et al.
4,825,776 A 5/1989 Spencer
4,870,914 A 10/1989 Radwill
4,915,031 A 4/1990 Wiebe
4,929,132 A 5/1990 Yeates et al.
4,936,226 A 6/1990 Wiebe
4,938,152 A 7/1990 List
4,942,824 A 7/1990 Cros
4,947,760 A 8/1990 Dawson et al.
4,953,471 A 9/1990 Wronkiewicz et al.
4,966,081 A 10/1990 Dominguez et al.
4,974,521 A 12/1990 Eungard
4,986,192 A 1/1991 Wiebe
5,000,097 A 3/1991 List
5,001,989 A 3/1991 Mulcahy et al.
5,009,521 A 4/1991 Wiebe
5,027,716 A 7/1991 Weber
5,046,431 A 9/1991 Wagner
5,081,935 A 1/1992 Pavlick
5,086,708 A 2/1992 McKeown, Jr. et al.
5,095,823 A 3/1992 McKeown, Jr.
5,107,773 A 4/1992 Daley et al.
5,111,753 A 5/1992 Zigler et al.
5,138,954 A 8/1992 Mulcahy
5,140,912 A 8/1992 Hesch
5,174,218 A 12/1992 List
5,176,083 A 1/1993 Bullock
5,226,369 A 7/1993 Weber
5,235,918 A 8/1993 Durand et al.
5,237,933 A 8/1993 Bucksbee
5,239,932 A 8/1993 Weber
5,241,913 A 9/1993 Weber
5,271,335 A 12/1993 Bogenschutz
5,271,511 A 12/1993 Daugherty, Jr. et al.
5,320,046 A 6/1994 Hesch
5,327,837 A 7/1994 Weber
5,331,902 A 7/1994 Hawthorne et al.
5,392,717 A 2/1995 Hesch et al.
5,404,826 A 4/1995 Rudibaugh et al.
5,410,968 A 5/1995 Hawthorne et al.
5,417,163 A 5/1995 Lienard
RE34,963 E 6/1995 Eungard
5,438,934 A 8/1995 Goding
5,450,799 A 9/1995 Goding
5,452,665 A 9/1995 Wronkiewicz et al.
5,463,964 A 11/1995 Long et al.
5,481,986 A 1/1996 Spencer et al.
5,490,464 A * 2/1996 Rudibaugh et al. ..... 105/422
5,503,084 A 4/1996 Goding et al.
5,509,358 A 4/1996 Hawthorne
5,511,489 A 4/1996 Bullock
5,511,491 A 4/1996 Hesch et al.
5,515,792 A 5/1996 Bullock et al.
5,524,551 A 6/1996 Hawthorne et al.
5,540,157 A 7/1996 Andersson et al.
5,544,591 A 8/1996 Taillon
5,555,817 A 9/1996 Taillon
5,555,818 A 9/1996 Bullock
5,560,589 A 10/1996 Gran et al.
5,562,045 A 10/1996 Rudibaugh et al.
5,572,931 A 11/1996 Lazar
5,613,445 A 3/1997 Rismiller
5,622,115 A 4/1997 Ehrlich et al.
5,632,208 A 5/1997 Weber
5,647,283 A 7/1997 McKisic
5,657,698 A 8/1997 Black, Jr. et al.
5,666,885 A 9/1997 Wike
5,685,228 A 11/1997 Ehrlich et al.
5,685,229 A 11/1997 Ohara et al.
5,690,033 A 11/1997 Andre
5,722,327 A 3/1998 Hawthorne et al.
5,735,216 A 4/1998 Bullock et al.
5,743,192 A * 4/1998 Saxton et al. ..... 105/355
5,746,137 A 5/1998 Hawthorne
5,749,301 A 5/1998 Wronkiewicz et al.
5,765,486 A 6/1998 Black, Jr. et al.
5,782,187 A 7/1998 Black, Jr. et al.
5,794,537 A 8/1998 Zaerr et al.
5,794,538 A 8/1998 Pitchford
5,799,582 A 9/1998 Rudibaugh et al.
5,802,982 A 9/1998 Weber
5,832,836 A 11/1998 Ehrlich et al.
5,845,584 A 12/1998 Bullock et al.
5,850,795 A 12/1998 Taillon
5,857,414 A 1/1999 Thoman et al.
5,875,721 A 3/1999 Wright et al.
5,918,547 A 7/1999 Bullock
5,921,186 A 7/1999 Hawthorne et al.
5,924,366 A 7/1999 Trainer et al.
5,943,961 A 8/1999 Rudibaugh et al.
5,967,053 A 10/1999 Toussaint et al.
5,979,335 A 11/1999 Saxton et al.
5,992,330 A 11/1999 Gilbert et al.
6,125,767 A 10/2000 Hawthorne et al.
6,142,081 A 11/2000 Long
6,173,655 B1 1/2001 Hawthorne
6,178,894 B1 1/2001 Leingang
6,186,075 B1 2/2001 Spencer
6,227,122 B1 5/2001 Spencer
6,269,752 B1 8/2001 Taillon
6,276,283 B1 8/2001 Weber
6,283,040 B1 9/2001 Lewin
6,338,300 B1 1/2002 Landrot
6,347,588 B1 2/2002 Leingang
6,371,033 B1 * 4/2002 Smith et al. ..... 105/157.1
6,374,749 B1 * 4/2002 Duncan et al. ..... 105/198.5
6,422,155 B1 7/2002 Heyden
6,425,334 B1 7/2002 Wronkiewicz et al.
6,446,561 B1 * 9/2002 Khattab ..... 105/355
6,591,759 B1 7/2003 Bullock
6,631,685 B1 10/2003 Hewitt
6,672,224 B1 1/2004 Weber et al.
6,688,236 B1 2/2004 Taillon
6,691,625 B1 2/2004 Duncan
6,701,850 B1 3/2004 McCabe et al.
2003/0024429 A1 2/2003 Forbes

| | | | |
|---|---|---|---|
| 2003/0041772 | A1 | 3/2003 | Forbes |
| 2003/0097955 | A1 | 5/2003 | Bullock |
| 2003/0129037 | A1 | 7/2003 | Forbes |

FOREIGN PATENT DOCUMENTS

| | | | |
|---|---|---|---|
| CA | 714822 | | 8/1965 |
| CA | 2090031 | | 6/1991 |
| CA | 2100004 | | 4/1994 |
| CA | 2153137 | | 6/1995 |
| CA | 2191613 | | 5/1997 |
| CA | 2034125 | | 7/2000 |
| CH | 371475 | | 10/1963 |
| CH | 329987 | | 5/1998 |
| DE | 473036 | | 2/1929 |
| DE | 664933 | | 8/1929 |
| DE | 688777 | | 2/1940 |
| DE | 1180392 | | 10/1964 |
| DE | 2318369 | | 10/1974 |
| EP | 0264731 | | 4/1988 |
| EP | 0347334 | | 12/1989 |
| EP | 0444362 | A2 | 9/1991 |
| EP | 0494323 | A | 7/1992 |
| EP | 1053925 | | 11/2000 |
| EP | 1053925 | A1 | 11/2000 |
| FR | 1095600 | | 6/1955 |
| IT | 324559 | | 2/1935 |
| JP | 58-39558 | | 3/1983 |
| JP | 63-279966 | | 11/1988 |
| JP | 4-143161 | | 5/1992 |

OTHER PUBLICATIONS

1984 Car and Locomotive Cyclopedia, 5th ed. (Omaha: Simmons-Boardman Books, Inc. 1984) at pp. 512-513.

1997 Car and Locomotive Cyclopedia, 6th ed. (Omaha: Simmons-Boardman Books, Inc. 1997) at pp. 7-24.

1997 Car and Locomotive Cyclopedia, 6th ed. (Omaha: Simmons-Boardman Books, Inc. 1997) at pp. 705-770. Section 7: Trucks, Wheels, Axles & Bearings. 705-720, 724, 726,735, 736, 739-751.

1966 Car and Locomotive Cyclopedia, 1st ed. (New York: Simmons-Boardman Publishing Corporation, 1966) at p. 827.

1984 Car and Locomotive Cyclopedia, 5th ed. (Omaha: Simmons-Boardman Books, Inc. 1984) at pp. 488, 489, 496, 500 and 526.

Nov. 1998 Railway Age, pp. 47, 57, 53, 62.

Sep. 1996, Rownd, K. et al., "Improved Ride Quality of Finished Automobiles by Rail", Technology Digest TD 96-021, Association of American Railroads.

Sep. 1996, Rownd, K. et al., "Over-the-Road Tests Demonstrated Improved Ride Quality for Transportation of Finished Automobiles", Technology Digest TD 96-022. Association of American Railroads.

Sep. 1997, Burnett, S. et al., Improved Vehicle Dynamics Model for Tri-Level Auto-Rack Railcars, Technology Digest TD 97-038, Association of American Railroads.

Sep. 1997, Rownd, K. et al., "Improved Ride Quality for Rail Transport of Finished Automobiles", Technology Digest TD 97-039, Association of American Railroads.

Jun. 1998, Rownd, K. et al., "Use of Modified Suspensions to Improve Ride Quality in Bi-Level Auto-Racks", Technology Digest 98-014, Association of American Railroads.

Oct. 1998, Rownd, K. et al., "Improved Ride-Quality for Transportation of Finished Auto by Tri-Level Autorack", Technology Digest 98-025, Association of American Railroads.

Dec. 1998, Rownd, K. et al., "Advanced Suspensions Meet Performance Standards for Bi-Level Auto-Racks Cars", Technology Digest 98-032, Association of American Railroads.

Jun. 1999 , Rownd, K. et al., "Advanced Suspensions Meet Ride-Quality Performance Standards for Tri-Level Auto-Rack Cars", Technology Digest 99-020, Association of American Railroads.

Jun. 1999, Rownd, K. et al., Evaluation of End-of-Car Cushioning Designs Using the TOES Mode:, Technology Digest 99-019, Association of American Railroads.

Aug. 1999, Rownd, K. et al., "Improving the Economy of bulk-Commodity Service Through Improved Suspensions", Technology Digest 99-027, Association of American Railroads.

Jul. 2000, Rownd, K. et al., "Improving the Economics of Bulk-Commodity Service: ASF Bulk Truck", Technology Digest 00-011, Association of American Railroads.

Jul. 2000, Rownd, K. et al., "Improving the Economics of Bulk-Commodity Service—S2E Standard Car Truck", Technology Digest 00-012, Association of American Railroads.

ASF Trucks "Good for the Long Run," American Steel Foundries, date unknown.

ASF User's Guide, "Freight Car Truck Design," American Steel Foundries, ASF652, date unknown.

Barber S-2-D Product Bulletin, undated.

Buckeye XC-R, Buckeye Steel Castings, date unknown.

*Standard Car Truck Company, Truck Information Package 2000*: Iron Friction Wedge Replacement Guide, Standard Car Truck Company, 2000. Lifeguard Friction Wedge Replacement Guide, Standard Car Truck Company, 2000. TwinGuard Friction Wedge Replacement Guide, Standard Car Truck Company, 2000. Product Bulletin, Barber TwinGuard, Standard Car Truck Company, date unknown. Barber Split Wedge, Standard Car Truck Company, date unknown. Barber Split Wedge Replacement Guide, Standard Car Truck Company, 2000. Barber 905-SW Split Wedge Friction Casting, Standard Car Truck Company, 2000. Barber 905-SW Split Wedge Pocket Insert, Standard Car Truck Company, 2000. Barber 905-SW Split Wedge Insert Application Guide, Standard Car Truck Company, 2000.

*American Steel Foundries information*: Super Service Ridemaster, American Steel Foundries, date unknown. Motion Control M976 Upgrade Kit, source unknown, date unknown. ASF Motion Control Truck System with Super Service Ridemaster & D5 Springs, drawing No. AR-3421, ASF-Keystone, Inc., Jul. 14, 2003. Assembly ASF/Pennsy Adapter Plus Pad & Adapter; drawing No. 43317, ASF-Keystone, Inc., Jul. 10, 2003.

1997 Car and Locomotive Cyclopedia, 5th ed., Simmons-Boardman Books, Inc. (Omaha), p. 811-822.

1937 *Car and Locomotive Cyclopedia*, (New York: Simmons-Boardman Publishing Corporation) pp 892 & 893.

1961 *Car Builders Cyclopedia*, 21st ed. (New York: Simmons-Boardman Publishing Corporation, 1961) at pp. 846, 847.

1966 *Car and Locomotive Cyclopedia*, (New York: Simmons-Boardman Publishing Corporation pp 818 & 819.

1974 *Car and Locomotive Cyclopedia*, 3rd ed. (New York: Simmons-Boardman Publishing Corporation, 1974) pp. S13-36, S13-37.

1980 *Car and Locomotive Cyclopedia*, pp. 669-750. Section 13.

1984 *Car and Locomotive Cyclopedia*, 5th ed. (Omaha: Simmons-Boardman Books, Inc. 1984) at pp. 512-513.

1997 *Car and Locomotive Cyclopedia*, 6th ed. (Omaha: Simmons-Boardman Books, Inc. 1997) at pp. 705-770. Section 7: Trucks Wheels Axles & Bearings.
1997 *Car and Locomotive Cyclopedia*, 6th ed. (Omaha: Simmons-Boardman Books, Inc. 1997) at pp. 811-822. Section 7 Bearings.
1966 *Car and Locomotive Cyclopedia*, 1st ed. (New York: Simmons-Boardman Publishing Corporation, 1966) at p. 827.
1970 *Car and Locomotive Cyclopedia*, 2nd ed. (New York: Simmons-Boardman Publishing Corporation, 1970) at p. 816.
1984 *Car and Locomotive Cyclopedia*, 5th ed. (Omaha: Simmons Boardman Books, Inc. 1984) at pp. 488, 489, 496, 500 and 526.
1997 *Car and Locomative Cyclopedia*, 6th ed. (Omaha: Simmons-Boardman Books, Inc. 1997) at p. 747.
Nov. 1998 *Railway Age*, pp. 47, 51, 53, 62.
Jul. 2003, "A Dynamic Relationship", *Railway Age*, at pp. 37-38.
*Railway Age*, Comprehensive Railroad Dictionary (Simmons-Boardman Books, Inc.) p. 142.
Sep. 1996, Rownd, K. et al., "Improved Ride Qaulity of Finished Automobiles by Rail", *Technology Digest* TD 96-021, Association of American Railroads.
Sep. 1996, Rownd, K. et al., "Over-the-Road Tests Demonstrated Improved Ride Quality for Transportation of Finished Automobiles", *Technology Digest* TD 96-022, Association of American Railroads.
Sep. 1997, Burnett, S. et al., "Improved Vehicle Dynamics Model for Tri-Level Auto-Rack Railcars", *Technology Digest* TD 97-038, Association of American Railroads.
Sep. 1997, Rownd, K. et al., "Improved Ride Quality for Rail Transport of Finished Automobiles", *Technology Digest* TD 97-039, Association of American Railroads.
Jun. 1998, Rownd, K. et al., "Use of Modified Suspensions to Improve Ride Quality in Bi-Level Auto-Racks", *Technology Digest* 98-014, Association of American Railroads.
Oct. 1998 , Rownd, K. et al., "Improved Ride-Quality for Transportation of Finished Auto by Tri-Level Autorack", *Technology Digest* 98-025, Association of American Railroads.
Dec. 1998, Rownd, K. et al., "Advanced Suspensions Meet Performance Standards for Bi-Level Auto-Rack Cars", *Technology Digest* 98-032, Association of American Railroads.
Jun. 1999, Rownd, K. et al., "Advanced Suspensions Meet Ride-Quality Performance Standards for Tri-Level Auto-Rack Cars", *Technology Digest* 99-020, Association of American Railroads.
Jun. 1999, Rownd, K. et al., "Evaluation of End-of-Car Cushioning Designs Using the TOES Model", *Technology Digest* 99-019, Association of American Railroads.
Aug. 1999,. Rownd, K. et al., "Improving the Economy of Bulk-Commodity Service Through Improved Suspensions", *Technology Digest* 99-027, Association of American Railroads.
Jul. 2000, Rownd, K. et al., "Improving the Economics of Bulk-Commodity Service: ASF Bulk Truck", *Technology Digest* 00-011, Association of American Railroads.
Jul. 2000, Rownd, K. et al., "Improving the Economics of Bulk-Commodity Service—S2E Standard Car Truck", *Technology Digest* 00-012, Association of American Railroads.
ASF Trucks "Good for the Long Run," American Steel Foundries, date unknown.
ASF User's Guide, "Freight Car Truck Design," American Steel Foundries, ASF652, date unknown.
ADAPTERPlus, Pennsy Corporation, Internet—PENNSY.com, Ver. 9807, date unknown.
*User's Manual for NUCARS*, Version 2.0, SD-o43, at pp. 5-39, 5-40, no date.
Barber S-2-D Product Bulletin, no date.
Association of American Railroads Mechanical Division Manual of Standards and Recommended Practices Journal "Roller Bearing Adapters for Freight Cars", date unknown, pp. H-35-H-42.
Narrow Pedestal Side Frame Trucks, Timken Roller Bearing Company, date unknown.
Timken "AP" Bearing Assembly, Timken Roller Bearing Company, date unknown.
Buckeye XC-R VII, Buckeye Steel Castings, date unknown.
Standard Car Truck Company, Truck Information Package 2000: Iron Friction Wedge Replacement Guide, Standard Car Truck Company, 2000. Lifeguard Friction Wedge Replacement Guide, Standard Car Truck Company, 2000. TwinGuard Friction Wedge Replacement Guide, Standard Car Truck Company, 2000. Product Bulletin, Barber TwinGuard, Standard Car Truck Company, date unknown. Barber Split Wedge, Standard Car Truck Company, date unknown. Barber Split Wedge Replacement Guide, Standard Car Truck Company, 2000. Barber 905-SW Split Wedge Friction Casting, Standard Car Truck Company, 2000. Barber 905-SW Split Wedge Pocket Insert, Standard Car Truck Company, 2000. Barber 905-SW Split Wedge Insert Application Guide, Standard Car Truck Company, 2000.
Standard Car Truck Company Barber Stabilized Trucks presentation Oct. 10, 2000.
Standard Car Truck Company "Barber Change Brings Choices", date unknown.
Standard Car Truck Company Barber Friction Wedge Matrix, date unknown.
Standard Car Truck Company Barber Stabilized Truck—Suspension Performance Properties, Mar. 14, 2000.

* cited by examiner 770
810
780
782
804
776
778
13c
814
792
772
794
786
788
774
800

822
13d
820

802
812
808
814
806
816
786
770
796

770

830
834
832
836
838

854
846
848
850
852
844

840
842
844
846
832

832

RAIL ROAD CAR AND TRUCK THEREFOR

This application is a continuation-in-part of Ser. No. 09/920,437 (now U.S. Pat. No. 6,659,016) filed Aug. 1, 2001, Ser. No. 10/210,797 filed Aug. 1, 2002 and Ser. No. 10/210,853 filed Aug. 1, 2002.

FIELD OF THE INVENTION

This invention relates generally to rail road freight cars and to trucks for use with rail road freight cars.

BACKGROUND OF THE INVENTION

Auto rack rail road cars are used to transport automobiles. Typically, auto-rack rail road cars are loaded in the "circus loading" manner, by driving vehicles into the cars from one end, and securing them in place with chocks, chains or straps. When the trip is completed, the chocks are removed, and the cars are driven out. The development of autorack rail road cars can be traced back 80 or 90 years, when mass production led to a need to transport large numbers of automobiles from the factory to market.

Automobiles are a high value, relatively low density, relatively fragile type of lading. Damage to lading due to dynamic loading in the railcar may tend to arise principally in two ways. First, there are longitudinal input loads transmitted through the draft gear due to train line action or shunting. Second, there are vertical, rocking and transverse dynamic responses of the rail road car to track perturbations as transmitted through the rail car suspension. It would be desirable to improve ride quality to lessen the chance of damage occurring.

In the context of longitudinal train line action, damage most often occurs from two sources (a) slack run-in and run out; (b) humping or flat switching. Rail road car draft gear have been designed against slack run-out and slack run-in during train operation, and also against the impact as cars are coupled together. Historically, common types of draft gear, such as that complying with, for example, AAR specification M-901-G, have been rated to withstand an impact at 5 m.p.h. (8 km/h) at a coupler force of 500,000 Lbs. (roughly $2.2\times10^6$ N). Typically, these draft gear have a travel of 2¾ to 3¼ inches in buff before reaching the 500,000 Lbs. load, and before "going solid". The term "going solid" refers to the point at which the draft gear exhibits a steep increase in resistance to further displacement. If the impact is large enough to make the draft gear "go solid" then the force transmitted, and the corresponding acceleration imposed on the lading, increases sharply. While this may be acceptable for ores, coal or grain, it is undesirably severe for more sensitive lading, such as automobiles or auto parts, rolls of paper, fresh fruit and vegetables and other high value consumer goods such as household appliances or electronic equipment. Consequently, from the relatively early days of the automobile industry there has been a history of development of longer travel draft gear to provide lading protection for relatively high value, low density lading, in particular automobiles and auto parts, but also farm machinery, or tractors, or highway trailers.

The subject of slack action is discussed at length in my co-pending U.S. patent application Ser. No. 09/920,437 filed Aug. 1, 2001 and incorporated herein by reference.

Since automobiles tend to be a relatively low density form of lading as compared to grain, ores, or coal, the volumetric capacity of the cars tends to be filled up before the weight of the reaches the maximum allowable weight for the trucks.

This has led to efforts to increase the volumetric capacity of the cars. Over time, particularly in the period of 1945–1970, autotrack cars grew longer and taller. At present, an autorack car may be up to about 90 feet long and 20 ft-2 inches tall. Autorack cars may typically have a tall, somewhat barn-like housing. The housing has end doors that are intended to keep out thieves and vandals.

The desire to increase the internal volume of the autorack car, and the relatively light weight of the lading, led to the development of a special 70 Ton rail road car truck for use with autorack cars. A 70 Ton "special" truck is shown in the 1997 *Car and Locomotive Cyclopedia* (Simmons-Boardman, Omaha, 1997) at page 726. The illustration indicates that the total loading of the spring groups at solid is indicated as 70,166 Lbs. per spring group, giving a total of 140,334 Lbs. per truck and 280,668 Lbs. per single unit autorack car. The spring rate is indicated as 18,447 Lbs./in., per spring group or 36,894 Lbs./in for the truck overall (there being one spring group per side frame, and two spring groups per truck). The truck shown in the 1997 *Cyclopedia* is a swing motion truck manufactured by National Castings Inc. In contrast to a regular 70 Ton truck that has, typically, 33 inch diameter wheels, the 70 Ton special autorack truck has wheels that have a diameter of only 28 inches. This tends to allow for lower main deck wheel trackways, and hence greater inside clearance height. In part, the use of such a truck in an autorack car may reflect the low density of the lading. That is, a regular 70 Ton truck is designed to carry a gross weight on rail of 110,000 Lbs, for a total full car weight of 220,000 Lbs. If the dead sprung weight of a conventional single unit autorack car is 75–85,000 Lbs., and the unsprung weight is about 15,000 Lbs, that would leave about 120,000 Lbs., for lading. Assuming that a typical passenger sedan weighs about 2500 Lbs., that would allow for about 48 automobiles before the gross weight on rail would be exceeded. Even for larger, heavier vehicles, weighing perhaps as much as 5000 Lbs., this would still give some 24 light trucks, vans, or "sport utility vehicles". But the volumetric capacity of a single unit autorack rail road car may be about 12–15 family sedans and perhaps fewer light trucks, vans, or SUV's. Thus the autorack rail road car truck loading may often tend to be significantly less than 110,000 lbs.

In contrast to the philosophy underlying the design of the 70 Ton special 28 inch truck, the present inventor believes that it is advantageous to use a truck having wheels larger than 33 inches in diameter for auto rack rail road cars. Wheel life and maintenance are dependent on wheel loading, and, for the same loading history, inversely dependent on wheel diameter. A larger wheel may tend to have lower operating stresses for the same lading; may tend to have a greater wear allowance for braking; may tend to undergo fewer rotations than a wheel of smaller diameter for the same distance travelled, and therefore may tend to accumulate fewer cycles in terms of fatigue life; and may tend not to get as hot during braking. All of these factors may tend to increase wheel life and reduce maintenance. Further, a larger wheel diameter may be used in conjunction with the use of longer springs. The use of longer springs may permit the employment of springs having a softer spring rate, giving a gentler ride. In terms of fatigue life and wear, this in turn may tend to give a load history with reduced peak loads, and lower frequency of those peak loads. Attainment of any one of these advantages would be desirable.

In terms of dynamic response through the trucks, there are a number of loading conditions to consider. First, there is a direct vertical response in the "vertical bounce" condition.

This may typically arise when there is a track perturbation in both rails at the same point, such as at a level crossing or at a bridge or tunnel entrance where there may be a relatively sharp discontinuity in track stiffness. A second "rocking" loading condition occurs when there are alternating track perturbations, typically such as used formerly to occur with staggered spacing of 39 ft rails. This phenomenon is less frequent given the widespread use of continuously welded rails, and the generally lower speeds, and hence lower dynamic forces, used for the remaining non-welded track. A third loading condition arises from elevational changes between the tracks, such as when entering curves in which case a truck may have a tendency to warp. A fourth loading condition arises from truck "hunting", typically at higher speeds, where the truck oscillates transversely between the rails. During hunting, the trucks tend most often to deform in a parallelogram manner. Fifth, lateral perturbations in the rails sometimes arise where the rails widen or narrow slightly, or one rail is more worn than another, and so on.

There are both geometric and historic factors to consider related to these loading conditions and the dynamic response of the truck. One historic factor is the near universal usage of the three-piece style of freight car truck in North America. While other types of truck are known, the three piece truck is overwhelmingly dominant in freight service in North America. The three piece truck relies on a primary suspension in the form of a set of springs trapped in a "basket" between the truck bolster and the side frames. Rather than requiring independent suspension of each wheel, for wheel load equalisation a three piece truck uses one set of springs, and the side frames pivot about the truck bolster ends in a manner like a walking beam. It is a remarkably simple and durable layout. However, the dynamic performance of the truck flows from that layout. The 1980 *Car & Locomotive Cyclopedia*, states at page 669 that the three piece truck offers "interchangeability, structural reliability and low first cost but does so at the price of mediocre ride quality and high cost in terms of car and track maintenance". It would be desirable to retain many or all of these advantages while providing improved ride quality.

In terms of rail road car truck suspension loading regimes, the first consideration is the natural frequency of the vertical bounce response. The static deflection from light car (empty) to maximum laded gross weight (full) of a rail car at the coupler tends to be typically about 2 inches. In addition, rail road car suspensions have a dynamic range in operation, including a reserve travel allowance.

In typical historical use, springs were chosen to suit the deflection under load of a full coal car, or a full grain car, or fully loaded general purpose flat car. In each case, the design lading tended to be very heavy relative to the rail car weight. For example, the live load for a 286,000 lbs. car may be of the order of five times the weight of the dead sprung load (i.e., the weight of the car, including truck bolsters but less side frames, axles and wheels). Further, in these instances, the lading may not be particularly sensitive to abusive handling. That is, neither coal nor grain tends to be badly damaged by poor ride quality. As a result, these cars tend to have very stiff suspensions, with a dominant natural frequency in vertical bounce mode of about 2 Hz. when loaded, and about 4 to 6 Hz. when empty. Historically, much effort has been devoted to making freight cars light for at least two reasons. First, the weight to be back hauled empty is kept low, reducing the fuel cost of the backhaul. Second, as the ratio of lading to car weight increases, a higher proportion of hauling effort goes into hauling lading, rather than hauling the railcar.

By contrast, an autorack car, or other type of car for carrying relatively high value, low density lading such as auto parts, electronic consumer goods, or white goods more generally, has the opposite loading profile. A two unit articulated autorack car may have a light car (i.e., empty) weight of 165,000 lbs., and a lading weight when fully loaded of only 35–40,000 lbs., per car body unit. That is, not only may the weight of the lading be less than the sprung weight of the rail road car unit, it may be less than 40% of the car weight. The lading typically has a high, or very high, ratio of value to weight. Unlike coal or grain, automobiles are relatively fragile, and hence more sensitive to a gentle (or a not so gentle) ride. As a relatively fragile, high value, high revenue form of lading, it may be desirable to obtain superior ride quality to that suitable for coal or grain.

Historically, auto rack cars were made by building a rack structure on top of a general purpose flat car. As such, the resultant car was sprung for the flat car design loads. When loaded with automobiles, this might yield a vertical bounce natural frequency in the range of 3 Hz. It would be preferable for the railcar vertical bounce natural frequency to be on the order of 1.4 Hz or less when loaded. Since this natural frequency varies as the square root of the quotient obtained by dividing the spring rate of the suspension by the overall sprung mass, it is desirable to reduce the spring constant, to increase the mass, or both.

One way to improve ride quality is to increase the dead sprung weight of the rail road car body. Deliberately increasing the mass of a freight car is counter intuitive, since many years of effort has gone into reducing the weight of rail cars relative to the weight of the lading for the reasons noted above. One manufacturer, for example, advertises a light weight aluminium auto-rack car. However, given the high value and low density of the lading, adding weight may be reasonable to obtain a desired level of ride quality. Further, auto rack rail cars tend to be tall, long, and thin, with the upper deck loads carried at a relatively high location as measured from top of rail. A significant addition of weight at a low height relative to top of rail may also be beneficial in reducing the height of the center of gravity of the loaded car.

Another way to improve ride quality is to decrease the spring rate. Decreasing the spring rate involves further considerations. Historically the deck height of a flat car tended to be very closely related to the height of the upper flange of the center sill. This height was itself established by the height of the cap of the draft pocket. The size of the draft pocket was standardised on the basis of the coupler chosen, and the allowable heights for the coupler knuckle. The deck height usually worked out to about 41 inches above top of rail. For some time auto rack cars were designed to a 19 ft height limit. To maximise the internal loading space, it has been considered desirable to lower the main deck as far as possible, particularly in tri-level cars. Since the lading is relatively light, the rail car trucks have tended to be light as well, such as 70 Ton trucks, as opposed to 100, 110 or 125 Ton trucks for coal, ore, or grain cars at 263,000, 286,000 or 315,000 lbs. gross weight on rail. Since the American Association of Railroads (AAR) specifies a minimum clearance of 5" above the wheels, the combination of low deck height, deck clearance, and minimum wheel height set an effective upper limit on the spring travel, and reserve spring travel range available. If softer springs are used, the remaining room for spring travel below the decks may well not be sufficient to provide the desired reserve height. In consequence, the present inventor proposes, contrary to lowering the main deck, that the main deck be higher than 42 inches to allow for more spring travel.

As noted above, many previous auto rack cars have been built to a 19 ft height. Another major trend in recent years has been the advent of "double stack" intermodal container cars capable of carrying two shipping containers stacked one above the other in a well or to other freight cars falling within the 20 ft 2 in. height limit of AAR plate H. Many main lines have track clearance profiles that can accommodate double stack cars. Consequently, it is now possible to use auto rack cars built to the higher profile of the double stack intermodal container cars.

While decreasing the primary vertical bounce natural frequency appears to be advantageous for auto rack rail road cars generally, including single car unit auto rack rail road cars, articulated auto rack cars may also benefit not only from adding ballast, but from adding ballast preferentially to the end units near the coupler end trucks. As explained more fully in the description below, the interior trucks of articulated cars tend to be more heavily burdened than the end trucks, primarily because the interior trucks share loads from two adjacent car units, while the coupler end trucks only carry loads from one end of one car unit. It would be advantageous to even out this loading so that the trucks have roughly similar vertical bounce frequencies.

Three piece trucks currently in use tend to use friction dampers, sometimes assisted by hydraulic dampers such as can be mounted, for example, in the spring set. Friction damping has most typically been provided by using spring loaded blocks, or snubbers, mounted with the spring set, with the friction surface bearing against a mating friction surface of the columns of the side frames, or, if the snubber is mounted to the side frame, then the friction surface is mounted on the face of the truck bolster. There are a number of ways to do this. In some instances, as shown at p. 847 of the 1961 *Car Bullders Cyclopedia* lateral springs are housed in the end of the truck bolster, the lateral springs pushing horizontally outward on steel shoes that bear on the vertical faces of the side columns of the side frames. This provides roughly constant friction (subject to the wear of the friction faces), without regard to the degree of compression of the main springs of the suspension.

In another approach, as shown at p. 715 of the 1997 *Car & Locomotive Cyclopedia*, one of the forward springs in the main spring group, and one of the rearward springs in the main spring group bear upon the underside, or short side, of a wedge. One of the long sides, typically an hypotenuse of a wedge, engages a notch, or seat, formed near the outboard end of the truck bolster, and the third side has the friction face that abuts, and bears against, the friction face of the side column (either front or rear, as the case may be), of the side frame. The action of this pair of wedges then provides damping of the various truck motions. In this type of truck the friction force varies directly with the compression of the springs, and increases and decreases as the truck flexes. In the vertical bounce condition, both friction surfaces work in the same direction. In the warping direction (when one wheel rises or falls relative to the other wheel on the same side, thus causing the side frame to pivot about the truck bolster) the friction wedges work in opposite directions against the restoring force of the springs.

The "hunting" phenomenon has been noted above. Hunting generally occurs on tangent (i.e., straight) track as railcar speed increases. It is desirable for the hunting threshold to occur at a speed that is above the operating speed range of the rail car. During hunting the side frames tend to want to rotate about a vertical axis, to a non-perpendicular angular orientation relative to the truck bolster sometimes called "parallelogramming" or lozenging. This will tend to cause angular deflection of the spring group, and will tend to generate a squeezing force on opposite diagonal sides of the wedges, causing them to tend to bear against the side frame columns. This diagonal action will tend to generate a restoring moment working against the angular deflection. The moment arm of this restoring force is proportional to half the width of the wedge, since half of the friction plate lies to either side of the centreline of the side frame. This tends to be a relatively weak moment connection, and the wedge, even if wider than normal, tends to be positioned over a single spring in the spring group.

Typically, for a truck of fixed wheelbase length, there is a trade-off between wheel load equalisation and resistance to hunting. Where a car is used for carrying high density commodities at low speeds, there may tend to be a higher emphasis on maintaining wheel load equalisation. Where a car is light, and operates at high speed there will be a greater emphasis on avoiding hunting. In general, the parallelogram deformation of the truck in hunting may be deterred by making the truck laterally more stiff. One approach to discouraging hunting is to use a transom, typically in the form of a channel running from between the side frames below the spring baskets. Another approach is to use a frame brace.

One way to address the hunting issue is to employ a truck having a longer wheelbase, or one whose length is proportionately great relative to its width. For example, at present two axle truck wheelbases may range from about 5'-3" to 6'-0". However, the standard North American track gauge is 4'-8½", giving a wheelbase to track width ratio possibly as small as 1.12. At 6'-0" the ratio is roughly 1.27. It would be preferable to employ a wheelbase having a longer aspect ratio relative to the track gauge. As described herein, one aspect of the present invention employs a truck with a longer wheelbase, which may be about 80 to 86 inches, giving a ratio of 1.42 or 1.52. This increase in wheelbase length may tend also to be benign in terms of wheel loading equalisation.

In a typical spring seat and spring group arrangement, the side frame window may typically be of the order of 21 inches in height from the spring seat base to the underside of the overarching compression member, and the width of the side frame window between the wear plates on the side frame columns is typically about 18", giving a side frame window that is taller than wide in the ratio of about 7:6. Similarly, the bottom spring seat has a base that is typically about 18 inches long to correspond to the width of the side frame window, and about 16 inches wide in the transverse direction, that is being longer than wide. It may be advantageous to make the side frame windows wider, and the spring seat correspondingly longer to accommodate larger diameter long travel springs with a softer spring rate or a larger number of softer coils of smaller diameter. At the same time, lengthening the wheel base of the truck may also be advantageous since it is thought that a longer wheelbase may ameliorate truck hunting performance, as noted above. Such a design change is counter-intuitive since it may generally be desired to keep truck size small, and widening the unsupported window span may not have been considered desirable heretofore.

Another way to raise the hunting threshold is to increase the parallelogram stiffness between the bolster and the side frames. It is possible, as described herein, to employ pairs of damper wedges, of comparable size to those previously used, the two wedges being placed side by side and each individually supported by a different spring, or being the outer two wedges in a three deep spring group, to give a larger moment arm to the restoring force and to the damping associated with that force.

One determinant of overall ride quality is the dynamic response to lateral perturbations. That is, when there is a lateral perturbation at track level, the rigid steel wheelsets of the truck may be pushed sideways relative to the car body. Lateral perturbations may arise for example from uneven track, or from passing over switches or from turnouts and other track geometry perturbations. When the train is moving at speed, the time duration of the input pulse due to the perturbation may be very short.

The suspension system of the truck reacts to the lateral perturbation. It is generally desirable for the force transmission to be relatively low. High force transmissibility, and corresponding high lateral acceleration, may tend not to be advantageous for the lading. This is particularly so if the lading includes relatively fragile goods, such as automobiles, electronic equipment, white goods, and other consumer products. In general, the lateral stiffness of the suspension reflects the combined displacement of (a) the sideframe between (i) the pedestal bearing adapter and (ii) the bottom spring seat (that is, the sideframes swing laterally as a pendulum with the pedestal bearing adapter being the top pivot point for the pendulum); and (b) the lateral deflection of the springs between (i) the lower spring seat in the sideframe and (ii) the upper spring mounting against the underside of the truck bolster, and (c) the moment and the associated angular displacement between the (i) spring seat in the sideframe and (ii) the upper spring mounting against the underside of the truck bolster.

In a conventional rail road car truck, the lateral stiffness of the spring groups is sometimes estimated as being approximately ½ of the vertical spring stiffness. Thus the choice of vertical spring stiffness may strongly affect the lateral stiffness of the suspension. The vertical stiffness of the spring groups may tend to yield a vertical deflection at the releasable coupler from the light car (i.e., empty) condition to the fully laden condition of about 2 inches. For a conventional grain or coal car subject to a 286,000 lbs., gross weight on rail limit, this may imply a dead sprung load of some 50,000 lbs., and a live sprung load of some 220,000 lbs., yielding a spring stiffness of 25–30,000 lbs./in., per spring group (there being, typically, two groups per truck, and two trucks per car). This may yield a lateral spring stiffness of 13–16,000 lbs./in per spring group. It should be noted that the numerical values given in this background discussion are approximations of ranges of values, and are provided for the purposes of general order-of-magnitude comparison, rather than as values of a specific truck.

The second component of stiffness relates to the lateral deflection of the sideframe itself. In a conventional truck, the weight of the sprung load can be idealized as a point load applied at the center of the bottom spring seat. That load is carried by the sideframe to the pedestal seat mounted on the bearing adapter. The vertical height difference between these two points may be in the range of perhaps 12 to 18 inches, depending on wheel size and sideframe geometry. For the general purposes of this description, for a truck having 36 inch wheels, 15 inches (+/−) might be taken as a roughly representative height.

The pedestal seat may typically have a flat surface that bears on an upwardly crowned surface of the bearing adapter. The crown may typically have a radius of curvature of about 60 inches, with the center of curvature lying below the surface (i.e., the surface is concave downward).

When a lateral shear force is imposed on the springs, there is a reaction force in the bottom spring seat that will tend to deflect the sideframe, somewhat like a pendulum. When the sideframe takes on an angular deflection in one direction, the line of contact of the flat surface of the pedestal seat with the crowned surface of the bearing adapter will tend to move along the arc of the crown in the opposite direction. That is, if the bottom spring seat moves outboard, the line of contact will tend to move inboard. This motion is resisted by a moment couple due to the sprung weight of the car on the bottom spring seat, acting on a moment arm between (a) the line of action of gravity at the spring seat and (b) the line of contact of the crown of the bearing adapter. For a 286,000 lbs. car the apparent stiffness of the sideframe may be of the order of 18,000–25,000 lbs./in, measured at the bottom spring seat. That is, the lateral stiffness of the sideframe (i.e., the pendulum action by itself) can be greater than the (already relatively high) lateral stiffness of the spring group in shear, and this apparent stiffness is proportional to the total sprung weight of the rail car (including lading). When taken as being analogous to two springs in series, the overall equivalent lateral spring stiffness may be of the order of 8,000 lbs./in. to 10,000, per sideframe. A car designed for lesser weights may have softer apparent stiffness. This level of stiffness may not always yield as smooth a ride as may be desired.

There is another component of spring stiffness due to the unequal compression of the inside and outside portions of the spring group as the bottom spring seat rotates relative to the upper spring group mount under the bolster. This stiffness, which is additive to (that is, in parallel with) the stiffness of the sideframe, can be significant, and may be of the order of 3000–3500 lbs./in per spring group, depending on the stiffness of the springs and the layout of the group. Other second and third order effects are neglected for the purpose of this description. The total lateral stiffness for one sideframe, including the spring stiffness, the pendulum stiffness and the spring moment stiffness, for a S2HD 110 Ton truck may be about 9200 lbs/inch per side frame.

It has been observed that it may be preferable to have springs of a given vertical stiffness to give certain vertical ride characteristics, and a different characteristic for lateral perturbations. In particular, a softer lateral response may be desired at high speed (greater than about 50 m.p.h) and relatively low amplitude to address a truck hunting concern, while a different spring characteristic may be desirable to address a low speed (roughly 10–25 m.p.h) roll characteristic, particularly since the overall suspension system may have a roll mode resonance lying in the low speed regime.

An alternate type of three piece truck is the "swing motion" truck. One example of a swing motion truck is shown at page 716 in the 1980 *Car and Locomotive Cyclopedia* (1980, Simmons-Boardman, Omaha). This illustration, with captions removed, is the basis of FIGS. 1*a*, 1*b* and 1*c*, herein, labelled "Prior Art". Since the truck has both lateral and longitudinal axes of symmetry, the artist has only shown half portions of the major components of the truck. The particular example illustrated is a swing motion truck produced by National Castings Inc., more commonly referred to as "NACO". Another example of a NACO Swing Motion truck is shown at page 726 of the 1997 *Car and Locomotive Cyclopedia* (1997, Simmons-Boardroom, Omaha). An earlier swing motion three piece truck is shown and described in U.S. Pat. No. 3,670,660 of Weber et al., issued Jun. 20, 1972, the specification of which is incorporated herein by reference.

In a swing motion truck, the sideframe is mounted as a "swing hanger" and acts much like a pendulum. In contrast to the truck described above, the bearing adapter has an upwardly concave rocker bearing surface, having a radius of curvature of perhaps 10 inches and a center of curvature lying above the bearing adapter. A pedestal rocker seat nests in the upwardly concave surface, and has itself an upwardly concave surface that engages the rocker bearing surface. The pedestal rocker seat has a radius of curvature of perhaps 5 inches, again with the center of curvature lying upwardly of the rocker.

In this instance, the rocker seat is in dynamic rolling contact with the surface of the bearing adapter. The upper rocker assembly tends to act more like a hinge than the shallow crown of the bearing adapter described above. As such, the pendulum may tend to have a softer, perhaps much softer, response than the analogous conventional sideframe. Depending on the geometry of the rocker, this may yield a sideframe resistance to lateral deflection in the order of ¼ (or less) to about ½ of what might otherwise be typical. If combined in series with the spring group stiffness, it can be seen that the relative softness of the pendulum may tend to become the dominant factor. To some extent then, the lateral stiffness of the truck becomes less strongly dependent on the chosen vertical stiffness of the spring groups at least for small displacements. Furthermore, by providing a rocking lower spring seat, the swing motion truck may tend to reduce, or eliminate, the component of lateral stiffness that may tend to arise because of unequal compression of the inboard and outboard members of the spring groups when the sideframe has an angular displacement, thus further softening the lateral response.

In the truck of U.S. Pat. No. 3,670,660 the rocking of the lower spring seat is limited to a range of about 3 degrees to either side of center, and a transom extends between the sideframes, forming a rigid, unsprung, lateral connecting member between the rocker plates of the two sideframes. In this context, "unsprung" refers to the transom being mounted to a portion of the truck that is not resiliently isolated from the rails by the main spring groups.

When the three degree condition is reached, the rockers "lock-up" against the side frames, and the dominant lateral displacement characteristic is that of the main spring groups in shear, as illustrated and described by Weber. The lateral, unsprung, sideframe connecting member, namely the transom, has a stop that engages a downwardly extending abutment on the bolster to limit lateral travel of the bolster relative to the sideframes. This use of a lateral connecting member is shown and described in U.S. Pat. No. 3,461,814 of Weber, issued Mar. 7, 1967, also incorporated herein by reference. As noted in U.S. Pat. No. 3,670,660 the use of a spring plank had been known, and the use of an abutment at the level of the spring plank tended to permit the end of travel reaction to the truck bolster to be transmitted from the sideframes at a relatively low height, yielding a lower overturning moment on the wheels than if the end-of-travel force were transmitted through gibs on the truck bolster from the sideframe columns at a relatively greater height. The use of a spring plank in this way was considered advantageous.

In Canadian Patent 2,090,031, (issued Apr. 15, 1997 to Weber et al.,) noting the advent of lighter weight, low deck cars, Weber et al., replaced the transom with a lateral rod assembly to provide a rigid, unsprung connection member between the platforms of the rockers of the lower spring seats. As noted above, one type of car in which relative lightness and a low main deck has tended to be found is an Autorack car.

For the purposes of rapid estimation of truck lateral stiffness, the following formula can be used:

$$k_{truck}=2\times[(k_{sideframe})^{-1}+(k_{spring\ shear})^{-1}]^{-1}$$

where $k_{sideframe}=[k_{pendulum}+k_{spring\ moment}]$ $k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

For the range of motion that may typically be of interest, and for small angles of deflection, $k_{pendulum}$ can be taken as being approximately constant at, for example, the value obtained for deflection of one degree. This may tend to be a sufficiently accurate approximation for the purposes of general calculation.

In a pure pendulum, the lateral constant for small angles approximates k=W/L, where k is the lateral constant, W is the weight, and L is the pendulum length. Further, for the purpose of rapid comparison of the lateral swinging of the sideframes, an equivalent pendulum length for small angles of deflection can be defined as $L_{eq}=W/k_{pendulum}$. In this equation W represents the sprung weight borne by that sideframe, typically ¼ of the total sprung weight for a symmetrical single unit rail car. For a conventional truck $L_{eq}$ may be of the order of about 3 or 4 inches. For a swing motion truck, $L_{eq}$ may be of the order of about 10 to 15 inches.

It is also possible to define the pendulum lateral stiffness (for small angles) in terms of the length of the pendulum, the radius of curvature of the rocker, and the design weight carried by the pendulum according to the formula:

$$k_{pendulum}=(F_{lateral}/\delta_{lateral})=(W/L_{pendulum})[(R_{curvature}/L_{pendulum})+1]$$

where:

$k_{pendulum}$=the lateral stiffness of the pendulum $F_{lateral}$=the force per unit of lateral deflection $\delta_{lateral}$=a unit of lateral deflection W=the weight borne by the pendulum $L_{pendulum}$=the length of the pendulum, being the vertical distance from the contact surface of the bearing adapter to the bottom spring seat $R_{curvature}$=the radius of curvature of the rocker surface Following from this, if the pendulum stiffness is taken in series with the lateral spring stiffness, then the resultant overall lateral stiffness can be obtained. Using this number in the denominator, and the design weight in the numerator yields a length, effectively equivalent to a pendulum length if the entire lateral stiffness came from an equivalent pendulum according to $$L_{resultant}=W/k_{lateral\ total}$$

For a conventional truck with a 60 inch radius of curvature rocker, and stiff suspension, this length, $L_{resultant}$ may be of the order of 6–8 inches, or thereabout.

So that the present invention may better be understood by comparison, in the prior art illustration of FIGS. 1*a*, 1*b*, and 1*c*, a NACO swing motion truck is identified generally as A20. Inasmuch as the truck is symmetrical about the truck center both from side-to-side and lengthwise, the artist has shown only half of the bolster, identified as A22, and half of one of the sideframes, identified as A24.

In the customary manner, sideframe A24 has defined in it a generally rectangular window A26 that admits one of the ends of the bolster A28. The top boundary of window A26 is defined by the sideframe arch, or compression member identified as top chord member A30, and the bottom of window A26 is defined by a tension member, identified as bottom chord A32. The fore and aft vertical sides of window A26 are defined by sideframe columns A34.

At the swept up ends of sideframe A24 there are sideframe pedestal fittings A38 which each accommodate an upper rocker identified as a pedestal rocker seat A40, that engages the upper surface of a bearing adapter A42. Bearing adapter A42 itself engages a bearing mounted on one of the axles of the truck adjacent one of the wheels. A rocker seat A40 is located in each of the fore and aft pedestals, the rocker seats being longitudinally aligned such that the sideframe can swing transversely relative to the rolling direction of the truck A20 generally in what is referred to as a "swing hanger" arrangement.

The bottom chord of the sideframe includes pockets A44 in which a pair of fore and aft lower rocker bearing seats A46 are mounted. The lower rocker seat A48 has a pair of rounded, tapered ends or trunnions A50 that sit in the lower rocker bearings A48, and a medial platform A52. An array of four comer bosses A54 extend upwardly from platform A52.

An unsprung, lateral, rigid connecting member in the nature of a spring plank, or transom A60 extends cross-wise between the sideframes in a spaced apart, underslung, relationship below truck bolster A22. Transom A60 has an end portion that has an array of four apertures A62 that pick up on bosses A54. A grouping, or set of springs A64 seats on the end of the transom, the comer springs of the set locating above bosses A54.

The spring group, or set A64, is captured between the distal end of bolster A22 and the end portion of transom A60. Spring set A64 is placed under compression by the weight of the rail car body and lading that bears upon bolster A22 from above. In consequence of this loading, the end portion of transom A60, and hence the spring set, are carried by platform A54. The reaction force in the springs has a load path that is carried through the bottom rocker A70 (made up of trunnions A50 and lower rocker bearings A48) and into the sideframe A22 more generally.

Friction damping is provided by damping wedges A72 that seat in mating bolster pockets A74. Bolster pockets A74 have inclined damper seats A76. The vertical sliding faces of the friction damper wedges then ride up an down on friction wear plates A80 mounted to the inwardly facing surfaces of the sideframe columns.

The "swing motion" truck gets its name from the swinging motion of the sideframe on the upper rockers when a lateral track perturbation is imposed on the wheels. The reaction of the sideframes is to swing, rather like pendula, on the upper rockers. When this occurs, the transom and the truck bolster tend to shift sideways, with the bottom spring seat platform rotating on the lower rocker.

The upper rockers are inserts, typically of a hardened material, whose rocking, or engaging, surface A80 has a radius of curvature of about 5 inches, with the center of curvature when assembled) lying above the upper rockers (i.e., the surface is upwardly concave).

As noted above, one of the features of a swing motion truck is that while it may be quite stiff vertically, and while it may be resistant to parallelogram deformation because of the unsprung lateral connection member, it may at the same time tend to be laterally relatively soft.

The use of multiple variable friction force dampers in which the wedges are mounted over members of the spring group, is shown in U.S. Pat. No. 3,714,905 of Barber, issued Feb. 6, 1973. The damper arrangement shown by Barber is not apparently presently available in the market, and does not seem ever to have been made available commercially.

Notably, the damper wedges shown in Barber appear to have relatively sharply angled wedges, with an included angle between the friction face (i.e., the face bearing against the side frame column) and the sliding face (i.e., the angled face seated in the damper pocket formed in the bolster, typically the hypotenuse) of roughly 35 degrees. The angle of the third, or opposite, horizontal side face, namely the face that seats on top of the vertically oriented spring, is the complementary angle, in this example, being about 55 degrees. It should be noted that as the angle of the wedge becomes more acute, (i.e., decreasing from about 35 degrees) the wedge may have an undesirable tendency to jam in the pocket, rather than slide.

Barber, above, shows a spring group of variously sized coils with four relatively small corner coils loading the four relatively sharp angled dampers. From the relative sizes of the springs illustrated, it appears that Barber was contemplating a spring group of relatively traditional capacity—a load of about 80,000 lbs., at a "solid" condition of 3 1/16 inches of travel, for example, and an overall spring rate for the group of about 25,000 lbs/inch, to give 2 inches of overall rail car static deflection for about 200,000 lbs live load.

Apparently keeping roughly the same relative amount of damping overall as for a single damper, Barber appears to employ individual B331 coils (k=538 lb/in, (+/−)) under each friction damper, rather than a B432 coil (k=1030 lb/in, (+/−)) as might typically have been used under a single damper for a spring group of the same capacity. As such, it appears that Barber contemplated that springs accounting for somewhat less than 15% of the overall spring group stiffness would underlie the dampers.

These spring stiffness might typically be suitable for a rail road car carrying iron ore, grain or coal, where the lading is not overly fragile, and the design ratio of live load to dead sprung load is typically greater than 3:1. It might not be advantageous for a rail road car for transporting automobiles, auto parts, consumer electronics or other white goods of relatively low density and high value where the design ratio of live load to dead sprung load may be well less than 2:1, and quite possibly lying in the range of 0.4:1 to 1:1.

In the past, spring groups have been arranged such that the spring loading under the dampers has been proportionately small. That is, the dampers have typically been seated on side spring coils, as shown in the AAR standard spring groupings shown in the 1997 *Car & Locomotive Cyclopedia* at pages 743–746, in which the side spring coils, inner and outer as may be, are often B321, B331, B421, B422, B432, or B433 springs as compared to the main spring coils, such that the springs under the dampers have lower spring rates than the other coil combinations in the other positions in the spring group. As such, the dampers may be driven by less than 15% of the total spring stiffness of the group generally.

In U.S. Pat. No. 5,046,431 of Wagner, issued Sep. 10, 1991, the standard inboard-and-outboard gib arrangement on the truck bolster was replaced by a single central gib mounted on the side frame column for engaging the shoulders of a vertical channel defined in the end of the truck bolster. In doing this, the damper was split into inboard and outboard portions, and, further, the inboard and outboard portions, rather than lying in a common transverse vertical plane, were angled in an outwardly splayed orientation.

Wagner's gib and damper arrangement may not necessarily be desirable in obtaining a desired level of ride quality. In obtaining a soft ride it may be desirable that the truck be relatively soft not only in the vertical bounce direction, but also in the transverse direction, such that lateral track perturbations can be taken up in the suspension, rather than be transmitted to the car body, (and hence to the lading), as may tend undesirably to happen when the gibs bottom out (i.e., come into hard abutting contact with the side frame) at the limit of horizontal travel.

The present inventor has found it desirable that there be an allowance for lateral travel of the truck bolster relative to the wheels of the order of 1 to 1½ inches to either side of a neutral central position. Wagner does not appear to have been concerned with this issue. On the contrary, Wagner appears to show quite a tight gib clearance, with relatively little travel before solid contact. Furthermore, transverse displacement of the truck bolster relative to the side frame is typically resiliently resisted by the horizontal shear in the spring groups, and by the pendulum motion of the side frames rocking on the crowns of the bearing adapters, these two components being combined like springs in series. Wagner's canted dampers appear to make lateral translation of the bolster stiffer, rather than softer. This may not be advantageous for relatively fragile lading. In the view of the present inventor, while it is advantageous to increase resistance to the hunting phenomenon, it may not be advantageous to do so at the expense of increasing lateral stiffness.

In the damper groups themselves, it is thought that parallelogram deflection of the truck such that the truck bolster is not perpendicular to the side frame, as during hunting, may tend to cause the dampers to try to twist angularly in the damper seats. In that situation one corner of the damper may tend to be squeezed more tightly than the other. As a result, the tighter corner may try to retract relative to the less tight corner, causing the damper wedge to squirm and rotate somewhat in the pocket. This tendency to twist may also tend to reduce the squaring, or restoring force that tends to move the truck back into a condition in which the truck bolster is square relative to the side frames.

Consequently, it may be desirable to discourage this twisting motion by limiting the freedom to twist, as, for example, by introducing a groove or ridge, or keyway, or channel feature to govern the operation of the spring in the damper pocket. It may also be advantageous to use a split wedge to discourage twisting, such that one portion of the wedge can move relative to the other, thus finding a different position in a linear sense without necessarily forcing the other portion to twist. Further still, it may be advantageous to employ a means for encouraging a laterally inboard portion of the damper, or damper group, to be biased to its most laterally inboard position, and a laterally outboard portion of the damper, or the damper group, to be biased to its most laterally outboard position. In that way, the moment arm of the restoring force may tend to remain closer to its largest value. One way to do this, as described in the description of the invention, below, is to add a secondary angle to the wedge.

In the terminology herein, wedges have a primary angle Φ, namely the included angle between (a) the sloped damper pocket face mounted to the truck bolster, and (b) the side frame column face, as seen looking from the end of the bolster toward the truck center. This is the included angle described above. A secondary angle is defined in the plane of angle Φ, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper.

The secondary angle β is defined as the lateral rake angle seen when looking at the damper parallel to the plane of angle Φ. As the suspension works in response to track perturbations, the wedge forces acting on the secondary angle will tend to urge the damper either inboard or outboard according to the angle chosen. Inasmuch as the tapered region of the wedge may be quite thin in terms of vertical through-thickness, it may be desirable to step the sliding face of the wedge (and the co-operating face of the bolster seat) into two or more portions. This may be particularly so if the angle of the wedge is large.

Split wedges and two part wedges having a chevron, or chevron like, profile when seen in the view of the secondary angle can be used. Historically, split wedges have been deployed as a pair over a single spring, the split tending to permit the wedges to seat better, and to remain better seated, under twisting condition than might otherwise be the case. The chevron profile of a solid wedge may tend to have the same intent of preventing rotation of the sliding face of the wedge relative to the bolster in the plane of the primary angle of the wedge. Split wedges and compound profile wedges can be employed in pairs as described herein.

In a further variation, where a single broad wedge is used, with a compound or other profile, it may be desirable to seat the wedge on two or more springs in an inboard-and-outboard orientation to create a restoring moment such as might not tend to be achieved by a single spring alone. That is, even if a single large wedge is used, the use of two, spaced apart springs may tend to generate a restoring moment if the wedge tries to twist, since the deflection of one spring may then be greater that the other.

When the dampers are placed in pairs, either immediately side-by-side or with spacing between the pairs, the restoring moment for squaring the truck will tend not only to be due to the increase in compression to one set of springs due to the extra tendency to squeeze the dampers downward in the pocket, but due to the difference in compression between the springs that react to the extra squeezing of one diagonal set of dampers and the springs that act against the opposite diagonal pair that will tend to be less tightly squeezed.

SUMMARY OF THE INVENTION

In an aspect of the invention there is an autorack rail road car having a car body for the transport of automobiles, the car body being supported for rolling motion along rail road tracks by rail road car trucks. At least one of the trucks has wheels whose diameter is greater than 33 inches.

In a further feature of that aspect of the invention, at least one of the trucks has wheels that are at least 36 inches in diameter. In another feature of that aspect of the invention, the rail road car truck has wheels that are at least 38 inches in diameter. In yet a further feature of that aspect of the invention, at least one of the rail road car trucks has an overall vertical spring rate of less than 50,000 Lbs./in. In a further feature, the overall vertical spring rate of the truck is less than 40,000 Lbs./in. In a still further feature, the overall vertical spring rate is less than 30,000 Lbs./in. In a still further feature, the overall vertical spring rate is less than 20,000 Lbs./in. In a still further feature, the overall vertical spring rate is in the range of 10,000 Lbs/in. to 20,000 Lbs./in.

In a still further feature, at least one of the trucks is a swing motion truck. In an additional feature, the truck includes a pair of first and second side frames and a transversely oriented truck bolster mounted between the side frames. The side frames are mounted to the wheelsets, and are able to swing laterally relative to the wheels. The effective equivalent length of the swinging side frames is greater than 10 inches.

In a still further feature, at least one of the trucks is free of unsprung lateral cross-members. In another feature of that feature of the invention, the truck is free of a transom.

In still another feature of that aspect of the invention, at least one of the trucks has friction dampers mounted in laterally spaced pairs, the dampers being biased to exert a squaring restorative moment couple on the truck bolster relative to the side frames when the truck bolster is deflected from square relative to the side frames. In still another feature of that aspect of the invention, at least one of the trucks has springs mounted in inboard and outboard pairs between the bolster and each of the side frames, said inboard and outboard pairs being oriented to provide a squaring restorative moment couple to the bolster relative to the side frames.

In still another feature of the invention, the rail car includes a rail car body unit that has a weight of at least 90,000 Lbs., in an unloaded condition. In a further feature of the invention, the rail car body unit has an unladen weight of at least 100,000 Lbs. In another further feature the rail car body unit has an unladen weight of at least 120,000 Lbs. In another further feature, the rail car body unit has an unladen weight of at least 130,000 Lbs.

In another feature of that aspect of the invention, the rail road car body unit includes at least 15,000 Lbs., of ballast. In another feature, the rail road car body unit includes at least 25,000 Lbs., of ballast. In another feature of the invention, the rail road car body unit includes at least 40,000 Lbs., of ballast. In a further feature of the invention, the ballast weight is incorporated in a deck plate. In another feature of the invention the rail road car has a deck plate exceeding ⅜ inches in thickness. In another feature of the invention the rail road car body has a deck plate exceeding ½ inches in thickness. In another feature of the invention the rail road car body has a deck plate exceeding ¾ inches in thickness. In another feature of the invention the rail road car body has a deck plate exceeding 1 inch in thickness. In another feature of the invention the rail road car body has a deck plate exceeding 1¼ inch in thickness.

In another feature of that aspect of the invention at least one of the rail car trucks has a wheelbase exceeding 73 inches in length. In another feature at least one of the trucks has a wheelbase that exceeds 1.3 times the gauge width of the rails. In another feature the wheelbase is in the range of 78 to 88 inches in length. In another feature of the invention the wheelbase is in the range of 1.3 to 1.6 times the track gauge width.

In another feature of the invention, the rail road car is an articulated railroad car. In still another feature of the invention, the rail road car is an articulated rail road car, and one of the articulated connectors is cantilevered relative to the truck closest thereto. In another feature the articulated rail road car is a three pack rail road car. In still another feature the three pack rail road car has a middle unit connected between two end units. Each of the end units has a coupler end truck, and each of the end units has an asymmetric car body weight distribution in which most of the weight of the end car body is carried by the end truck. In a further feature, the end car body is ballasted. In a still further feature, the ballast of the end car body is has a distribution that is biased toward the end truck.

DETAILED DESCRIPTION OF THE PREFERRED EMBODIMENT

Figures 1A, 1B, 1C:
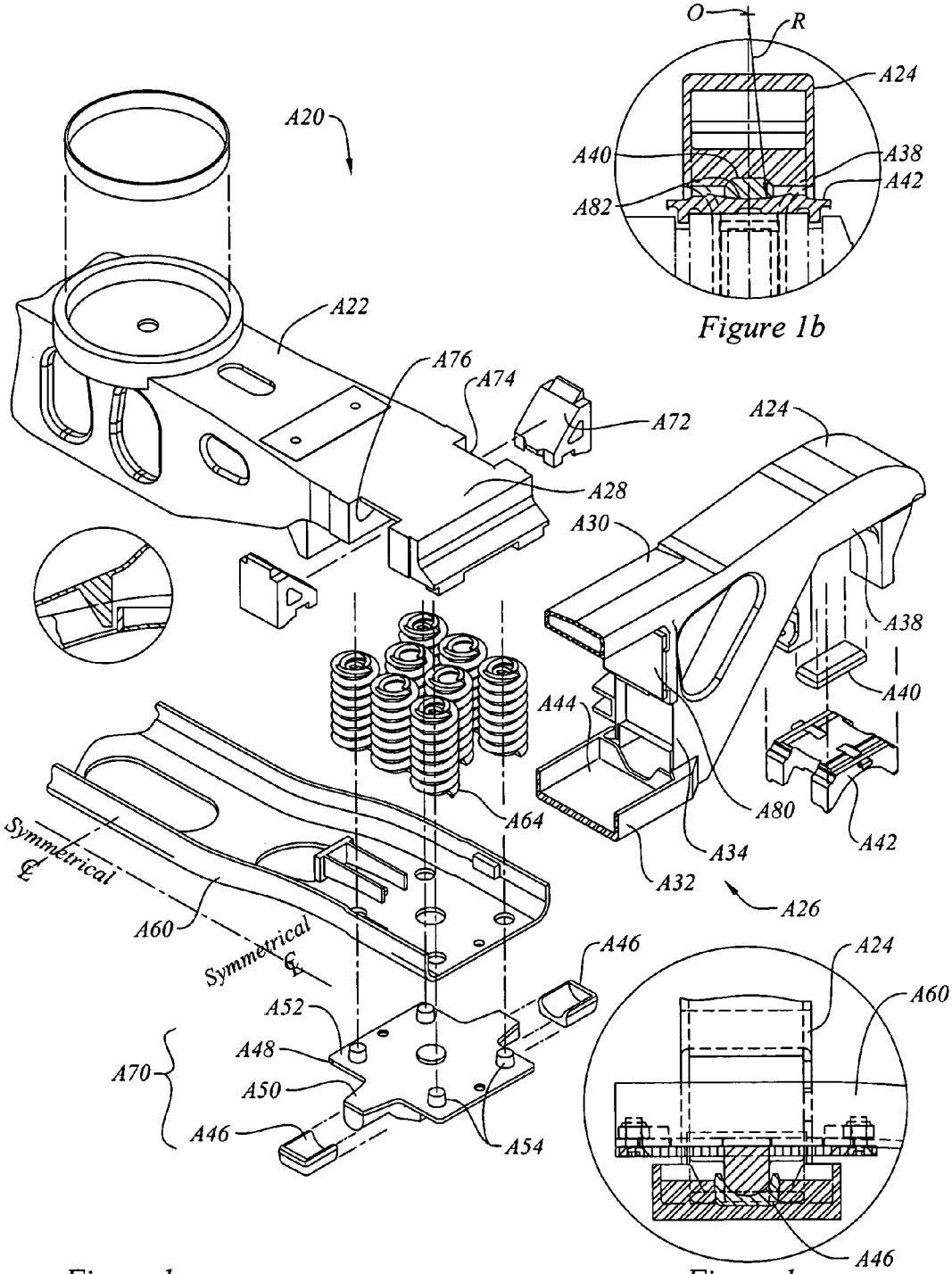
FIG. 1*a* shows a prior art exploded partial view illustration of a swing motion truck, much as shown at page 716 in the 1980 *Car and Locomotive Cyclopedia;*
FIG. 1*b* shows a cross-sectional detail of an upper rocker assembly of the truck of FIG. 1*a;*
FIG. 1*c* shows a cross-sectional detail of a lower rocker assembly of the truck of FIG. 1*a;*

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit, indicated as CL-Rail Car. The term "longitudinally inboard", or "longitudinally outboard" is a distance taken relative to a mid-span lateral section of the car, or car unit. Pitching motion is angular motion of a rail car unit about a horizontal axis perpendicular to the longitudinal direction. Yawing is angular motion about a vertical axis. Roll is angular motion about the longitudinal axis.

Reference is made in this description to rail car trucks and in particular to three piece rail road freight car trucks. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs, "70 Ton" corresponds to 220,000 lbs, "100 Ton" corresponds to 263,000 lbs, and "125 Ton" corresponds to 315,000 lbs. In each case the load limit per truck is then half the maximum gross car weight on rail. Two other types of truck are the "110 Ton" truck for 286,000 Lbs GWR and the "70 Ton Special" low profile truck sometimes used for auto rack cars. Given that the rail road car trucks described herein tend to have both longitudinal and transverse axes of symmetry, a description of one half of an assembly may generally also be intended to describe the other half as well, allowing for differences between right hand and left hand parts.

Portions of this application refer to friction dampers, and multiple friction damper systems. There are several types of damper arrangement as shown at pages 715–716 of the 1997 *Car and Locomotive Encyclopedia*, those pages being incorporated herein by reference. Double damper arrangements are shown and described in my co-pending U.S. patent application. Each of the arrangements of dampers shown at pp. 715 to 716 of the 1997 *Car and Locomotive Encyclopedia* can be modified to employ a four cornered, double damper arrangement of inner and outer dampers.

Figure 2A:
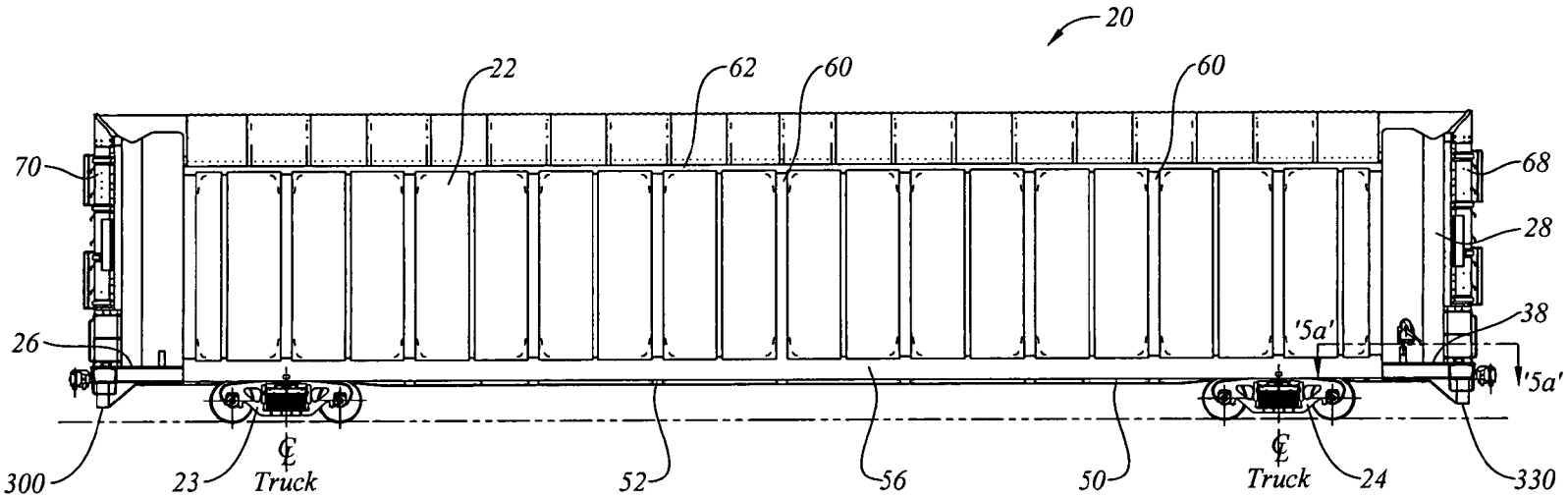
FIG. 2*a* shows a side view of a single unit auto rack rail road car.
Figure 2B:
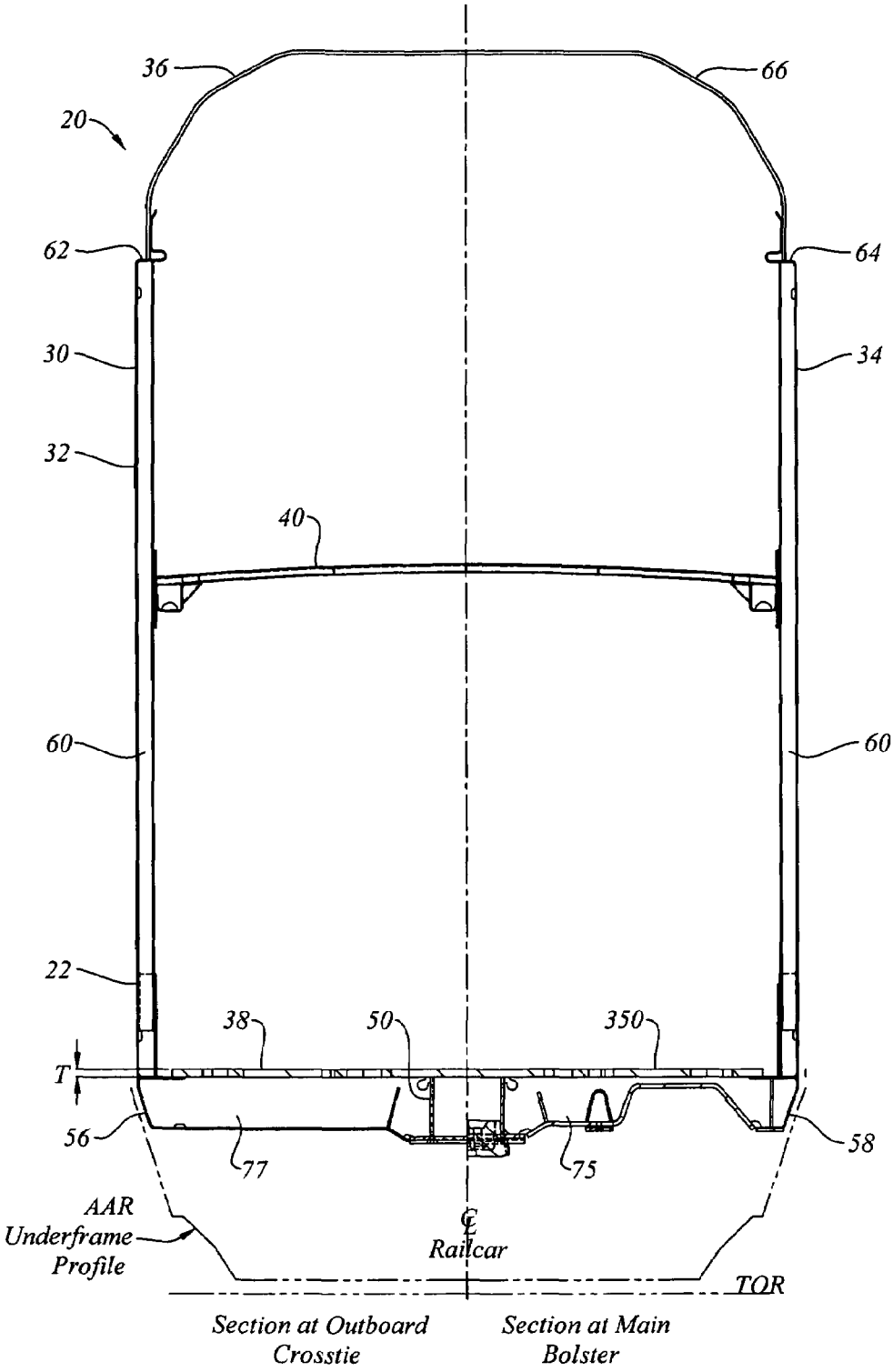
FIG. 2*b* shows a cross-sectional view of the auto-rack rail road car of FIG. 2*a* in a bi-level configuration, one half section of FIG. 2*b* being taken through the main bolster and the other half taken looking at the cross-tie outboard of the main bolster.

FIGS. 2*a*, 3*a*, 3*b*, 4*a*, and 4*b*, show different types of rail road freight cars in the nature of auto rack rail road cars, all sharing a number of similar features. FIG. 2*a* (side view) shows a single unit autorack rail road car, indicated generally as 20. It has a rail car body 22 supported for rolling motion in the longitudinal direction (i.e., along the rails) upon a pair of three-piece rail road freight car trucks 23 and 24 mounted at main bolsters at either of the first and second ends 26, 28 of rail car body 22. Body 22 has a housing structure 30, including a pair of left and right hand sidewall structures 32, 34 and an over-spanning canopy, or roof 36 that cooperate to define an enclosed lading space. Body 22 has staging in the nature of a main deck 38 running the length of the car between first and second ends 26, 28 upon which wheeled vehicles, such as automobiles can be conducted by circus-loading. Body 22 can have staging in either a bi-level configuration, as shown in FIG. 2*b*, in which a second, or upper deck 40 is mounted above main deck 38 to permit two layers of vehicles to be carried; or a tri-level configuration with a mid-level deck, similar to deck 40, and a top deck, also similar to deck 40, are mounted above each other, and above main deck 38 to permit three layers of vehicles to be carried. The staging, whether bi-level or tri-level, is mounted to the sidewall structures 32, 34. Each of the decks defines a roadway, trackway, or pathway, by which wheeled vehicles such as automobiles can be conducted between the ends of rail road car 20.

A through center sill 50 extends between ends 26, 28. A set of cross-bearers 52 extend to either side of center sill 50, terminating at side sills 56, 58 that run the length of car 20 parallel to outer sill 50. Main deck 38 is supported above cross-bearers 52 and between side sills 56, 58. Sidewall structures 32, 34 each include an array of vertical support members, in the nature of posts 60, that extend between side sills 56, 58, and top chords 62, 64. A corrugated sheet roof 66 extends between top chords 62 and 64 above deck 38 and such other decks as employed. Radial arm doors 68, 70 enclose the end openings of the car, and are movable to a closed position to inhibit access to the interior of car 20, and to an open position to give access to the interior. Each of the decks has bridge plate fittings (not shown) to permit bridge plates to be positioned between car 20 and an adjacent car when doors 68 or 70 are opened to permit circus loading of the decks. Both ends of car 20 have couplers and draft gear for connecting to adjacent rail road cars.

Two-Unit Articulated Auto Rack Car

Figure 3B:
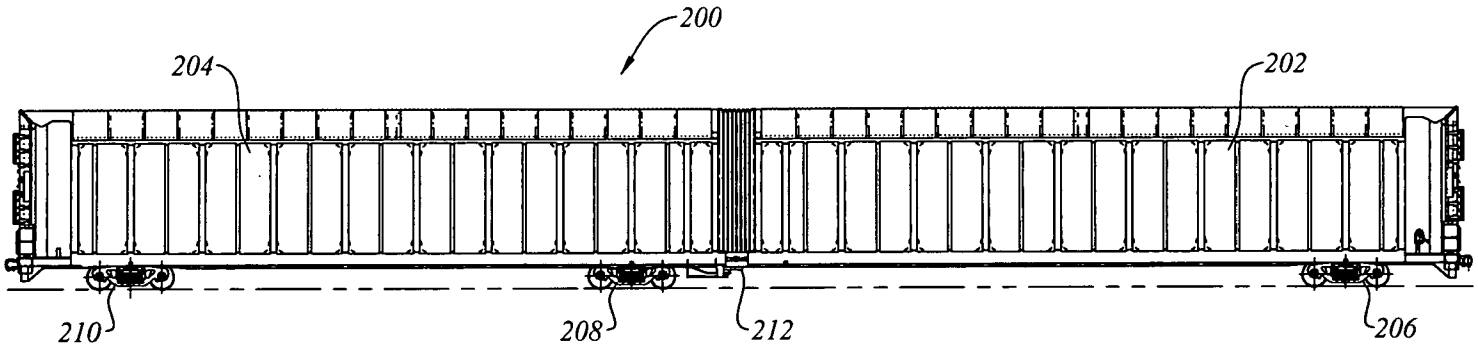
FIG. 3*b* shows a side view of an alternate auto rack rail road car to that of FIG. 3*a*, having a cantilevered articulation.
Figure 3A:
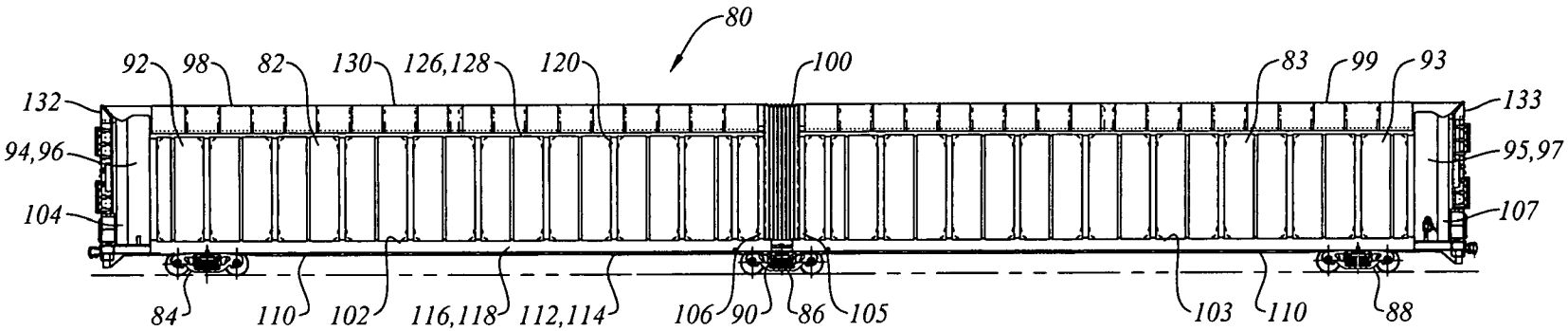
FIG. 3*a* shows a side view of a two unit articulated auto rack rail road car.

Similarly, FIG. 3*a* shows a two unit articulated auto rack rail road car, indicated generally as 80. It has a first rail car unit body 82, and a second rail car unit body 85, both supported for rolling motion in the longitudinal direction (i.e., along the rails) upon rail car trucks 84, 86 and 88. Rail car trucks 84 and 88 are mounted at main bolsters at respective coupler ends of the first and second rail car unit bodies 83 and 84. Truck 86 is mounted beneath articulated connector 90 by which bodies 83 and 84 are joined together. Each of bodies 83 and 84 has a housing structure 92, 93, including a pair of left and right hand sidewall structures 94, 96 (or 95, 97) and a canopy, or roof 98 (or 99) that define an enclosed lading space. A bellows structure 100 links bodies 82 and 83 to discourage entry by vandals or thieves.

Each of bodies 82, 83 has staging in the nature of a main deck similar to deck 38 running the length of the car unit between first and second ends 104, 106 (105, 107) upon which wheeled vehicles, such as automobiles can be conducted. Each of bodies 82, 83 can have staging in either a bi-level configuration, as shown in FIG. 1*b*, or a tri-level configuration. Other than brake fittings, and other minor fittings, car unit bodies 82 and 83 are substantially the same, differing in that car body 82 has a pair of female side-bearing arms adjacent to articulated connector 90, and car body 83 has a co-operating pair of male side bearing arms adjacent to articulated connector 90.

Each of car unit bodies 82 and 83 has a through center sill 110 that extends between the first and second ends 104, 106 (105, 107). A set of cross-bearers 112, 114 extend to either side of center sill 110, terminating at side sills 116, 118. Main deck 102 (or 103) is supported above cross-bearers 112, 114 and between side sills 116, 118. Sidewall structures 94, 96 and 95, 97 each include an array of vertical support members, in the nature of posts 120, that extend between side sills 116, 118, and top chords 126, 128. A corrugated sheet roof 130 extends between top chords 126 and 128 above deck 102 and such other decks as may be employed.

Radial arm doors 132, 134 enclose the coupler end openings of car bodies 82 and 83 of rail road car 80, and are movable to respective closed positions to inhibit access to the interior of rail road car 80, and to respective open positions to give access to the interior thereof. Each of the decks has bridge plate fittings (upper deck fittings not shown) to permit bridge plates to be positioned between car 80 and an adjacent auto rack rail road car when doors 132 or 134 are opened to permit circus loading of the decks.

Figures 2C, 2D:
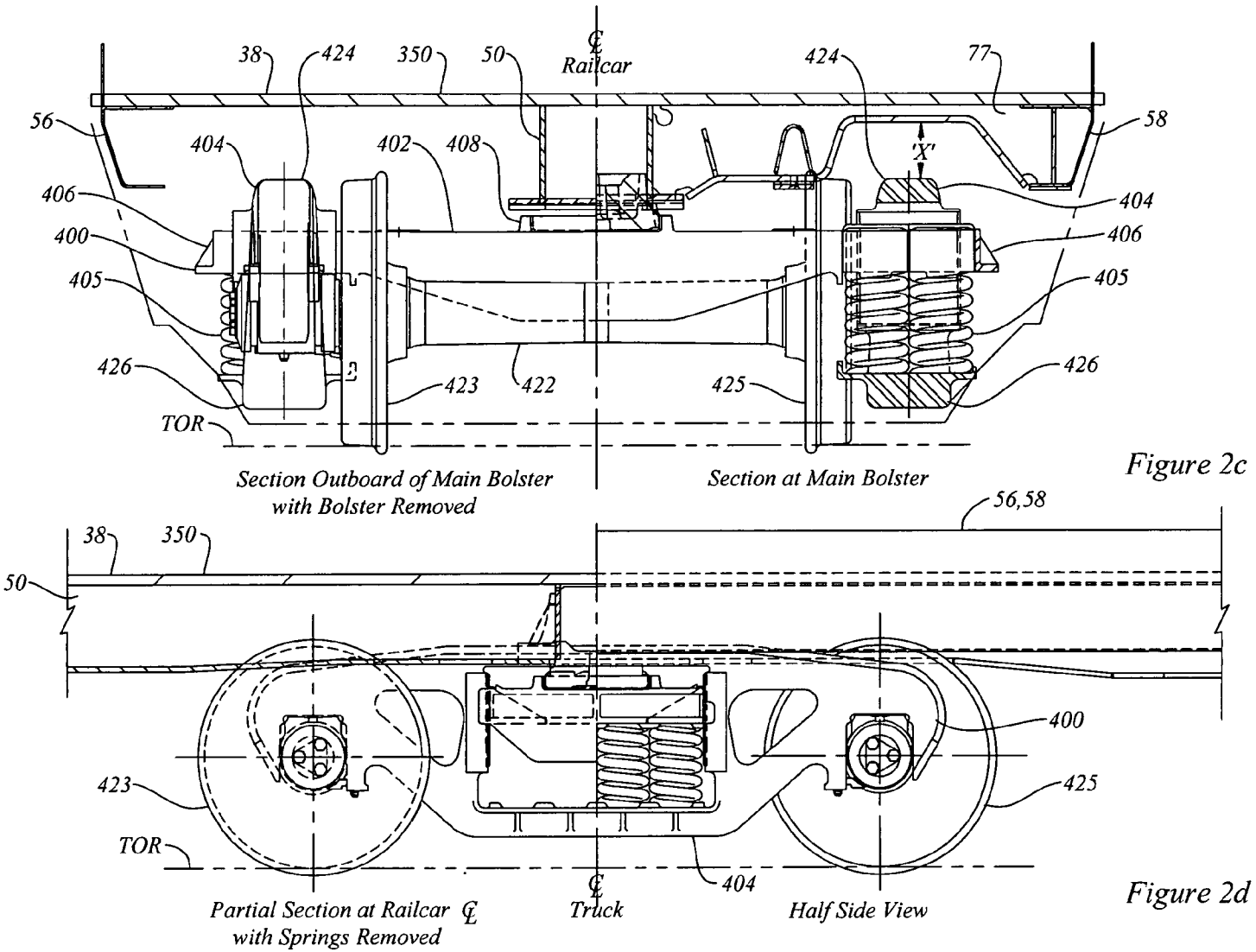
FIG. 2*c* shows a half sectioned partial end view of the rail road car of FIG. 2*a* illustrating the wheel clearance below the main deck, half of the section being taken through the main bolster, the other half section being taken outboard of the truck with the main bolster removed for clarity.
FIG. 2*d* shows a partially sectioned side view of the rail road car of FIG. 2*c* illustrating the relationship of the truck, the bolster and the wheel clearance, below the main deck.

For the purposes of this description, the cross-section of FIG. 2*b* can be considered typical also of the general structure of the other railcar unit bodies described below, whether 82, 85, 202, 204, 142, 144, 146, 222, 224 or 226. It should be noted that FIG. 2*b* shows a stepped section in which the right hand portion shows the main bolster 75 and the left hand section shows a section looking at the cross-tie 77 outboard of the main bolster. The sections of FIGS. 2*b* and 2*c* are typical of the sections of the end units described herein at their coupler end trucks, such as trucks 232, 148, 84, 88, 210, 206. The upward recess in the main bolster 75 provides vertical clearance for the side frames (typically 7" or more). That is, the clearance 'X' in FIG. 2*c* is about 7 inches in one embodiment between the side frames and the bolster for an unladen car at rest.

As may be noted, the web of main bolster 75 has a web rebate 79 and a bottom flange that has an inner horizontal portion 69, an upwardly stepped horizontal portion 71 and an outboard portion 73 that deepens to a depth corresponding to the depth of the bottom flange of side sill 58. Horizontal portion 69 is carried at a height corresponding generally to the height of the bottom flange of side sill 58, and portion 71 is stepped upwardly relative to the height of the bottom flange of side sill 58 to provide greater vertical clearance for the side frame of truck 23 or 24 as the case may be.

Three or More Unit Articulated Auto Rack Car

Figure 4B:
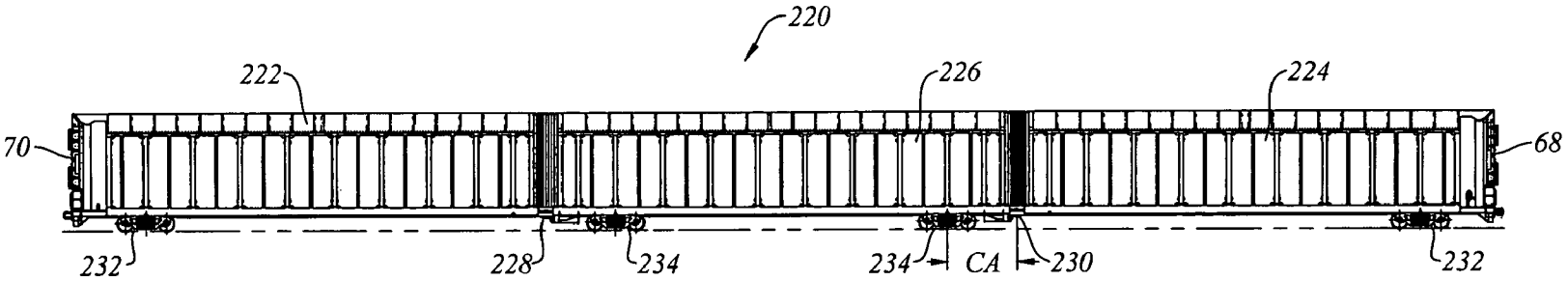
FIG. 4*b* shows a side view of an alternate three unit auto rack rail road car to the articulated rail road unit car of FIG. 4*a*, having cantilevered articulations.
Figure 4A:
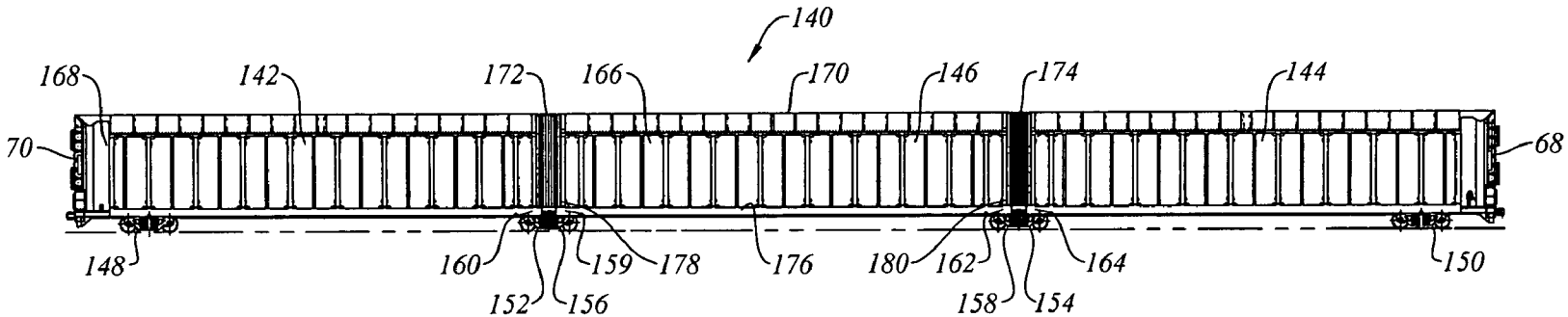
FIG. 4*a* shows a side view of a three unit auto rack rail road car.

FIG. 4*a* shows a three unit articulated autorack rail road car, generally as 140. It has a first end rail car unit body 142, a second end rail car unit body 144, and an intermediate rail car unit body 146 between rail car unit bodies 142 and 144. Rail car unit bodies 142, 144 and 146 are supported for rolling motion in the longitudinal direction (i.e., along the rails) upon rail car trucks 148, 150, 152, and 154. Rail car trucks 148 and 150 are "coupler end" trucks mounted at main bolsters at respective coupler ends of the first and second rail car bodies 142 and 144. Trucks 152 and 154 are "interior" or "intermediate" trucks mounted beneath respective articulated connectors 156 and 158 by which bodies 142 and 144 are joined to body 146. For the purposes of this description, body 142 is the same as body 82, and body 144 is the same as body 83. Rail car body 146 has a male end 159 for mating with the female end 160 of body 142, and a female end 162 for mating with the male end 164 of rail car body 144.

Body 146 has a housing structure 166 like that of FIG. 2*b*, that includes a pair of left and right hand sidewall structures 168 and a canopy, or roof 170 that co-operate to define an enclosed lading space. Bellows structures 172 and 174 link bodies 142, 146 and 144, 146 respectively to discourage entry by vandals or thieves.

Body 146 has staging in the nature of a main deck 176, similar to deck 38, running the length of the car unit between first and second ends 178, 180 defining a roadway upon which wheeled vehicles, such as automobiles can be conducted. Body 146 can have staging in either a bi-level configuration or a tri-level configuration, to co-operate with the staging of bodies 142 and 144.

Other than brake fittings, and other ancillary features, car bodies 142 and 144 are substantially the same, differing to the extent that car body 142 has a pair of female side-bearing arms adjacent to articulated connector 156, and car body 144 has a co-operating pair of male side bearing arms adjacent to articulated connector 158.

Other articulated auto-rack cars of greater length can be assembled by using a pair of end units, such as male and female end units 82 and 83, and any number of intermediate units, such as intermediate unit 146, as may be suitable. In that sense, rail road car 140 is representative of multi-unit articulated rail road cars generally.

Alternate Configurations

Alternate configurations of multi-unit rail road cars are shown in FIGS. 3*b* and 4*b*. In FIG. 3*b*, a two unit articulated auto-rack rail road car is indicated generally as 200. It has first and second rail car unit bodies 202, 204 supported for rolling motion in the longitudinal direction by three rail road car trucks, 206, 208 and 210 respectively. Rail car unit bodies 202 and 204 are joined together at an articulated connector 212. In this instance, while rail car bodies 202 and 204 share the same basic structural features of rail car body 22, in terms of a through center sill, cross-bearers, side sills, walls and canopy, and vehicles decks, rail car body 202 is a "two-truck" body, and rail car body 204 is a single truck body. That is, rail car body 202 has main bolsters at both its first, coupler end, and at its second, articulated connector end, the main bolsters being mounted over trucks 206 and 208 respectively. By contrast, rail car body 204 has only a single main bolster, at its coupler end, mounted over truck 210. Articulated connector 212 is mounted to the end of the respective center sills of rail car bodies 202 and 204, longitudinally outboard of rail car truck 208. The use of a cantilevered articulation in this manner, in which the pivot center of the articulated connector is offset from the nearest truck center, is described more fully in my co-pending U.S. patent application Ser. No. 09/614,815 for a Rail Road Car with Cantilevered Articulation filed Jul. 12, 2000, incorporated herein by reference, and may tend to permit a longer car body for a given articulated rail road car truck center distance as therein described.

Figure 4C:
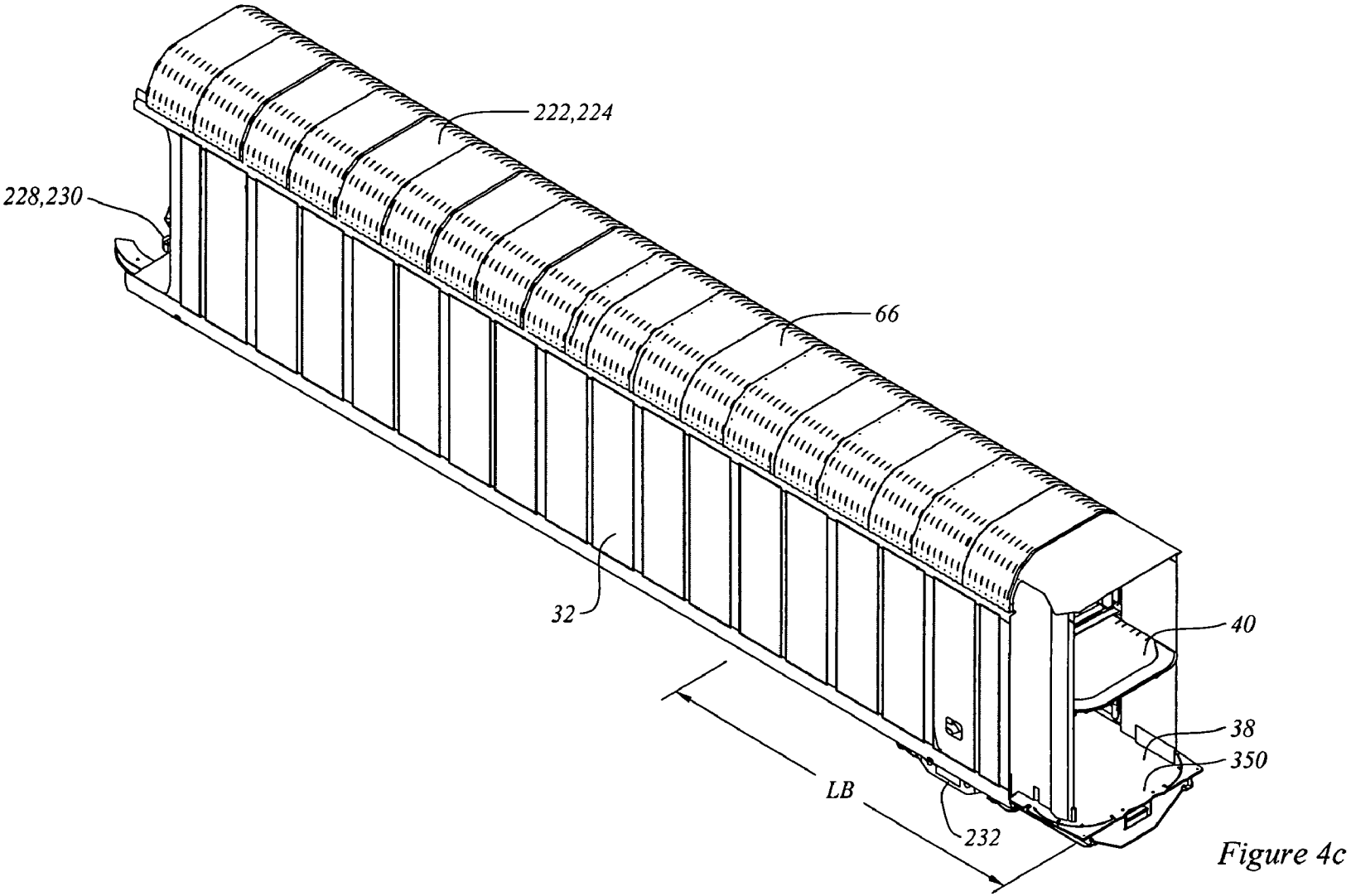
FIG. 4*c* shows an isometric view of an end unit of the three unit auto rack rail road car of FIG. 4*b;*

FIG. 4*b* shows a three-unit articulated rail road car 220 having first end unit 222, second end unit 224, and intermediate unit 226, with cantilevered articulated connectors 228 and 230. End units 222 and 224 are single truck units of the same construction as car body 204. Intermediate unit 226 is a two truck unit having similar construction to car body 202, but having articulated connectors at both ends, rather than having a coupler end. FIG. 4*c* shows an isometric view of end unit 224 (or 222). Analogous five pack articulated rail road cars having cantilevered articulations can also be produced. Many alternate configurations of multi-unit articulated rail road cars employing cantilevered articulations can be assembled by re-arranging, or adding to, the units illustrated.

In each of the foregoing descriptions, each of rail road cars 20, 80, 140, 200 and 220 has a pair of first and second coupler ends by which the rail road car can be releasably coupled to other rail road cars, whether those coupler ends are part of the same rail car body, or parts of different rail car bodies of a multi-unit rail road car joined by articulated connections, draw-bars, or a combination of articulated connections and draw-bars.

Figure 5A:
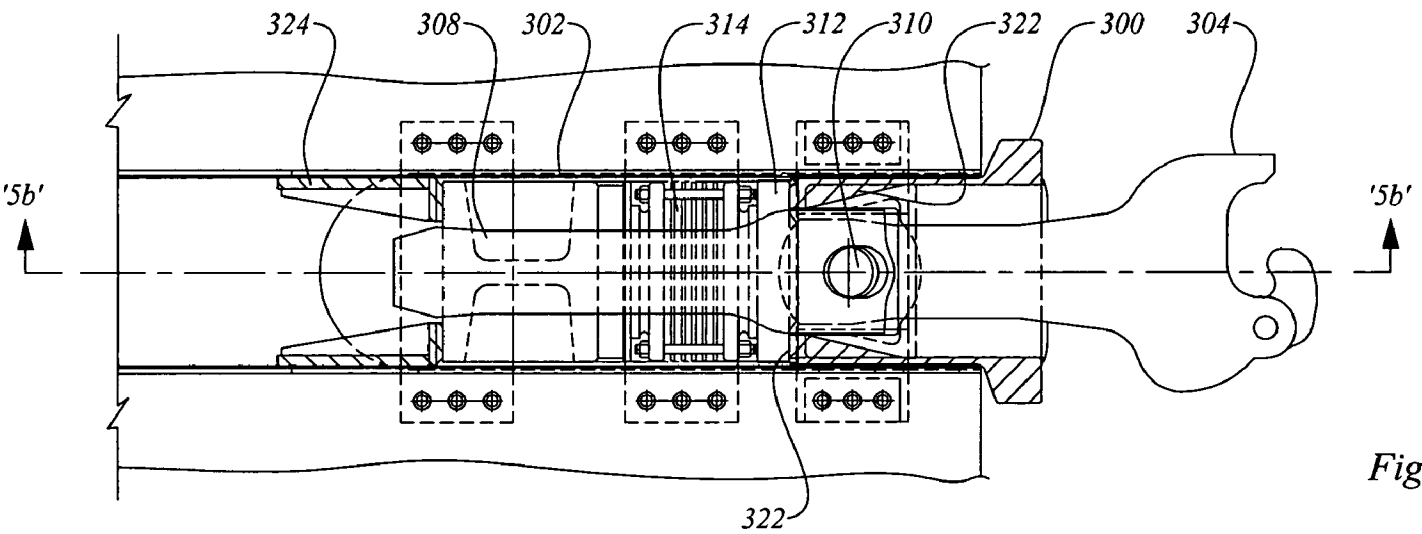
FIG. 5*a* is a partial side sectional view of the draft pocket of the coupler end of any of the rail road cars of FIGS. 2*a*, 3*a*, 3*b*, 4*a*, or 4*b* taken on '5*a*—5*a*' as indicated in FIG. 2*a*.
Figure 5B:
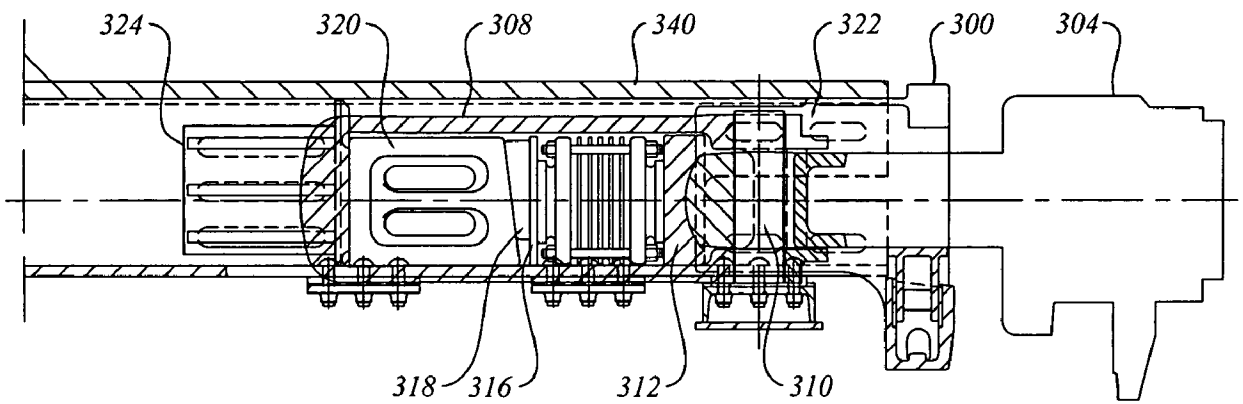
FIG. 5*b* shows a top view of the draft gear at the coupler end of FIG. 5*a* taken on '5*b*—5*b*' of FIG. 5*a;*

FIGS. 5*a* and 5*b* show an example of a draft gear arrangement that may be used at a first coupler end 300 of rail road car 20, coupler end 300 being representative of either of the coupler ends and draft gear arrangement of rail road car 20, and of rail road cars 80, 140, 200 and 220 more generally. Coupler pocket 302 houses a coupler indicated as 304. It is mounted to a coupler yoke 308, joined together by a pin 310. Yoke 308 houses a coupler follower 312, a draft gear 314 held in place by a shim (or shims, as required) 316, a wedge 318 and a filler block 320. Fore and aft draft gear stops 322, 324 are welded inside coupler pocket 302 to retain draft gear 314, and to transfer the longitudinal buff and draft loads through draft gear 314 and on to coupler 304. In the preferred embodiment, coupler 304 is an AAR Type F70DE coupler, used in conjunction with an AAR Y45AE coupler yoke and an AAR Y47 pin. In the preferred embodiment, draft gear 314 is a Mini-BuffGear such as manufactured Miner Enterprises Inc., or by the Keystone Railway Equipment Company, of 3420 Simpson Ferry Road, Camp Hill, Pa. As taken together, this draft gear and coupler assembly yields a reduced slack, or low slack, short travel, coupling as compared to an AAR Type E coupler with standard draft gear or hydraulic EOCC device. As such it may tend to reduce overall train slack. In addition to mounting the Mini-BuffGear directly to the draft pocket, that is, coupler pocket 302, and hence to the structure of the rail car body of rail road car 20, (or of the other rail road cars noted above) the construction described and illustrated is free of other long travel draft gear, sliding sills and EOCC devices, and the fittings associated with them. The draft pocket arrangement may include a flared bell-mouth and other features differing from the illustrated example.

Mini-BuffGear has between ⅝ and ¾ of an inch displacement travel in buff at a compressive force greater than 700,000 Lbs. Other types of draft gear can be used to give an official rating travel of less than 2½ inches under M-901-G, or if not rated, then a travel of less than 2.5 inches under 500,000 Lbs. buff load. For example, while Mini-BuffGear is preferred, other draft gear is available having a travel of less than 1¾ inches at 400,000 Lbs., one known type has about 1.6 inches of travel at 400,000 Lbs., buff load. It is even more advantageous for the travel to be less than 1.5 inches at 700,000 Lbs. buff load and, as in the embodiment of FIGS. 5*a* and 5*b*, preferred that the travel be at least as small as 1" inches or less at 700,000 Lbs. buff load.

Similarly, while the AAR Type F70DE coupler is preferred, other types of coupler having less than the 25/32" (that is, less than about ¾") nominal slack of an AAR Type E coupler generally or the 20/32" slack of an AAR E50ARE coupler can be used. In particular, in alternative embodiments with appropriate housing changes where required, AAR Type F79DE and Type F73BE (members of the Type F Family), with or without top or bottom shelves; AAR Type CS; or AAR Type H couplers can be used to obtain reduced slack relative to AAR Type E couplers.

In each of the examples herein, all of the trucks may have wheels that are greater than 33 inches in diameter. The wheels can advantageously be 36 inches or 38 inches in diameter, or possibly larger depending on deck height geometry, and are preferred to be 36 inch wheels. Although it is advantageous for the wheels of all of the trucks to be of the same diameter, it is not necessary. That is, one or more trucks, such as the intermediate truck or trucks in an articulated autorack rail road car embodiment can have wheels of a larger diameter than 33 inches such as 36 or 38 inches, for example, whereas the other trucks, namely the end trucks can have 33 inch or other wheels.

Weight Distribution

In each of the autorack rail car embodiments described above, each of the car units has a weight, that weight being carried by the rail car trucks with which the car is equipped. In each of the embodiments of articulated rail cars described above there is a number of rail car units joined at a number of articulated connectors, and carried for rolling motion along railcar tracks by a number of railcar trucks. In each case the number of articulated car units is one more than the number of articulations, and one less than the number of trucks. In the event that some of the cars units are joined by draw bars the number of articulated connections will be reduced by one for each draw bar added, and the number of trucks will increase by one for each draw bar added. Typically articulated rail road cars have only articulated connections between the car units. All cars described have releasable couplers mounted at their opposite ends.

In each case described above, where at least two car units are joined by an articulated connector, there are end trucks (e.g. 150, 232) inset from the coupler ends of the end car units, and intermediate trucks (e.g. 154, 234) that are mounted closer to, or directly under, one or other of the articulated connectors (e.g. 156, 230). In a car having cantilevered articulations, such as shown in FIG. 36, the articulated connector is mounted at a longitudinal offset distance (the cantilever arm CA) from the truck center. In each case, each of the car units has an empty weight, and also a full weight. The full weight is usually limited by the truck capacity, whether 70 ton (33 inch diameter wheels), 100 ton (36 inch diameter wheels), 110 ton (36 inch diameter wheels, 286,000 Lbs.) or 125 ton (38 inch diameter wheels). In some instances, with low density lading, the volume of the lading is such that the truck loading capacity cannot be reached without exceeding the volumetric capacity of the car body.

The dead sprung weight of a rail car unit is generally taken as the body weight of the car, including any ballast, as described below, plus that portion of the weight of the truck bearing on the springs, that portion most typically being the weight of the truck bolsters. The unsprung weight of the trucks is, primarily, the weight of the side frames, the axles and the wheels, plus ancillary items such as the brakes, springs, and axle bearings. The unsprung weight of a three piece truck may generally be about 8800 lbs. The live load is the weight of the lading. The sum of (a) the live load; (b) the dead sprung load; and (c) the unsprung weight of the trucks is the gross railcar weight on rail, and is not to exceed the rated value for the truck.

In each of the embodiments described above, each of the rail car units has a weight and a weight distribution of the dead sprung weight of the carbody which determines the dead sprung load carried by each truck. In each of the embodiments described above, the sum of the sprung weights of all of the car bodies of an articulated car is designated as $W_O$. (The sprung mass, $M_O$, is the sprung weight $W_O$ divided by the gravitational constant, g. In each case where a weight is given herein, it is understood that conversion to mass can be readily made in this way, particularly as when calculating natural frequencies). For a single unit, symmetrical rail road car, such as car 20, the weight on both trucks is equal. In all of the articulated auto rack rail road car embodiments described above, the distributed sprung weight on any end truck, is at least ⅔, and no more than 4/3 of the nearest adjacent interior truck, such as an interior truck next closest to the nearest articulated connector. It is advantageous that the dead sprung weight be in the range of 4/5 to 6/5 of the dead sprung weight carried by the interior truck, and it is preferred that the dead sprung weight be in the range of 90% to 110% of the interior truck. It is also desirable that the dead sprung weight on any truck, $W_{DS}$, fall in the range of 90% to 110% of the value obtained by dividing $W_O$ by the total number of trucks of the rail road car. Similarly, it is desirable that the dead sprung weight plus the live load carried by each of the trucks be roughly similar such that the overall truck loading is about the same. In any case, for the embodiments described above, the design live load for one truck, such as an end truck, can be taken as being at least 60% of the design live load of the next adjacent truck, such as an internal truck. In terms of overall dead and live loads, in each of the embodiments described the overall sprung load of the end truck is at least 70% of the nearest adjacent internal truck, advantageously 80% or more, and preferably 90% of the nearest adjacent internal truck.

Inasmuch as the car weight would generally be more or less evenly distributed on a lineal foot basis, and as such the interior trucks would otherwise reach their load capacities before the coupler end trucks, weight equalisation may be achieved in the embodiments described above by adding ballast to the end car units. That is, the dead sprung weight distribution of the end car units is biased toward the coupler end, and hence toward the coupler end truck (e.g. 84, 88, 206, 210, 150, 232). For example, in the embodiments described above, a first ballast member is provided in the nature of a main deck plate 350 of unusual thickness T that forms part of main deck 38 of the rail car unit. Plate 350 extends across the width of the end car unit, and from the longitudinally outboard end of the deck a distance LB. In the embodiment of FIGS. 4*b* and 4*c* for example, the intermediate or interior truck 234 may be a 70 ton truck near its sprung load limit of about 101,200 lbs., on the basis of its share of loads from rail car units 222 and 226 (or, symmetrically 224 and 226 as the case may be), while, without ballast, end trucks 232 would be at a significantly smaller sprung load, even when rail car 220 is fully loaded. In this case, thickness T can be 1½ inches, the width can be 112 inches, and the length LB can be 312 inches, giving a weight of roughly 15,220 lbs., centered on the truck center of end truck 232. This gives a dead load of end car unit 222 of roughly 77,000 lbs., a dead sprung load on end truck 232 of about 54,000 lbs., and a total sprung load on truck 232 can be about 84,000 lbs. By comparison, center car unit 226 has a dead sprung load of about 60,000 lbs., with a dead sprung load on interior truck 234 of about 55,000 lbs., and yielding a total sprung load on interior truck 234 of 101,000 lbs when car 220 is fully loaded. In this instance as much as a further 17,000 lbs. (+/−) of additional ballast can be added before exceeding the "70 Ton" gross weight on rail limit for the coupler end truck, 232. Ballast can also be added by increasing the weight of the lower flange or webs of the center sill, also advantageously reducing the center of gravity of the car. In alternate embodiments plate thickness T can be a thickness greater than ½ inches, whether ¾ inches, 1 inch, or 1¼ inches, or some other thickness. Further, the ballast plate need not be a monolithic cut sheet, but can be made up of a plurality of plates mounted at appropriate locations to yield a mass (or weight) of ballast of suitable distribution.

Similar weight distributions can be made for other capacities of truck whether 100 Ton, 110 Ton or 125 Ton. With an increase in truck capacity beyond "70 Ton", there is correspondingly an opportunity to add more ballast up to the truck capacity limit. As noted above, although any of these sizes of trucks can be used, it is preferable to use a truck with a larger wheel diameter. That is, while 33 inch wheels (or even 28" wheels in a "70 Ton Special") can be used, wheels larger than 33 inches in diameter are preferred such as 36 inch or 38 inch wheels.

Figures 6A, 6B, 6C:
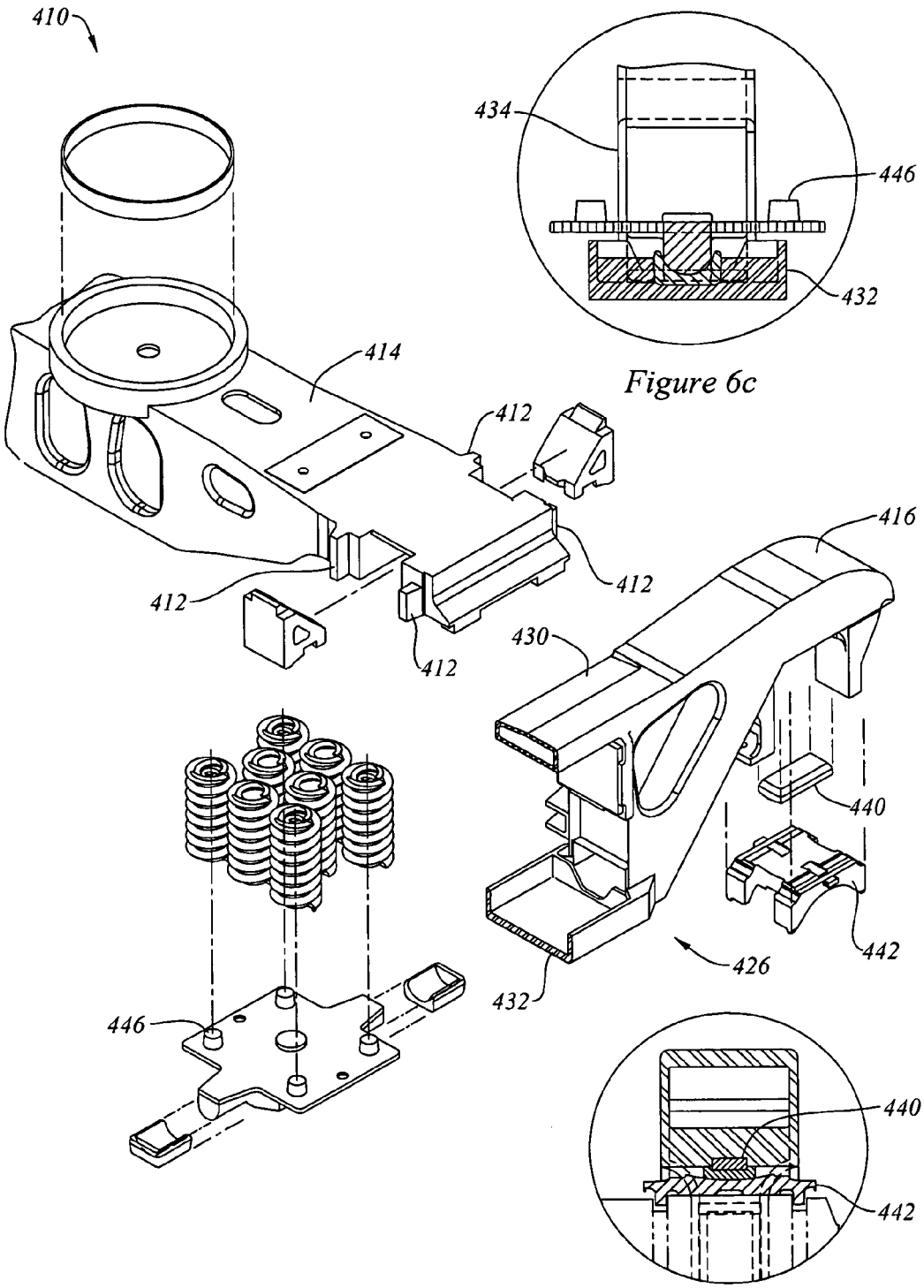
FIG. 6*a* shows a swing motion truck as shown in FIG. 1*a*, but lacking a transom.
FIG. 6*b* shows a cross-sectional detail of a bottom spring seat of the truck of FIG. 6*a;*
FIG. 6*c* shows a cross-sectional detail of a bottom spring seat of the truck of FIG. 6*a;*

In the example of FIG. 6*a* and 6*b*, a truck embodying an aspect of the present invention is indicated as 410. Truck 410 differs from truck A20 of FIG. 1*a* insofar as it is free of a rigid, unsprung lateral connecting member in the nature of unsprung cross-bracing such as a frame brace of crossed-diagonal rods, lateral rods, or a transom (such as transom A60) running between the rocker plates of the bottom spring seats of the opposed sideframes. Further, truck 410 employs gibs 412 to define limits to the lateral range of travel of the truck bolster 414 relative to the sideframe 416. In other respects, including the sideframe geometry and upper and lower rocker assemblies, truck 410 is intended to have generally similar features to truck A20, although it may differ in size, pendulum length, spring stiffness, wheelbase, window width and window height, and damping arrangement. The determination of these values and dimensions may depend on the service conditions under which the truck is to operate.

As with other trucks described herein, it will be understood that since truck 410 (and trucks 420, 520, and 600, described below) are symmetrical about both their longitudinal and transverse axes, the truck is shown in partial section. In each case, where reference is made to a sideframe, it will be understood that the truck has first and second sideframes, first and second spring groups, and so on.

Figure 7B:
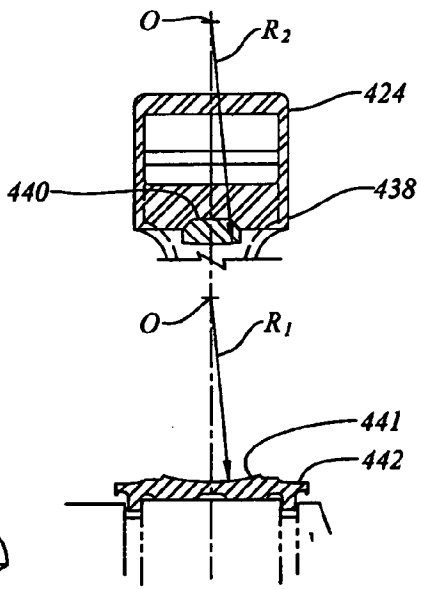
FIG. 7*b* shows a cross-sectional detail of the upper rocker assembly of the truck of FIG. 7*a;*
Figure 7A:
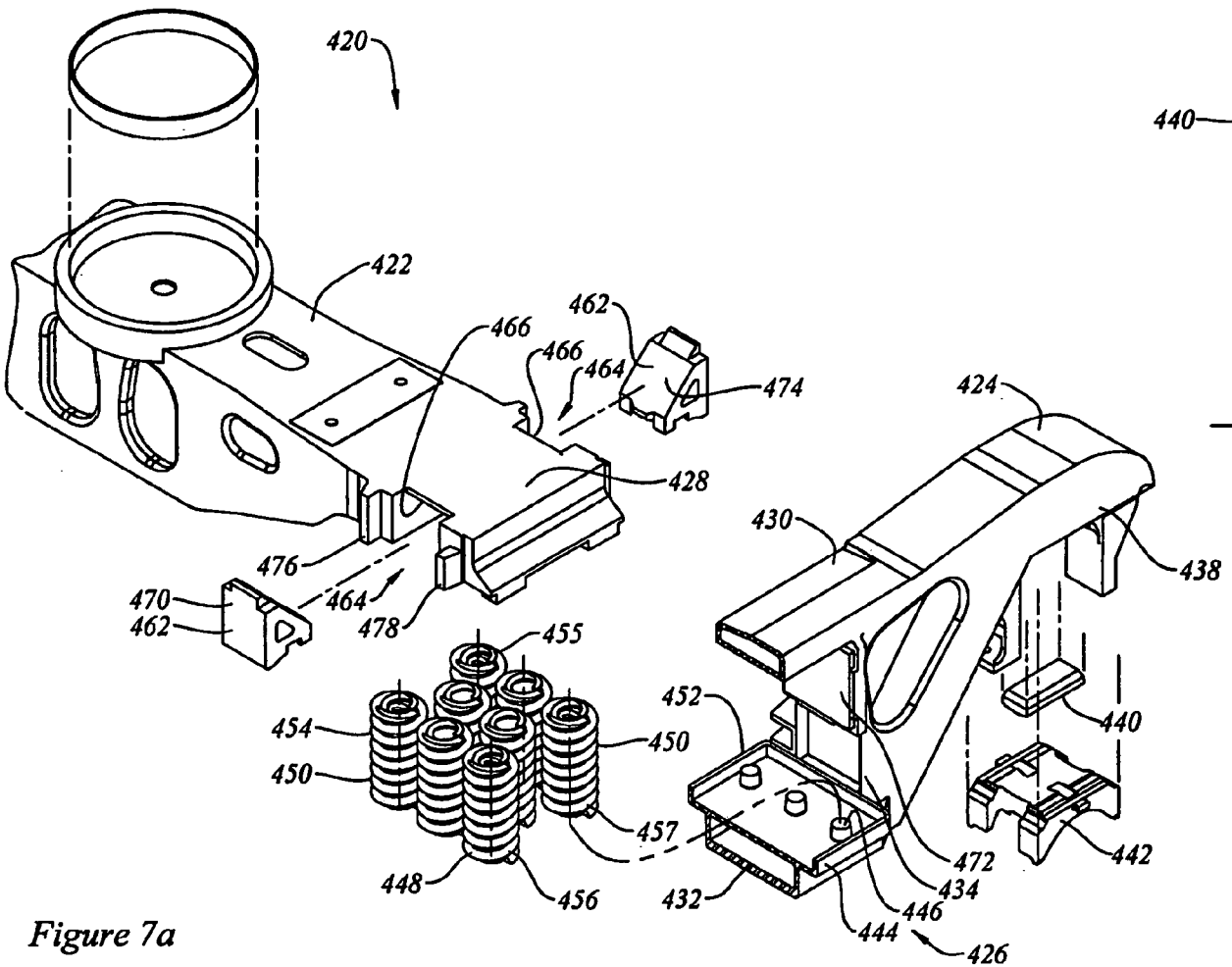
FIG. 7*a* shows a swing motion truck having an upper rocker as in the swing motion truck of FIG. 1*a*, but having a rigid spring seat, and being free of a transom.

In FIGS. 7*a* and 7*b*, for example, a truck is identified generally as 420. Inasmuch as truck 420 is symmetrical about the truck center both from side-to-side and lengthwise, the bolster, identified as 422, and the sideframes, identified as 424 are shown in part. Truck 420 differs from truck A20 of the prior art, described above, in that truck 420 has a rigid bottom spring seat 444 rather than a lower rocker as in truck A20, as described below, and is free of a rigid, unsprung lateral connection member such as an underslung transom A60, a frame brace, or laterally extending rods.

Sideframe 424 has a generally rectangular window 426 that accommodates one of the ends 428 of the bolster 422. The upper boundary of window 426 is defined by the sideframe arch, or compression member identified as top chord member 430, and the bottom of window 426 is defined by a tension member identified as bottom chord 432. The fore and aft vertical sides of window 426 are defined by sideframe columns 434.

The ends of the tension member sweep up to meet the compression member. At each of the swept-up ends of sideframe 424 there are sideframe pedestal fittings 438. Each fitting 438 accommodates an upper rocker identified as a pedestal rocker seat 440. Pedestal rocker seat 440 engages the upper surface of a bearing adapter 442. Bearing adapter 442 engages a bearing mounted on one of the axles of the truck adjacent one of the wheels. A rocker seat 440 is located in each of the fore and aft pedestal fittings 438, the rocker seats 440 being longitudinally aligned such that the sideframe can swing transversely relative to the rolling direction of the truck in a "swing hanger" arrangement.

Bearing adapter 442 has a hollowed out recess 441 in its upper surface that defines a bearing surface for receiving rocker seat 440. Bearing surface 441 is formed on a radius of curvature $R_1$. The radius of curvature $R_1$ is preferably in the range of less than 25 inches, may be in the range of 5" to 15", and is preferably in the range of 8 to 12 inches, and most preferably about 10 inches with the center of curvature lying upwardly of the rocker seat. The lower face of rocker seat 440 is also formed on a circular arc, having a radius of curvature $R_2$ that is less than the radius of curvature $R_1$ of the recess of surface recess 441. $R_2$ is preferably in the range of ¼ to ¾ as large as $R_1$, and is preferably in the range of 3–10 inches, and most preferably 5 inches when $R_1$ is 10 inches, ie., $R_2$ is one half of $R_1$. Given the relatively small angular displacement of the rocking motion of $R_2$ relative to $R_1$ (typically less than +/−10 degrees) the relationship is one of rolling contact, rather than sliding contact.

The bottom chord or tension member of sideframe 424 has a basket plate, or lower spring seat 444 rigidly mounted to bottom chord 432, such that it has a rigid orientation relative to window 426, and to sideframe 424 in general. That is, in contrast to the lower rocker platform of the prior art swing motion truck A20 of FIG. 1*a*, as described above, spring seat 444 is not mounted on a rocker, and does not rock relative to sideframe 424. Although spring seat 444 retains an array of bosses 446 for engaging the corner elements 454, namely springs 454 and 455 (inboard), 456 and 457 (outboard) of a spring set 448, there is no transom mounted between the bottom of the springs and seat 444. Seat 444 has a peripheral lip 452 for discouraging the escape of the bottom ends the of springs.

The spring group, or spring set 448, is captured between the distal end 428 of bolster 422 and spring seat 444, being placed under compression by the weight of the rail car body and lading that bears upon bolster 422 from above.

Friction damping is provided by damping wedges 462 that seat in mating bolster pockets 464 that have inclined damper seats 466. The vertical sliding faces 470 of the friction damper wedges 462 then ride up and down on friction wear plates 472 mounted to the inwardly facing surfaces of sideframe columns 434. Angled faces 474 of wedges 462 ride against the angled face of seat 466. Bolster 422 has inboard and outboard gibbs 476, 478 respectively, that bound the lateral motion of bolster 422 relative to sideframe columns 434. This motion allowance may advantageously be in the range of +/−1⅛ to 1¾ inches, and is most preferably in the range of 1³⁄₁₆ to 1⁹⁄₁₆ inches, and can be set, for example, at 1½ inches or 1¼ inches of lateral travel to either side of a neutral, or centered, position when the sideframe is undeflected.

As in the prior art swing motion truck A20, a spring group of 8 springs in a 3:2:3 arrangement is used. Other configurations of spring groups could be used, such as those described below.

Figure 8:
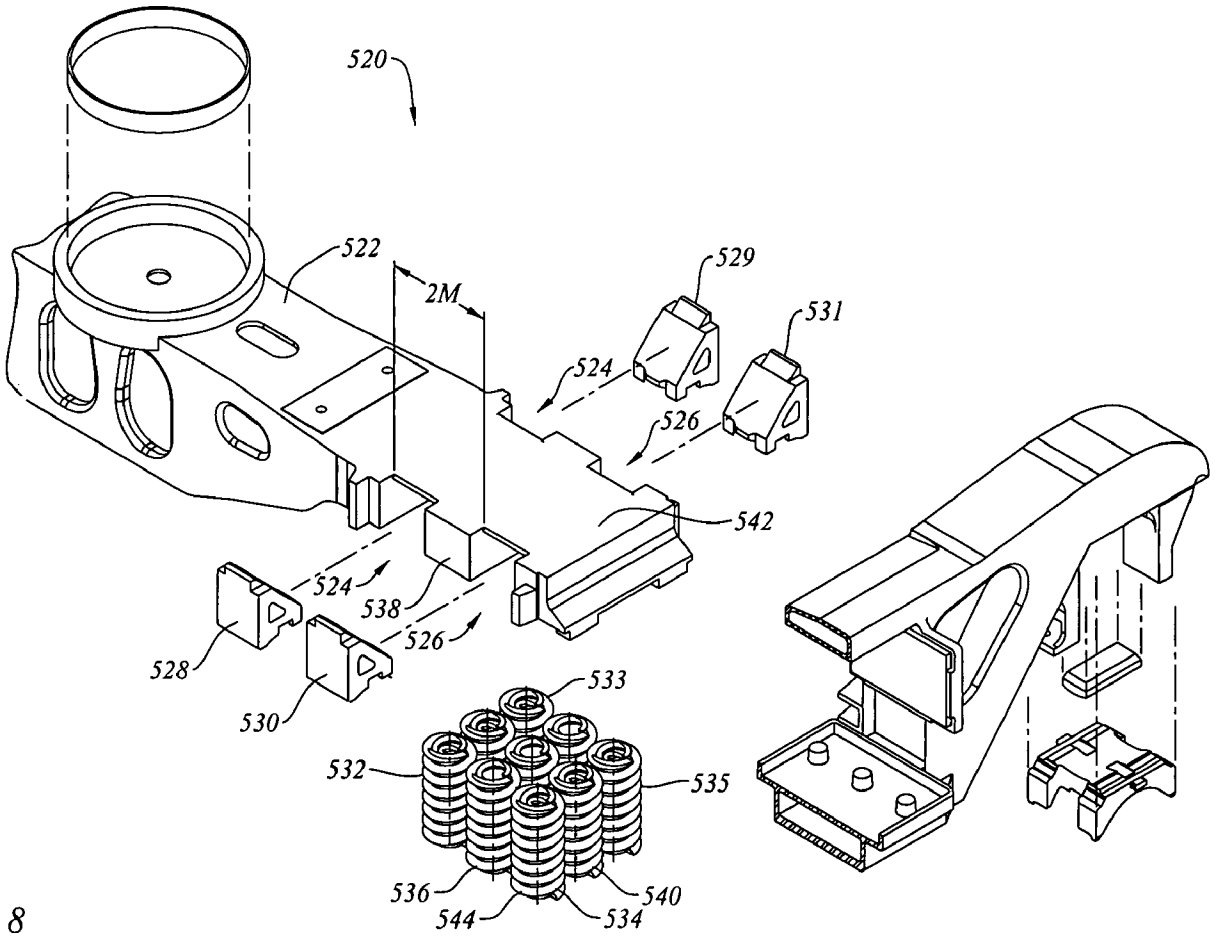
FIG. 8 shows a swing motion truck similar to that of FIG. 7*a*, but having doubled bolster pockets and wedges.

In the embodiment of FIG. 8, a truck 520 is substantially similar to truck 420, but differs insofar as truck 520 has a bolster 522 having double bolster pockets 524, 526 on each face of the bolster at the outboard end. Bolster pockets 524, 526 accommodate a pair of first and second, laterally inboard and laterally outboard friction damper wedges 528, 529 and 530, 531, respectively. Wedges 528, 529 each sit over a first, inboard corner spring 532, 533, and wedges 530, 531 each sit over a second, outboard corner spring 534, 535. In this four comer arrangement, each damper is individually sprung by one or another of the springs in the spring group. The static compression of the springs under the weight of the car body and lading tends to act as a spring loading to bias the damper to act along the slope of the bolster pocket to force the friction surface against the sideframe. As such, the dampers co-operate in acting as biased members working between the bolster and the side frames to resist parallelogram, or lozenging, deformation of the side frame relative to the truck bolster. A middle end spring 536 bears on the underside of a land 538 located intermediate bolster pockets 524 and 526. The top ends of the central row of springs, 540, seat under the main central portion 542 of the end of bolster 522.

Figure 17A:
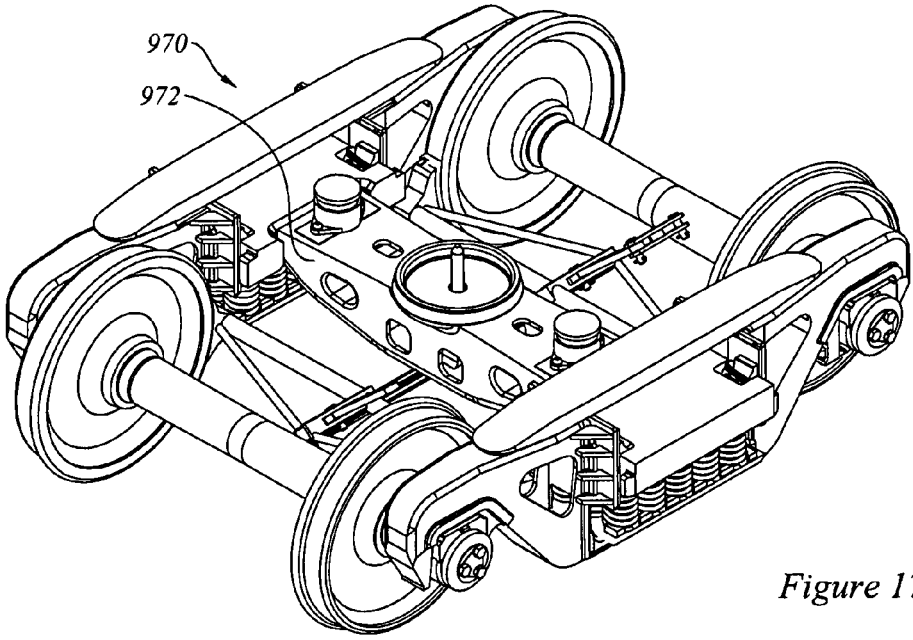
FIG. 17*a* shows an isometric view of an alternate railroad car truck to that of FIG. 9*a;*
Figure 17D:
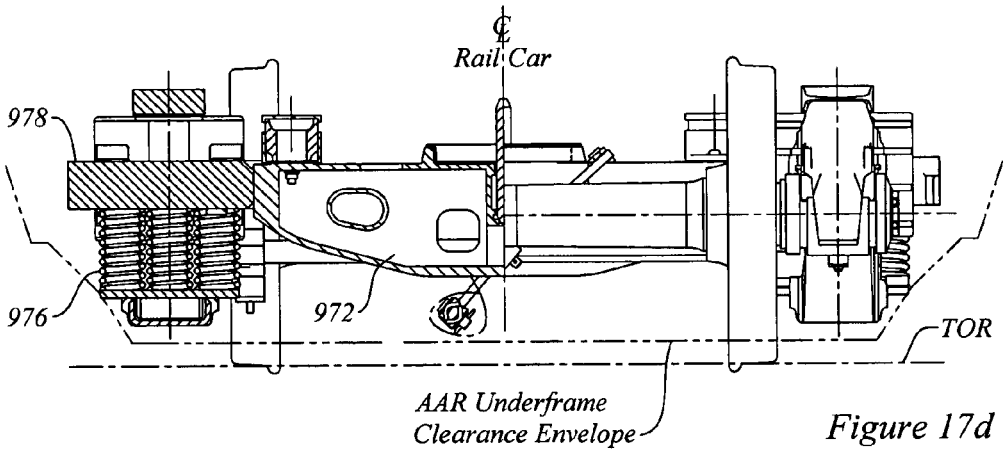
FIG. 17*d* shows an end view of the three piece truck of FIG. 17*a*.
Figure 17E:
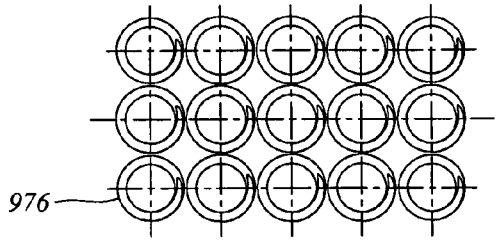
FIG. 17*e* shows a schematic of a spring layout for the truck of FIG. 17*a*.

The lower ends of the springs of the entire spring group, identified generally as 544, seat in the lower spring seat 546. Lower spring seat 546 has the layout of a tray with an upturned rectangular peripheral lip. Lower spring seat 546 is rigidly mounted to the lower chord 548 of sideframe 549. In this case, spring group 544 has a 3 rows×3 columns layout, rather than the 3:2:3 arrangement of truck 420. A 3×5 layout as shown in FIG. 17*e* (described below) could be used, as could other alternate spring group layouts. Truck 520 is free of any rigid, unsprung lateral sideframe connection members such as transom A60.

It will be noted that bearing plate 550 mounted to vertical sideframe columns 552 is significantly wider than the corresponding bearing plate 472 of truck 420 of FIG. 6*a*. This additional width corresponds to the additional overall damper span width measured fully across the damper pairs, plus lateral travel as noted above, typically allowing roughly 1½ (+/−) inches of lateral travel (i.e. for an overall total of roughly 3" travel) of the bolster relative to the sideframe to either side of the undeflected central position. That is, rather than having the width of one coil, plus allowance for travel, plate 550 has the width of three coils, plus allowance to accommodate 1½ (+/−) inches of travel to either side. Plate 550 is significantly wider than the through thickness of the sideframes more generally, as measured, for example, at the pedestals.

Damper wedges 528 and 530 sit over 44% (+/−) of the spring group i.e., ⅘ of a 3 rows×3 columns group as shown in FIG. 8, whereas wedges 470 only sat over ⅔ of the 3:2:3 group in FIG. 7*a*. For the same proportion of vertical damping, wedges 528 and 530 may tend to have a larger included angle (i.e., between the wedge hypotenuse and the vertical face for engaging the friction wear plates on the sideframe columns 434. For example, if the included angle of friction wedges 472 is about 35 degrees, then, assuming a similar overall spring group stiffness, and single coils, the corresponding angle of wedges 528 and 530 could advantageously be in the range of 50–65 degrees, or more preferably about 55 degrees. In a 3×5 group such as group 976 of truck 970 of FIG. 17*e*, for coils of equal stiffness, the wedge angle may tend to be in the 35 to 40 degree range. The specific angle will be a function of the specific spring stiffnesses and spring combinations actually employed.

The use of spaced apart pairs of dampers 528, 530 may tend to give a larger moment arm, as indicated by dimension "2M", for resisting parallelogram deformation of truck 520 more generally as compared to trucks 420 or A20. Parallelogram deformation may tend to occur, for example, during the "truck hunting" phenomenon that has a tendency to occur in higher speed operation.

Placement of doubled dampers in this way may tend to yield a greater restorative "squaring" force to return the truck to a square orientation than for a single damper alone, as in truck 420. That is, in parallelogram deformation, or lozenging, the differential compression of one diagonal pair of springs (e.g., inboard spring 532 and outboard spring 535 may be more pronouncedly compressed) relative to the other diagonal pair of springs (e.g., inboard spring 533 and outboard spring 534 may be less pronouncedly compressed than springs 532 and 535) tends to yield a restorative moment couple acting on the sideframe wear plates. This moment couple tends to rotate the sideframe in a direction to square the truck, (that is, in a position in which the bolster is perpendicular, or "square", to the sideframes) and thus may tend to discourage the lozenging or parallelogramming, noted by Weber.

Figure 9A:
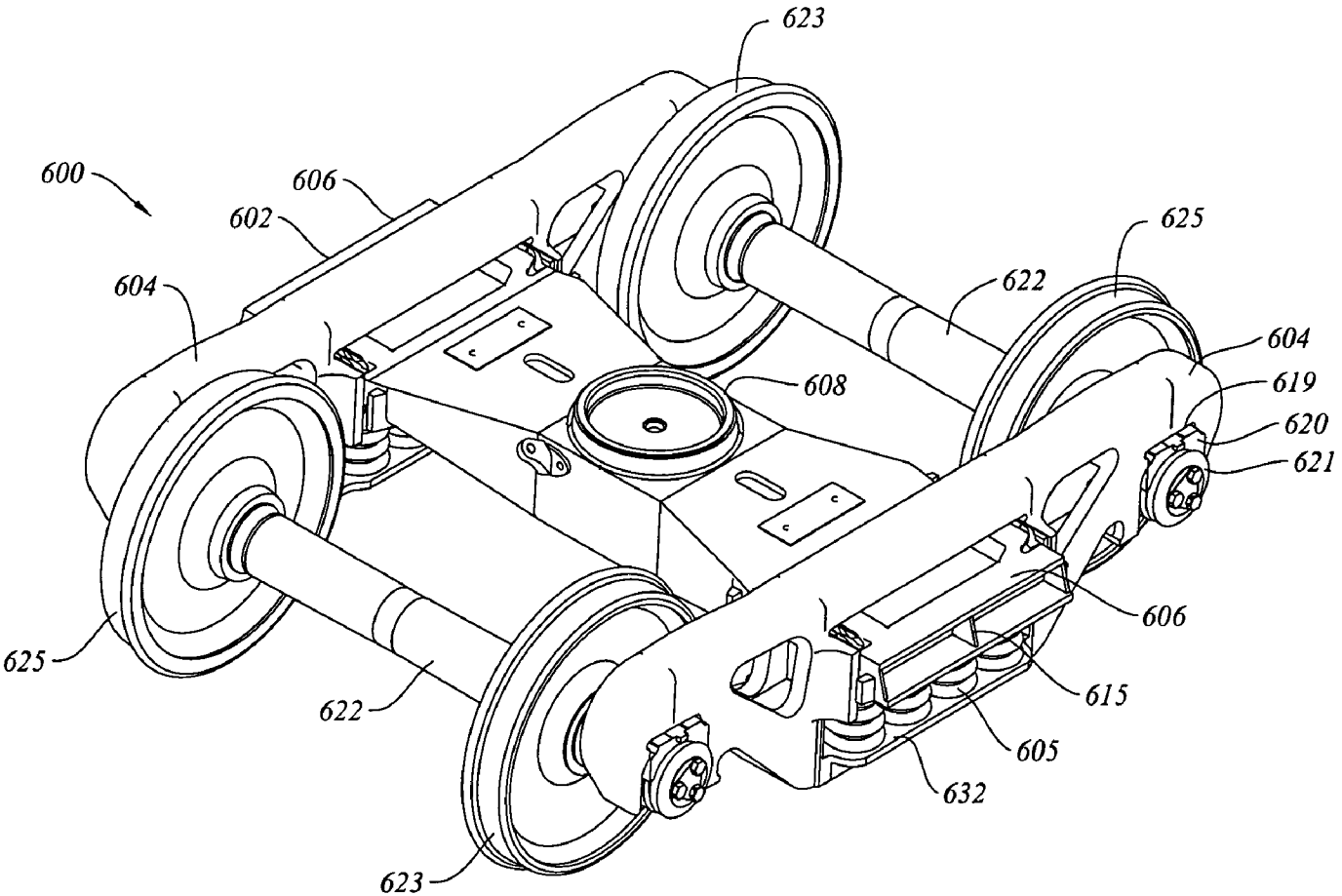
FIG. 9*a* shows an isometric view of a three piece truck for the auto rack rail road cars of FIGS. 2*a*, 3*a*, 3*b*, 4*a* or 4*b;*
Figure 9B:
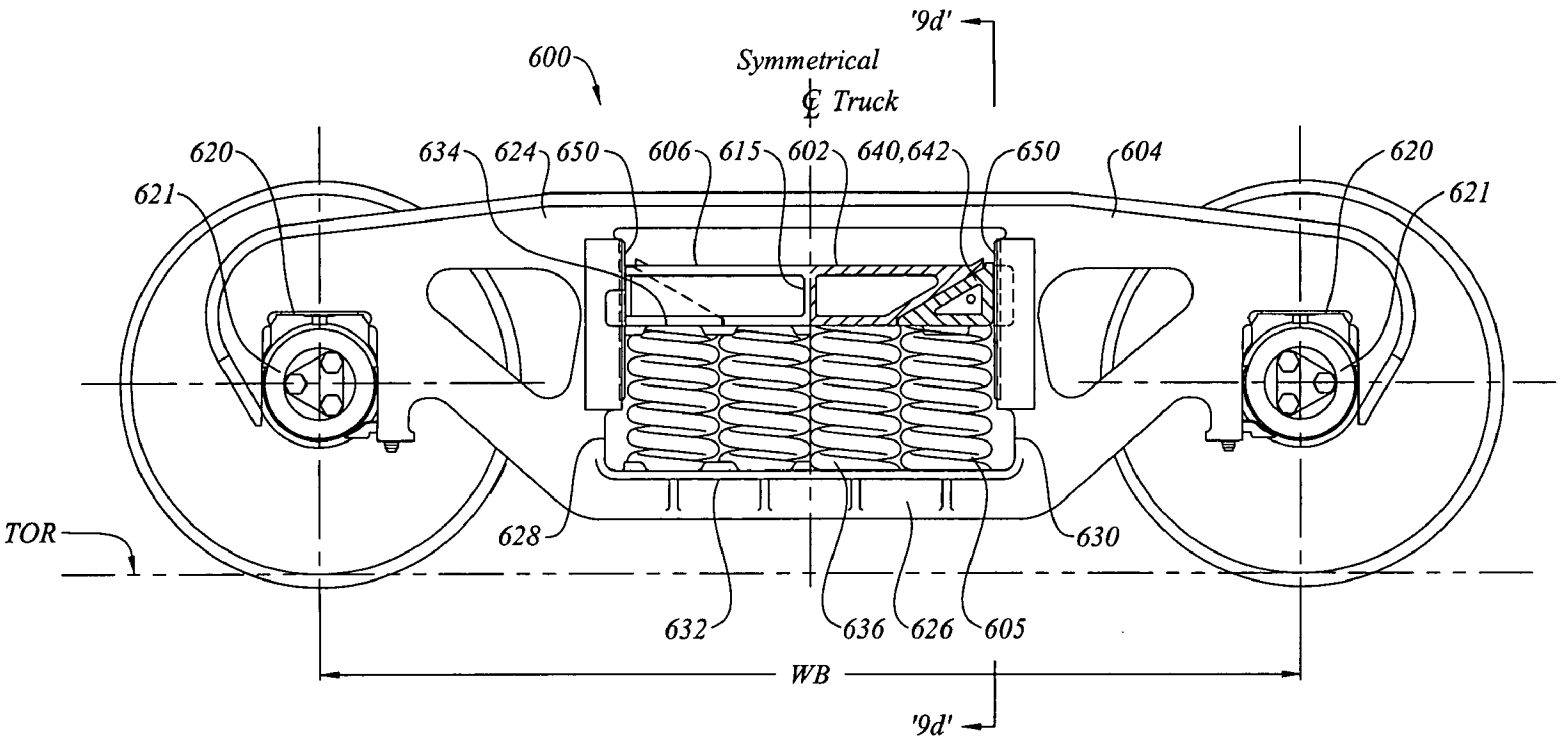
FIG. 9*b* shows a side view of the three piece truck of FIG. 9*a;*
Figure 9C:
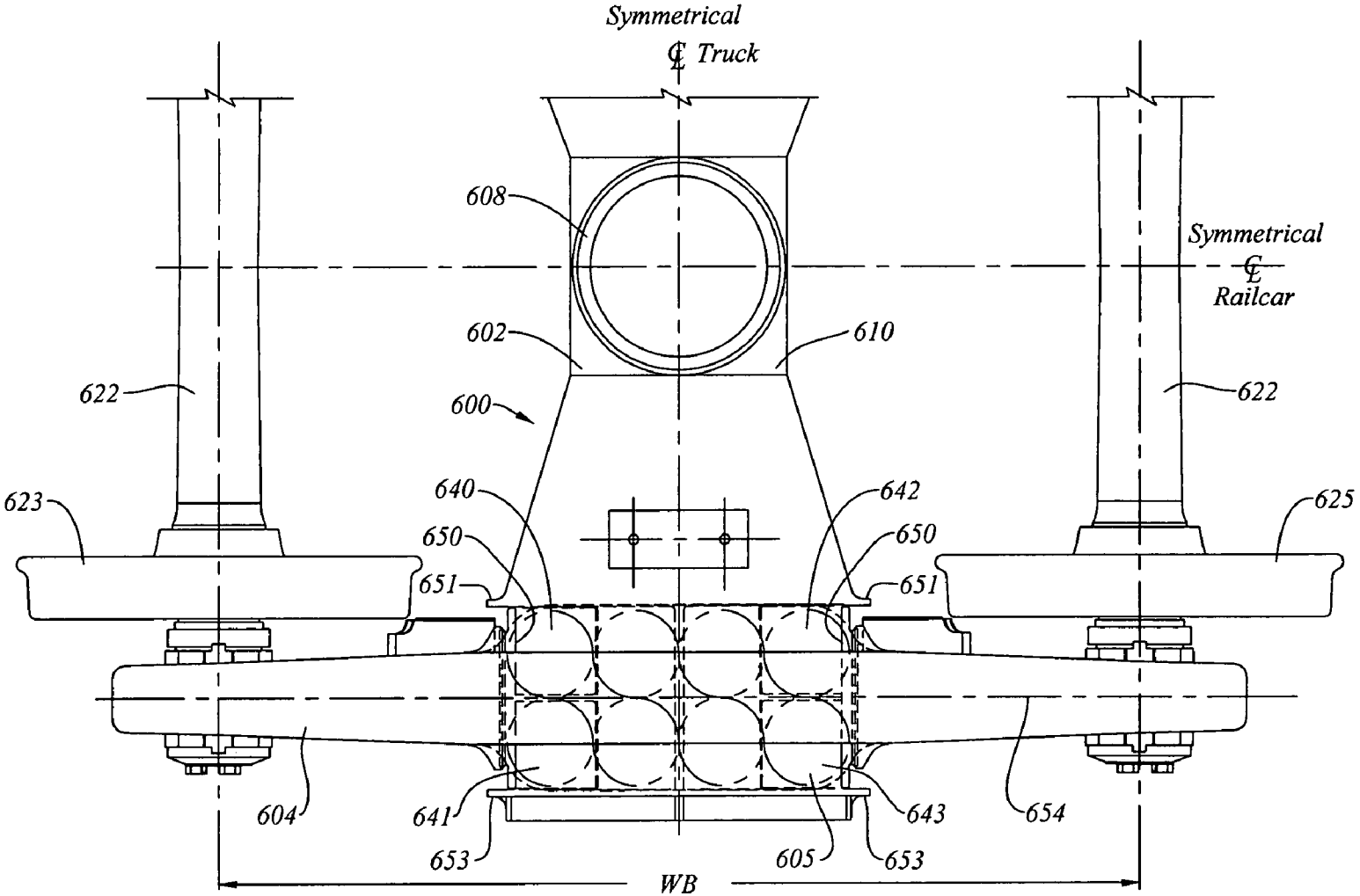
FIG. 9*c* shows a top view of half of the three piece truck of FIG. 9*b;*
Figure 9D:
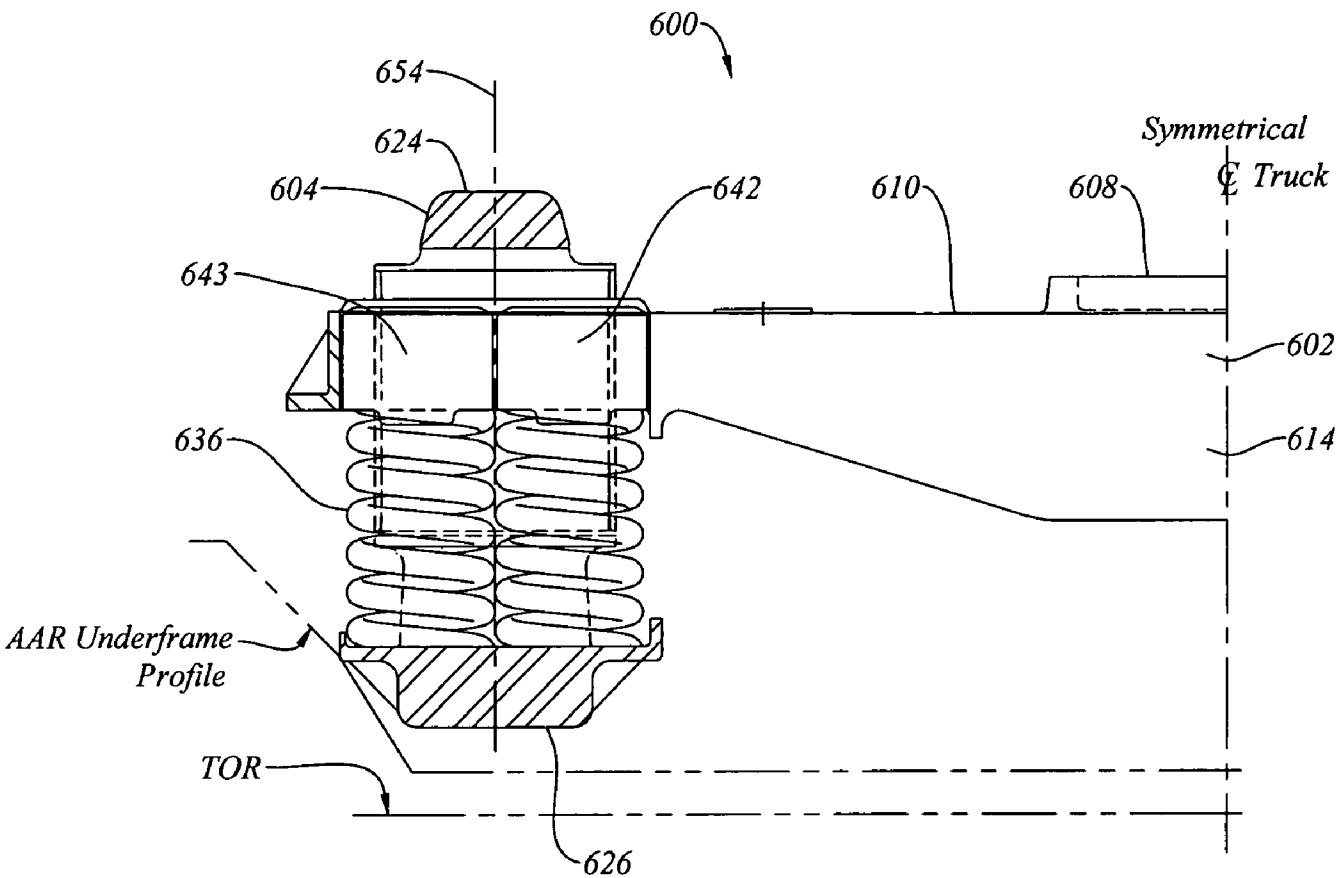
FIG. 9*d* shows a partial section of the three piece truck of FIG. 9*b* taken on '9*d*—9*d'*.

FIGS. 9*a*, 9*b*, 9*c*, 9*d* and 9*e* all relate to a three piece truck 600 for use with the rail road cars of FIGS. 2*a*, 3*a*, 3*b*, 4*a* or 4*b*. FIGS. 2*c* and 2*d* show the relationship of this truck to the deck level of these rail road cars. Truck 600 has three major elements, those elements being a truck bolster 602, symmetrical about the truck longitudinal centreline, and a pair of first and second side frames, indicated as 604. Only one side frame is shown in FIG. 9*c* given the symmetry of truck 600. Three piece truck 600 has a resilient suspension (a primary suspension) provided by a spring groups 605 trapped between each of the distal (i.e., transversely outboard) ends of truck bolster 602 and side frames 604.

Truck bolster 602 is a rigid, fabricated beam having a first end for engaging one side frame assembly and a second end for engaging the other side frame assembly (both ends being indicated as 606). A center plate or center bowl 608 is located at the truck center. An upper flange 610 extends between the two ends 606, being narrow at a central waist and flaring to a wider transversely outboard termination at ends 606. Truck bolster 602 also has a lower flange 612 and two fabricated webs 614 extending between upper flange 610 and lower flange 612 to form an irregular, closed section box beam. Additional webs 615 are mounted between the distal portions of upper flange 610 and 614 where bolster 602 engages one of the spring groups 605. The transversely distal region of truck bolster 602 also has friction damper seats 616, 618 for accommodating friction damper wedges as described further below.

Side frame 604 is a casting having bearing seats 619 into which bearing adapters 620, bearings 621, and a pair of axles 622 mount. Each of axles 622 has a pair of first and second wheels 623, 625 mounted to it in a spaced apart position corresponding to the width of the track gauge of the track upon which the rail car is to operate. Side frame 604 also has a compression member, or upper beam member 624, a tension member, or lower beam member 626, and vertical side columns 628 and 630, each lying to one side of a vertical transverse plane 625 bisecting truck 600 at the longitudinal station of the truck center. A generally rectangular opening in the nature of a sideframe window 627 is defined by the co-operation of the upper and lower beam members 624, 626 and vertical columns 628, 630. The distal end of truck bolster 602 can be introduced into window 627. The distal end of truck bolster 602 can then move up and down relative to the side frame within this opening. Lower beam member 626 (the tension member) has a bottom or lower spring seat 632 upon which spring group 605 can seat. Similarly, an upper spring seat 634 is provided by the underside of the distal portion of bolster 602 to engages the upper end of spring group 605. As such, vertical movement of truck bolster 602 will tend to compress or release the springs in spring group 605.

For the purposes of this description the swivelling, 4 wheel, 2 axle truck 600 has first and second sideframes 604 that can be taken as having the same upper rocker assembly as truck 520, and has a rigidly mounted lower spring seat 632, like spring seat 544, but having a shape to suit the 2 rows×4 columns spring layout rather than the 3×3 layout of truck 520. It may also be noted that sideframe window 627 has greater width between sideframe columns 628, 630 than window 526 between columns 528 to accommodate the longer spring group footprint, and bolster 602 similarly has a wider end to sit over the spring group.

In the embodiment of FIG. 9*a*, spring group 605 has two rows of springs 636, a transversely inboard row and a transversely outboard row, each row having four large (8 inch +/−) diameter coil springs 636, 637, 638, 639 giving vertical bounce spring rate constant, k, for group 605 of less than 10,000 lbs/inch. This spring rate constant can be in the range of 6000 to 10,000 lbs/in., and is advantageously in the range of 7000 to 9500 lbs/in, and preferably in the range of 8000–8500 lbs./in., giving an overall vertical bounce spring rate for the truck of double these values, preferably in the range of 14000 to 18,500 lbs/in, or more narrowly, 16,000–17000 lbs./in. for the truck. The spring array can include nested coils of outer springs, inner springs, and inner-inner springs depending on the overall spring rate desired for the group, and the apportionment of that stiffness. The number of springs, the number of inner and outer coils, and the spring rate of the various springs can be varied. The spring rates of the coils of the spring group add to give the spring rate constant of the group, typically being suited for the loading for which the truck is designed.

Each side frame assembly also has four friction damper wedges arranged in first and second pairs of transversely inboard and transversely outboard wedges 640, 641, 642 and 643 that engage the sockets, or seats 616, 618 in a four-cornered arrangement. The corner springs in spring group 605 bear upon a friction damper wedge 640, 641, 642 or 643. Each of vertical columns 628, 630 has a friction wear plate 650 having transversely inboard and transversely outboard regions against which the friction faces of wedges 640, 641, 642 and 643 can bear, respectively. Bolster gibs 651 and 653 lie inboard and outboard of wear plate 650 respectively. Gibs 651 and 653 act to limit the lateral travel of bolster 602 relative to side frame 604. The deadweight compression of the springs under the dampers will tend to yield a reaction force working on the bottom face of the wedge, trying to drive the wedge upward along the inclined face of the seat in the bolster, thus urging, or biasing, the friction face against the opposing portion of the friction face of the side frame column. In one embodiment, the springs chosen can have an undeflected length of 15 inches, and a dead weight deflection of about 3 inches.

Figure 9E:
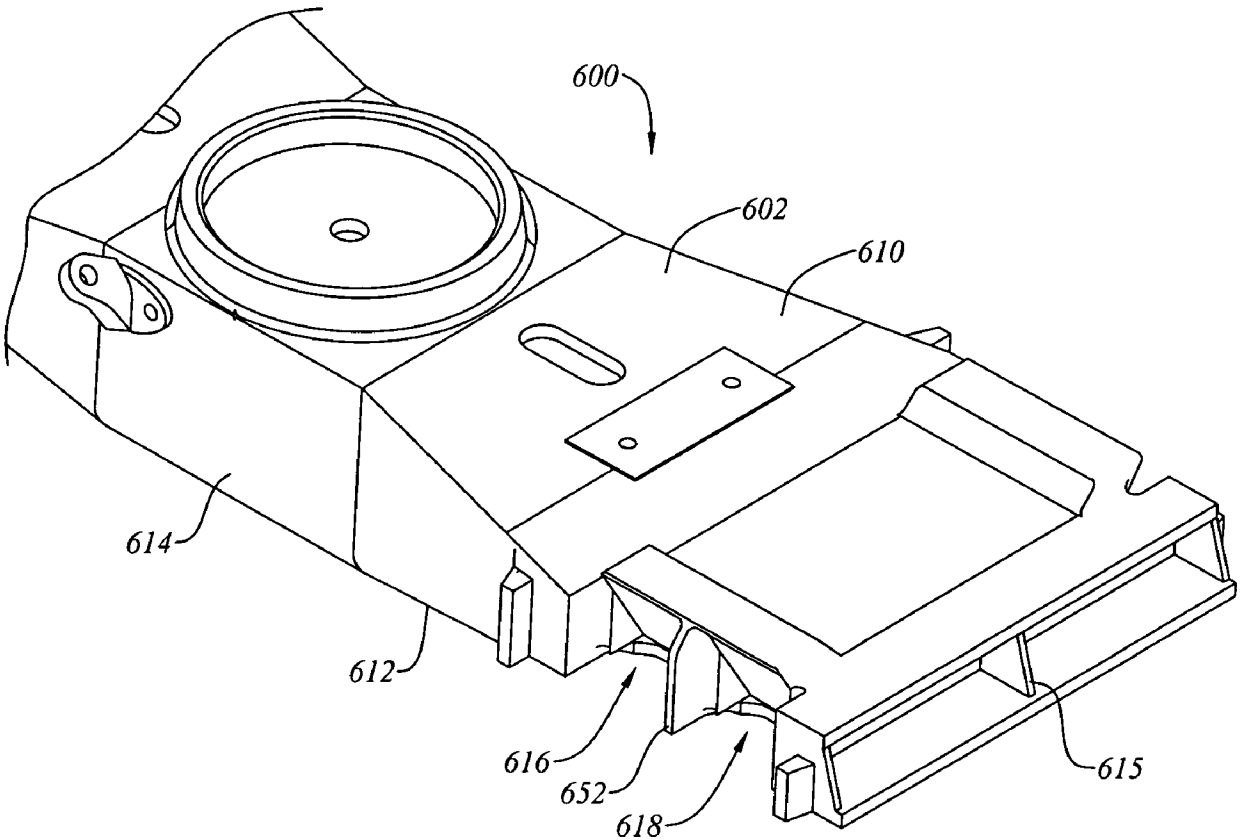
FIG. 9*e* shows a partial isometric view of the truck bolster of the three piece truck of FIG. 9*a* showing friction damper seats.
Figure 9F:
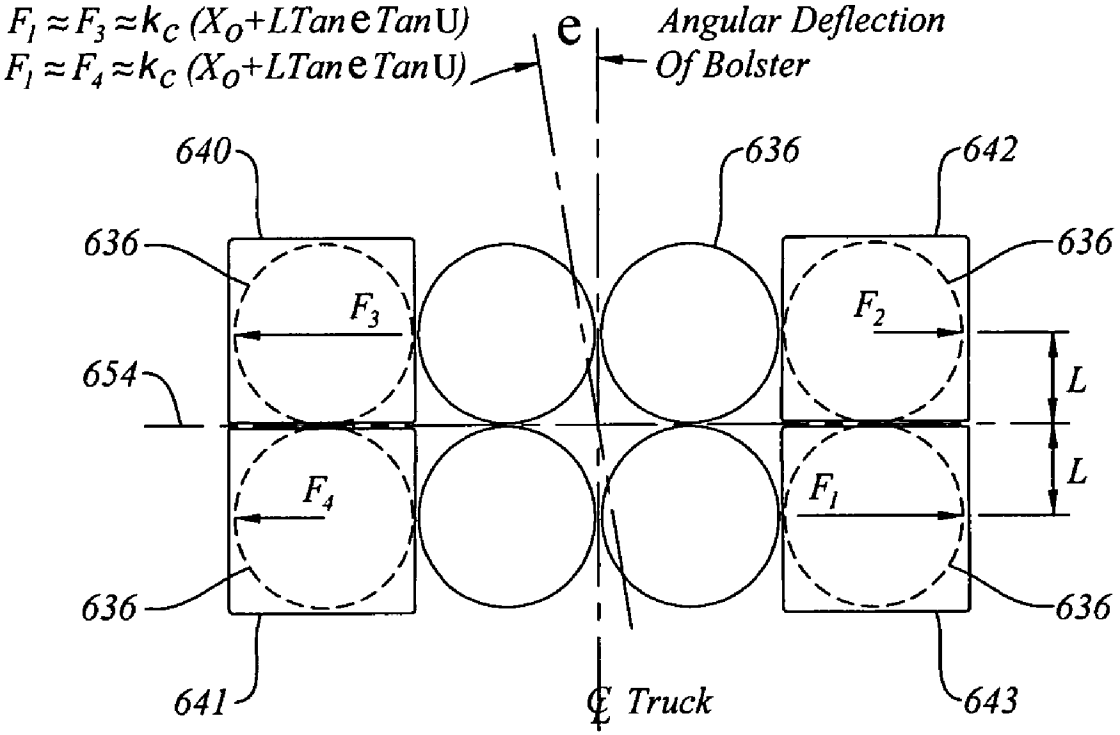
FIG. 9*f* shows a force schematic for dampers in the side frame of the truck of FIG. 9*a.;*

As seen in the top view of FIG. 9*c*, and in the schematic sketch of FIG. 9*f* the side-by-side friction dampers have a relatively wide averaged moment arm L to resist angular deflection of the side frame relative to the truck bolster in the parallelogram mode. This moment arm is significantly greater than the effective moment arm of a single wedge located on the spring group (and side frame) centre line. Further, the use of independent springs under each of the wedges means that whichever wedge is jammed in tightly, there is always a dedicated spring under that specific wedge to resist the deflection. In contrast to older designs, the overall damping face width is greater because it is sized to be driven by relatively larger diameter (e.g., 8 in +/−) springs, as compared to the smaller diameter of, for example, AAR B 432 out or B 331 side springs, or smaller. Further, in having two elements side-by-side the effective width of the damper is doubled, and the effective moment arm over which the diagonally opposite dampers work to resist parallelogram deformation of the truck in hunting and curving greater than it would have been for a single damper.

In the illustration of FIG. 9*e*, the damper seats are shown as being segregated by a partition 652. If a longitudinal vertical plane 654 is drawn through truck 600 through the center of partition 652, it can be seen that the inboard dampers lie to one side of plane 654, and the outboard dampers lie to the outboard side of plane 654. In hunting then, the normal force from the damper working against the hunting will tend to act in a couple in which the force on the friction bearing surface of the inboard pad will always be fully inboard of plane 654 on one end, and fully outboard on the other diagonal friction face. For the purposes of conceptual visualisation, the normal force on the friction face of any of the dampers can be idealised as an evenly distributed pressure field whose effect can be approximated by a point load whose magnitude is equal to the integrated value of the pressure field over its area, and that acts at the centroid of the pressure field. The center of this distributed force, acting on the inboard friction face of wedge 640 against column 628 can be thought of as a point load offset transversely relative to the diagonally outboard friction face of wedge 643 against column 630 by a distance that is notionally twice dimension 'L' shown in the conceptual sketch of FIG. 9*f*. In the example, this distance is about one full diameter of the large spring coils in the spring set. It is a significantly greater effective moment arm distance than found in typical friction damper wedge arrangements. The restoring moment in such a case would be, conceptually, $M_R=[(F_1+F_3)-(F_2+F_4)]L$. As indicated by the formulae on the conceptual sketch of FIG. 9*f*, the difference between the inboard and outboard forces on each side of the bolster is proportional to the angle of deflection $\epsilon$ of the truck bolster relative to the side frame, and since the normal forces due to static deflection $x_0$ may tend to cancel out, $M_R=4k_c\mathrm{Tan}(\epsilon)\mathrm{Tan}(\theta)L$, where $\theta$ is the primary angle of the damper, and $k_c$ is the vertical spring constant of the coil upon which the damper sits and is biased.

Further, in typical friction damper wedges, the enclosed angle of the wedge tends to be somewhat less than 35 degrees measured from the vertical face to the sloped face against the bolster. As the wedge angle decreases toward 30 degrees, the tendency of the wedge to jam in place increases. Conventionally the wedge is driven by a single spring in a large group. The portion of the vertical spring force acting on the damper wedges can be less than 15% of the group total. In the embodiment of FIG. 9*b*, it is 50% of the group total (i.e., 4 of 8 equal springs). The wedge angle of wedges 640, 642 is significantly greater than 35 degrees. The use of more springs, or more precisely a greater portion of the overall spring stiffness, under the dampers, permits the enclosed angle of the wedge to be over 35 degrees, whether in the range of between roughly 37 to 40 or 45 degrees, to roughly 60 or 65 degrees.

In this example, damper wedges 640, 641 and 642, 643 sit over 50% of the spring group i.e., ⅝ namely springs 636, 637, 638, 639. For the same proportion of vertical damping as in truck 420, wedges 640, 641 and 642, 643 may tend to have a larger included angle, possibly about 60 degrees, although angles in the range of 45 to 70 degrees could be chosen depending on spring combinations and spring stiffnesses. Once again, in a warping condition, the somewhat wider damping region (the width of two full coils plus lateral travel of 1½" (+/−)) of sideframe column wear plates 627, 629 lying between inboard and outboard gibbs 611, 613, 615, 617 relative to truck 20 (a damper width of one coil with travel), sprung on individual springs (inboard and outboard in truck 600, as opposed to a single central coil in truck 20), may tend to generate a moment couple to give a restoring force working on a moment arm. This restoring force may tend to urge the sideframe back to a square orientation relative to the bolster, with diagonally opposite pairs of springs working as described above. In this instance, the springs each work on a moment arm distance corresponding to half of the distance between the centers of the 2 rows of coils, rather than half the 3 coil distance shown in FIG. 8.

Where a softer suspension is used employing a relatively small number of large diameter springs, such as in a 2×4, 3×3, or 3×5 group as described in the detailed description of the invention herein, dampers may be mounted over each of four corner positions. In that case, the portion of spring force acting under the damper wedges may be in the 25–50% range for springs of equal stiffness. If the coils or coil groups are not of equal stiffness, the portion of spring force acting under the dampers may be in the range of perhaps 20% to 70%. The coil groups can be of unequal stiffness if inner coils are used in some springs and not in others, or if springs of differing spring constant are used.

The size of the spring group embodiment of FIG. 9*b* yields a side frame window opening having a width between the vertical columns of side frame 604 of roughly 33 inches. This is relatively large compared to existing spring groups, being more than 25% greater in width. In an alternate 3×5 spring group arrangement of 5½" diameter springs, the opening between the sideframe columns is more than 27½ inches wide, in one preferred embodiment being between 29 and 30 inches wide, namely about 29¼ inches.

Truck 600 has a correspondingly greater wheelbase length, indicated as WB. WB is advantageously greater than 73 inches, or, taken as a ratio to the track gauge width, is advantageously greater than 1.30 time the track gauge width. It is preferably greater than 80 inches, or more than 1.4 times the gauge width, and in one embodiment is greater than 1.5 times the track gauge width, being as great, or greater than, about 86 inches. Similarly, the side frame window is advantageously wider than tall, the measurement across the wear plate faces of the side frame columns being advantageously greater than 24", possibly in the ratio of greater than 8:7 of width to height, and possibly in the range of 28" or 32" or more, giving ratios of greater than 4:3 and greater than 3:2. The spring seat may have lengthened dimensions to correspond to the width of the side frame window, and a transverse width of 15½–17" or more.

Figure 10A:
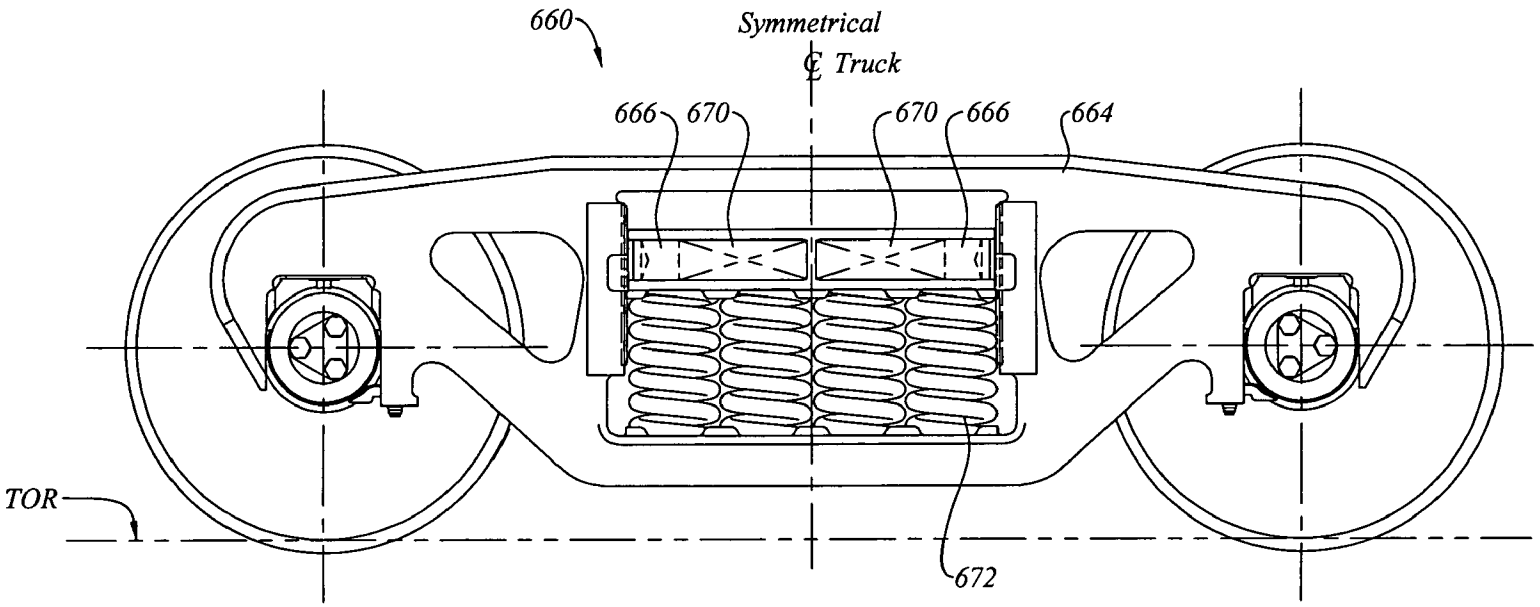
FIG. 10*a* shows a side view of an alternate three piece truck to that of FIG. 9*a;*
Figure 10B:
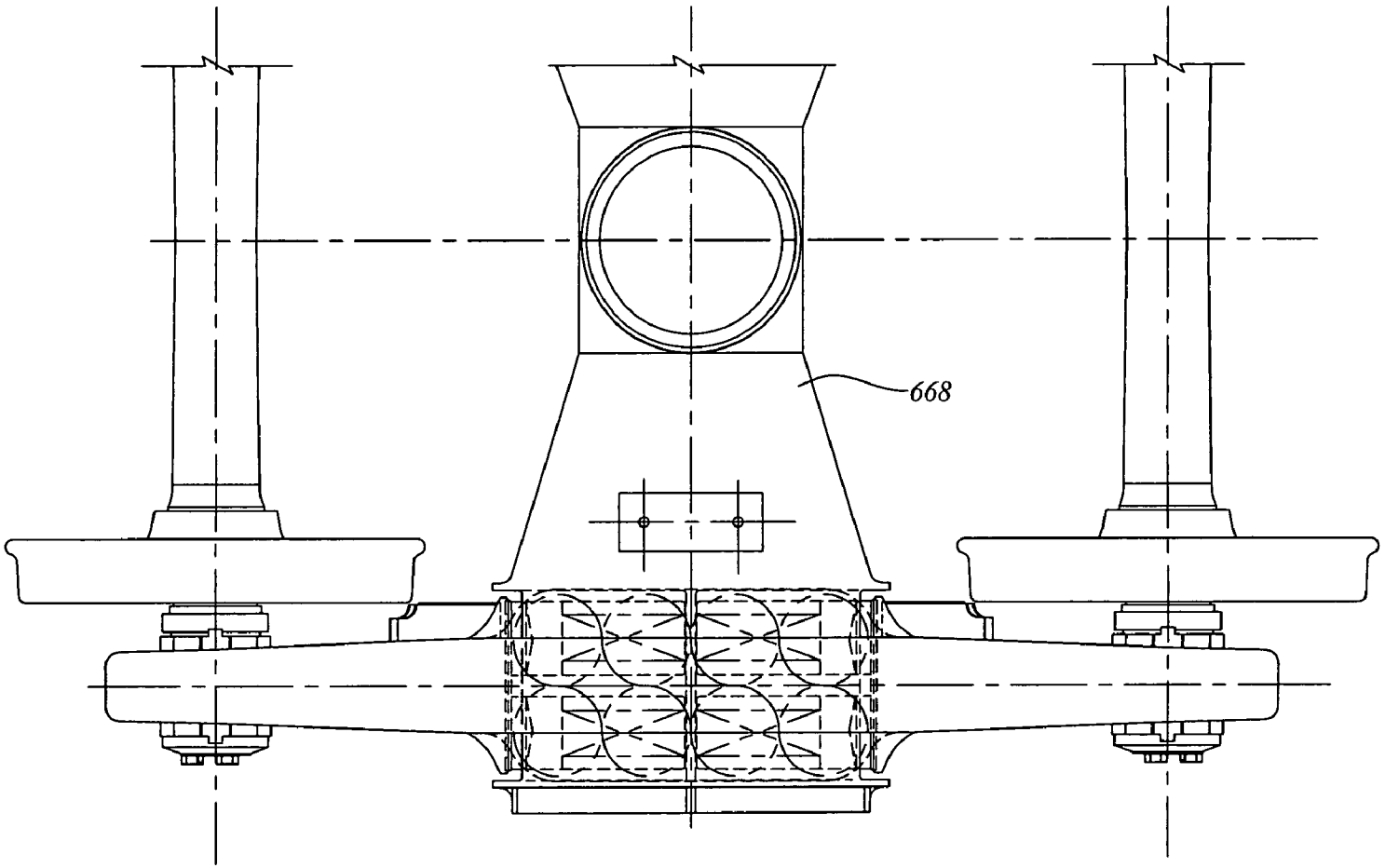
FIG. 10*b* shows a top view of half of the three piece truck of FIG. 10*a*.
Figure 10C:
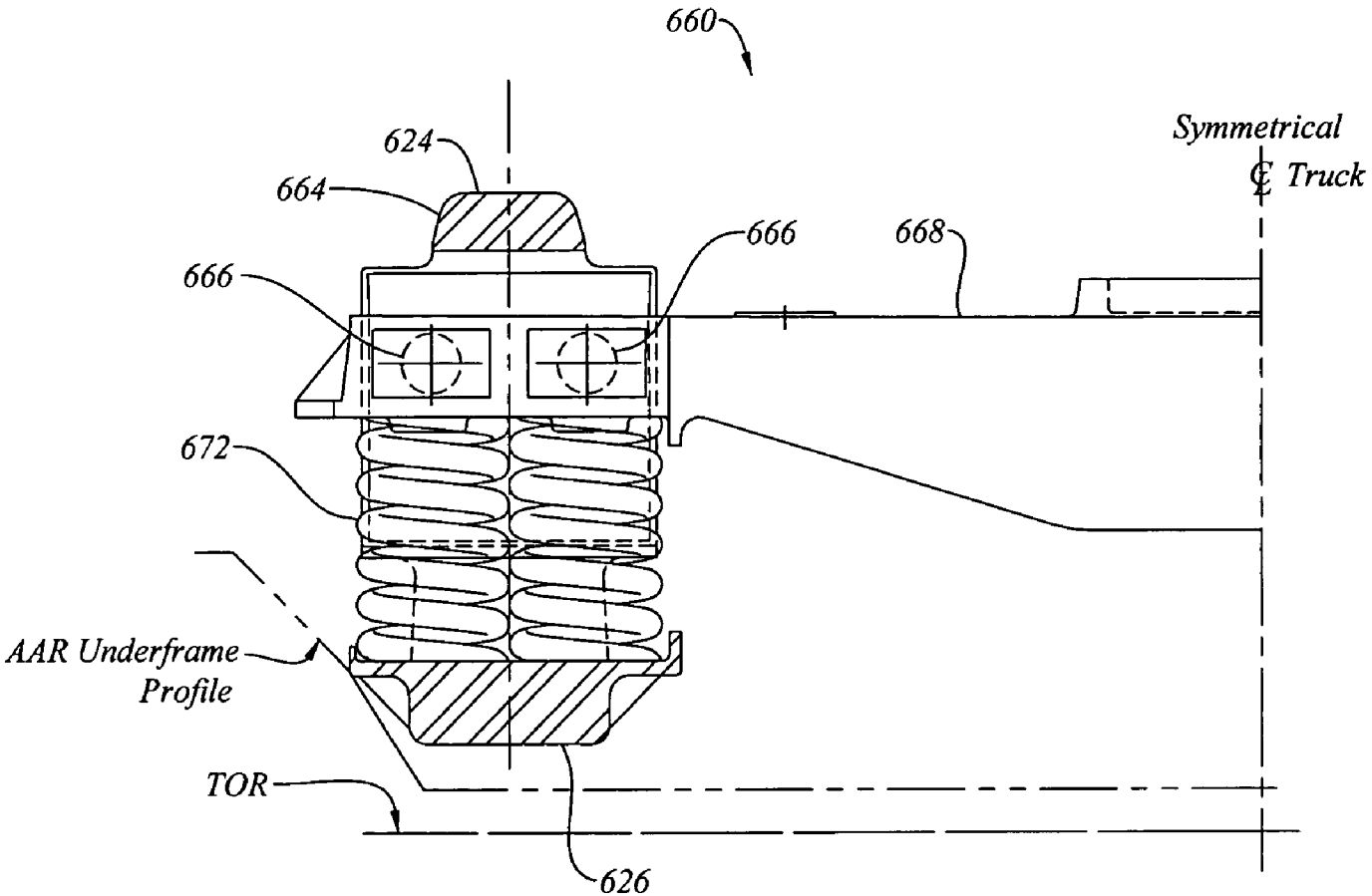
FIG. 10*c* shows a partial section of the three piece truck of FIG. 10*a* taken on '10*c*—10*c'*.

FIGS. 10*a*, 10*b* and 10*c*, there is an alternate embodiment of soft spring rate, long wheelbase three piece truck, identified as 660. Truck 660 employs constant force inboard and outboard, fore and aft pairs of friction dampers 666 mounted in the distal ends of truck bolster 668. In this arrangement, springs 670 are mounted horizontally in pockets in the distal ends of truck bolster 668 and urge, or bias, each of the friction dampers 666 against the corresponding friction surfaces of the vertical columns of the side frames.

The spring force on friction damper wedges 640, 641, 642 and 643 varies as a function of the vertical displacement of truck bolster 602, since they are driven by the vertical springs of spring group 605. By contrast, the deflection of springs 670 does not depend on vertical compression of the main spring group 672, but rather is a function of an initial pre-load. Although the arrangement of FIGS. 10*a*, 10*b* and 10*c* still provides inboard and outboard dampers and independent springing of the dampers, the embodiment of FIGS. 9*b* is preferred to that of FIGS. 6*a*, 6*b* and 6*c*.

Damper Variations

Figures 11A, 11B:
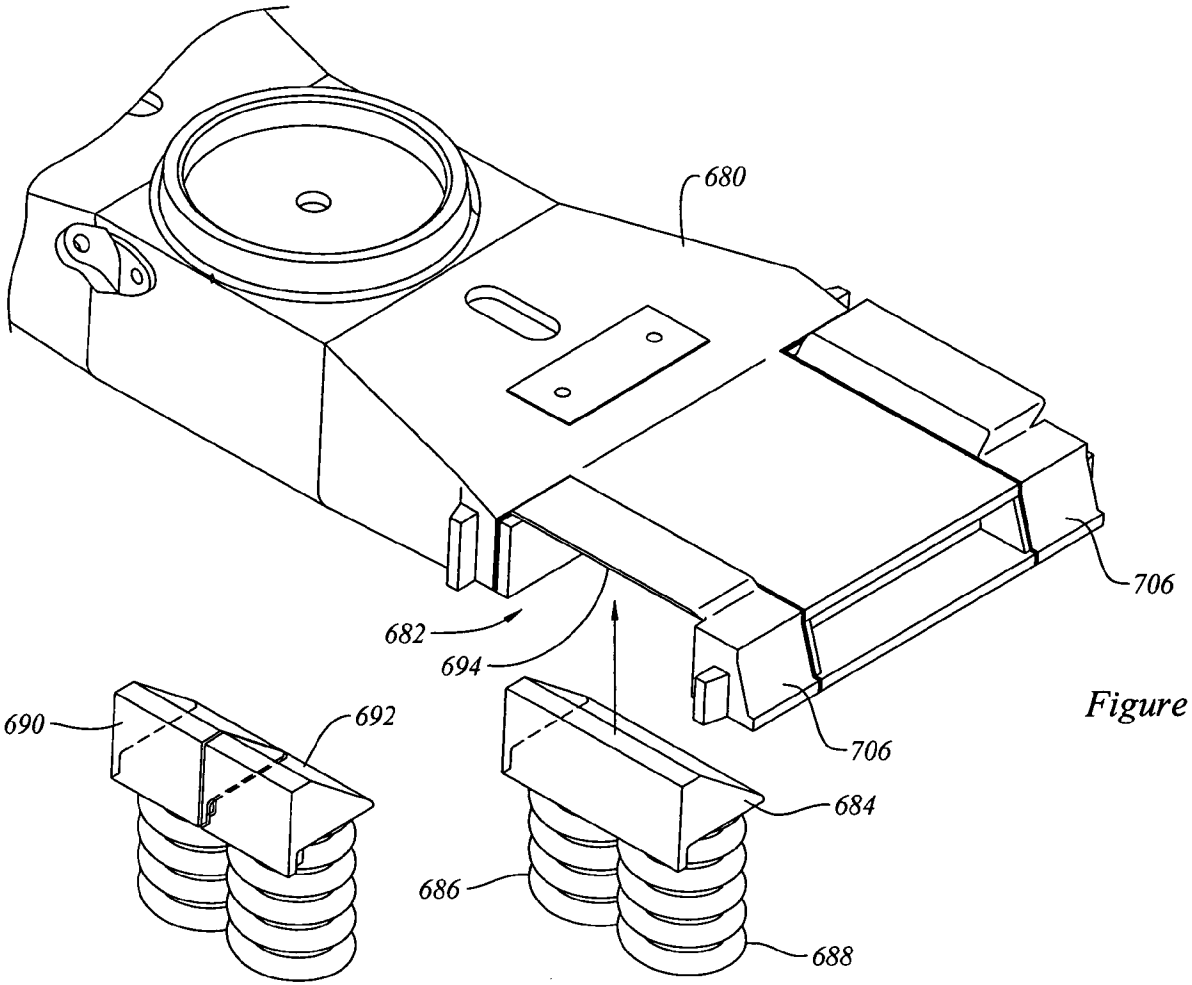
FIG. 11*a* shows an alternate version of the bolster of FIG. 9*e*, with a double sized damper pocket for seating a large single wedge having a welded insert.
FIG. 11*b* shows an alternate optional dual wedge for a truck bolster like that of FIG. 11*a;*

FIGS. 11*a* and 11*b* show a partial isometric view of a truck bolster 680 that is generally similar to truck bolster 600 of FIG. 9*a*, except insofar as bolster pocket 682 does not have a central partition like web 652, but rather has a continuous bay extending across the width of the underlying spring group, such as spring group 636. A single wide damper wedge is indicated as 684. Damper 684 is of a width to be supported by, and to be acted upon, by two springs 686, 688 of the underlying spring group. In the event that bolster 600 may tend to deflect to a non-perpendicular orientation relative to the associated side frame, as in the parallelogramming phenomenon, one side of wedge 684 will tend to be squeezed more tightly than the other, giving wedge 684 a tendency to twist in the pocket about an axis of rotation perpendicular to the angled face (i.e., the hypotenuse face) of the wedge. This twisting tendency may also tend to cause differential compression in springs 686, 688, yielding a restoring moment both to the twisting of wedge 684 and to the non-square displacement of truck bolster 680 relative to the truck side frame. As there may tend to be a similar moment generated at the opposite spring pair at the opposite side column of the side frame, this may tend to enhance the self-squaring tendency of the truck more generally.

Also included in FIG. 11*b* is an alternate pair of damper wedges 690, 692. This dual wedge configuration can similarly seat in bolster pocket 682, and, in this case, each wedge 690, 692 sits over a separate spring. Wedges 690, 692 are in a side-by-side independently displacable vertically slidable relationship relative to each other along the primary angle of the face of bolster pocket 682. When the truck moves to an out of square condition, differential displacement of wedges 690, 692 may tend to result in differential compression of their associated springs, e.g., 686, 688 resulting in a restoring moment as above.

The sliding motion described above may tend to cause wear on the moving surfaces, namely (a) the side frame columns, and (b) the angled surfaces of the bolster pockets. To alleviate, or ameliorate, this situation, consumable wear plates 694 can be mounted in bolster pocket 682 (with appropriate dimensional adjustments) as in FIG. 11*b*. Wear plates 694 can be smooth steel plates, possibly of a hardened, wear resistant alloy, or can be made from a nonmetallic, or partially non-metallic, relatively low friction wear resistant surface. Other plates for engaging the friction surfaces of the dampers can be mounted to the side frame columns, and indicated by item 696 in FIG. 16*a*.

For the purposes of this example, it has been assumed that the spring group is two coils wide, and that the pocket is, correspondingly, also two coils wide. The spring group could be more than two coils wide. The bolster pocket is assumed to have the same width as the spring group, but could be less wide. For two coils where in some embodiments the group may be more than two coils wide. A symmetrical arrangement of the dampers relative to the side frame and the spring group is desirable, but an asymmetric arrangement could be made. In the embodiments of FIGS. 9*a*, 11*a* and 17*a*, the dampers are in four cornered arrangements that are symmetrical both about the center axis of the truck bolster and about a longitudinal vertical plane of the side frame.

Figure 12:
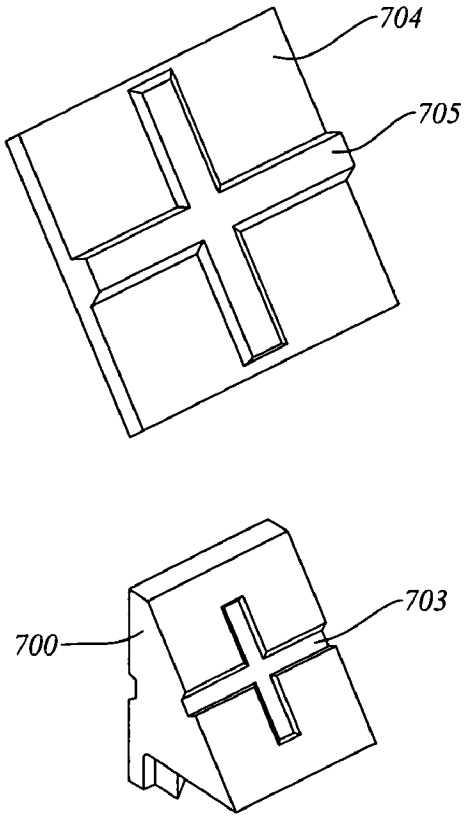
FIG. 12 shows an optional non-metallic wear surface arrangement for dampers such as used in the bolster of FIG. 11*b;*
Figure 12:
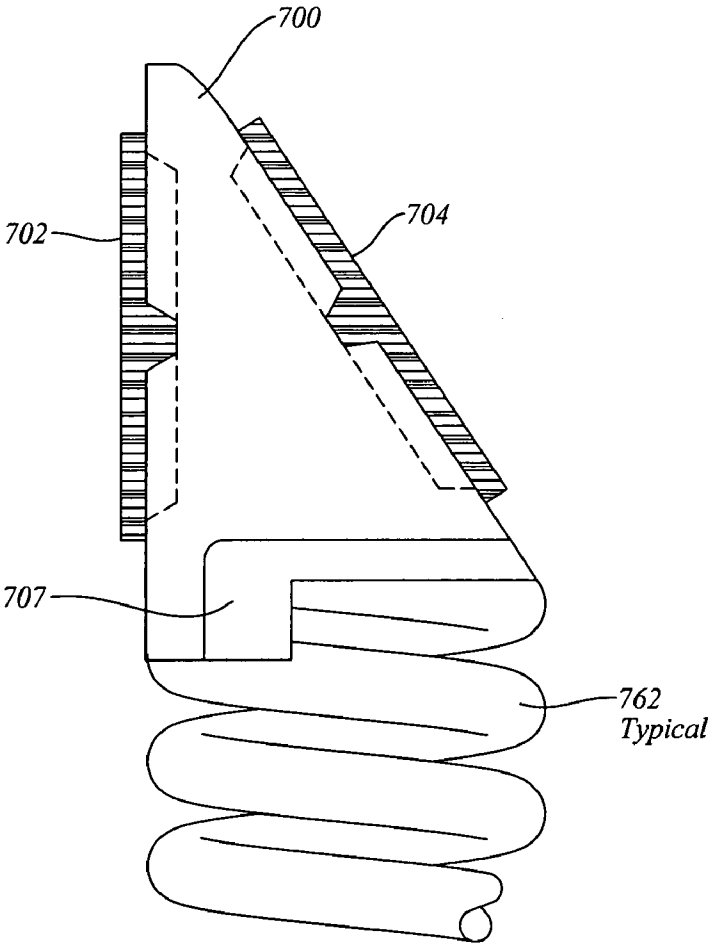

Similarly, the wedges themselves can be made from a relatively common material, such as a mild steel, and the given consumable wear face members in the nature of shoes, or wear members. Such an arrangement is shown in FIG. 12 in which a damper wedge is shown generically as 700. The replaceable, consumable wear members are indicated as 702, 704. The wedges and wear members have mating male and female mechanical interlink features, such as the cross-shaped relief 703 formed in the primary angled and vertical faces of wedge 700 for mating with the corresponding raised cross shaped features 705 of wear members 702, 704. Sliding wear member 702 is preferably made of a non-metallic, low friction material.

Although FIG. 12 shows a consumable insert in the nature of a wear plate, the entire bolster pocket can be made as a replaceable part, as in FIG. 11*a*. This bolster pocket can be made of a high precision casting, or can be a sintered powder metal assembly having desired physical properties. The part so formed is then welded into place in the end of the bolster, as at 706 indicated in FIG. 11*a*.

Figure 16A:
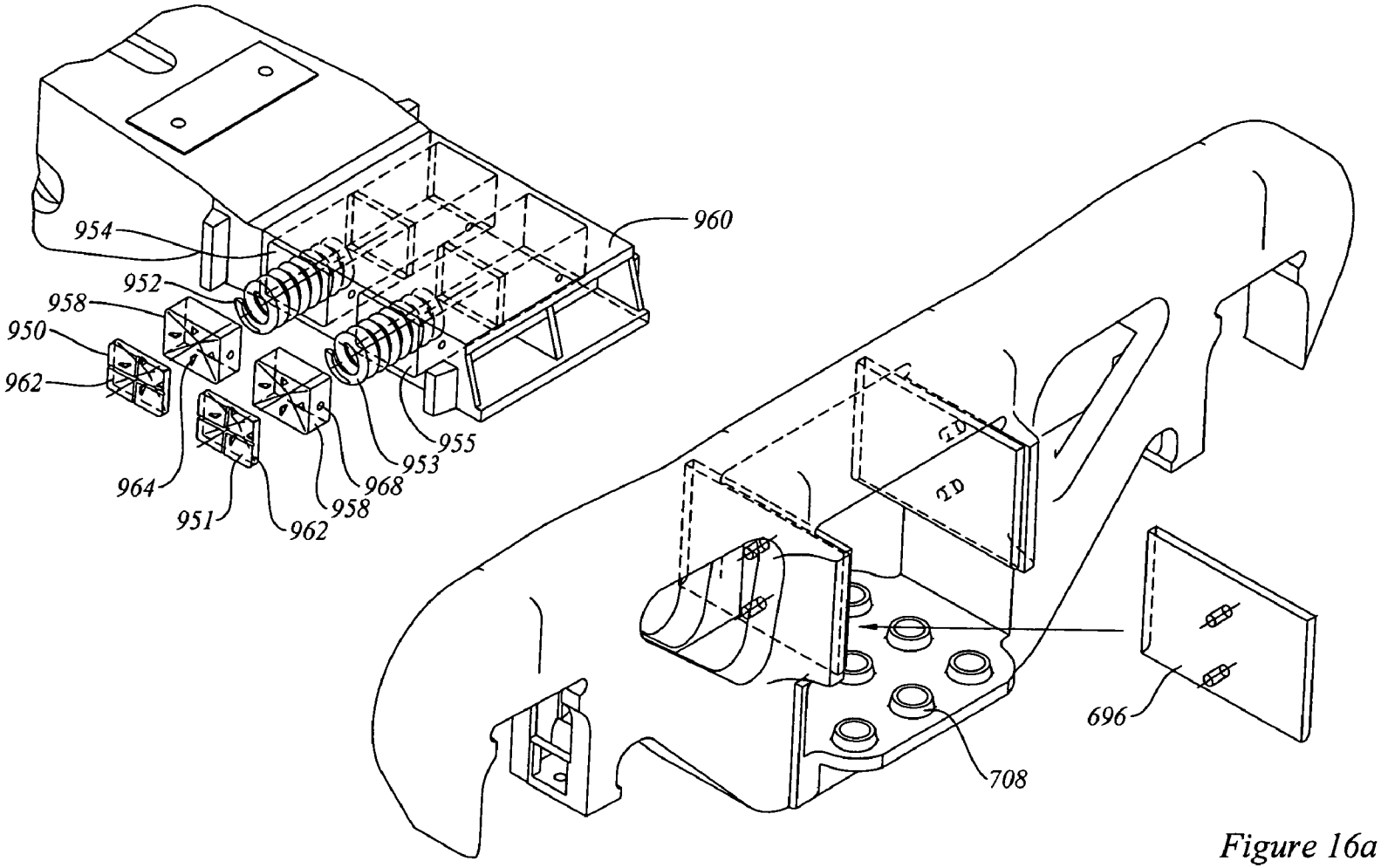
FIG. 16*a* shows an exploded isometric view of an alternate bolster and side frame assembly to that of FIG. 9*a*, in which horizontally acting springs drive constant force dampers.

The underside of the wedges described herein, wedge 700 being typical in this regard, has a seat, or socket 707, for engaging the top end of the spring coil, whichever spring it may be, spring 762 being shown as typically representative. Socket 707 serves to discourage the top end of the spring from wandering away from the intended generally central position under the wedge. A bottom seat, or boss for discouraging lateral wandering of the bottom end of the spring is shown in FIG. 16*a* as item 708.

Figure 11C:
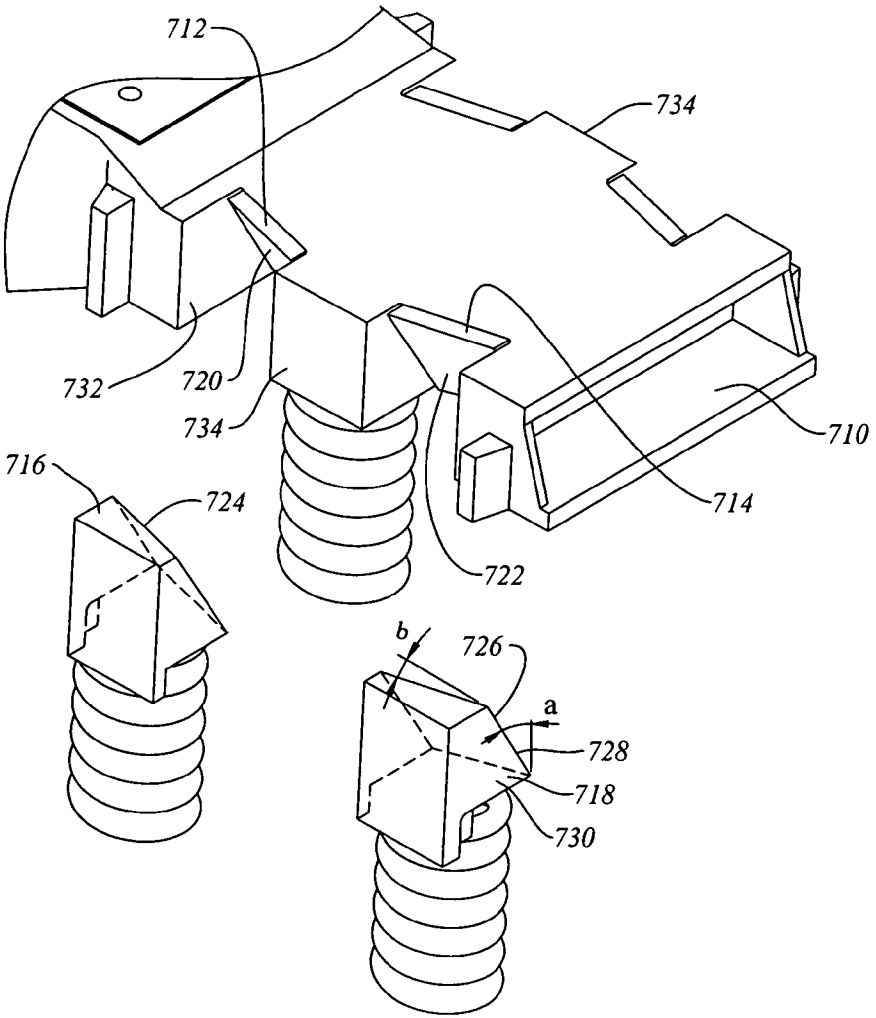
FIG. 11*c* shows an alternate bolster, similar to that of FIG. 9*a*, having a pair of spaced apart wedge pockets, and pocket inserts with both primary and secondary wedge angles.

Thus far only primary angles have been discussed. FIG. 11*c* shows an isometric view of an end portion of a truck bolster 710, generally similar to bolster 600. As with all of the truck bolsters shown and discussed herein, bolster 710 is symmetrical about the longitudinal vertical plane of the bolster (i.e., cross-wise relative to the truck generally) and symmetrical about the vertical mid-span section of the bolster (i.e., the longitudinal plane of symmetry of the truck generally, coinciding with the rail car longitudinal center line). Bolster 710 has a pair of spaced apart bolster pockets 712, 714 for receiving damper wedges 716, 718. Pocket 712 is laterally inboard of pocket 714 relative to the side frame of the truck more generally. Consumable wear plate inserts 720, 722 are mounted in pockets 712, 714 along the angled wedge face.

As can be seen, wedges 716, 718 have a primary angle, $\alpha$ as measured between vertical sliding face 724, (or 726, as may be) and the angled vertex 728 of outboard face 730. For the embodiments discussed herein, primary angle $\alpha$ will tend to be greater than 40 degrees, and may typically lie in the range of 45–65 degrees, possibly about 55–60 degrees. This angle will be common to the slope of all points on the sliding hypotenuse face of wedge 716 (or 718) when taken in any plane parallel to the plane of outboard end face 730. This same angle $\alpha$ is matched by the facing surface of the bolster pocket, be it 712 or 714, and it defines the angle upon which displacement of wedge 716, (or 718) is intended to move relative to that surface.

A secondary angle $\beta$ gives the inboard, (or outboard), rake of the hypotenuse surface of wedge 716 (or 718). The true rake angle can be seen by sighting along plane of the hypotenuse face and measuring the angle between the hypotenuse face and the planar outboard face 730. The rake angle is the complement of the angle so measured. The rake angle may tend to be greater than 5 degrees, may lie in the range of 10 to 20 degrees, and is preferably about 15 degrees. A modest angle is desirable.

When the truck suspension works in response to track perturbations, the damper wedges may tend to work in their pockets. The rake angles yield a component of force tending to bias the outboard face 730 of outboard wedge 718 outboard against the opposing outboard face of bolster pocket 714. Similarly, the inboard face of wedge 716 will tend to be biased toward the inboard planar face of inboard bolster pocket 712. These inboard and outboard faces of the bolster pockets are preferably lined with a low friction surface pad, indicated generally as 732. The left hand and right hand biases of the wedges may tend to keep them apart to yield the full moment arm distance intended, and, by keeping them against the planar facing walls, may tend to discourage twisting of the dampers in the respective pockets.

Bolster 710 includes a middle land 734 between pockets 712, 714, against which another spring 736 may work, such as might be found in a spring group that is three (or more) coils wide. However, whether two, three, or more coils wide, and whether employing a central land or no central land, bolster pockets can have both primary and secondary angles as illustrated in the example embodiment of FIG. 11*c*, with or without (though preferably with) wear inserts.

In the case where a central land, such as land 734 separates two damper pockets, the opposing wear plates of the side frame columns need not be monolithic. That is, two wear plate regions could be provided, one opposite each of the inboard and outboard dampers, presenting planar surfaces against which those dampers can bear. Advantageously, the normal vectors of those regions are parallel, and most conveniently those surfaces are co-planar and perpendicular to the long axis of the side frame, and present a clear, un-interrupted surface to the friction faces of the dampers.

Figure 11D:
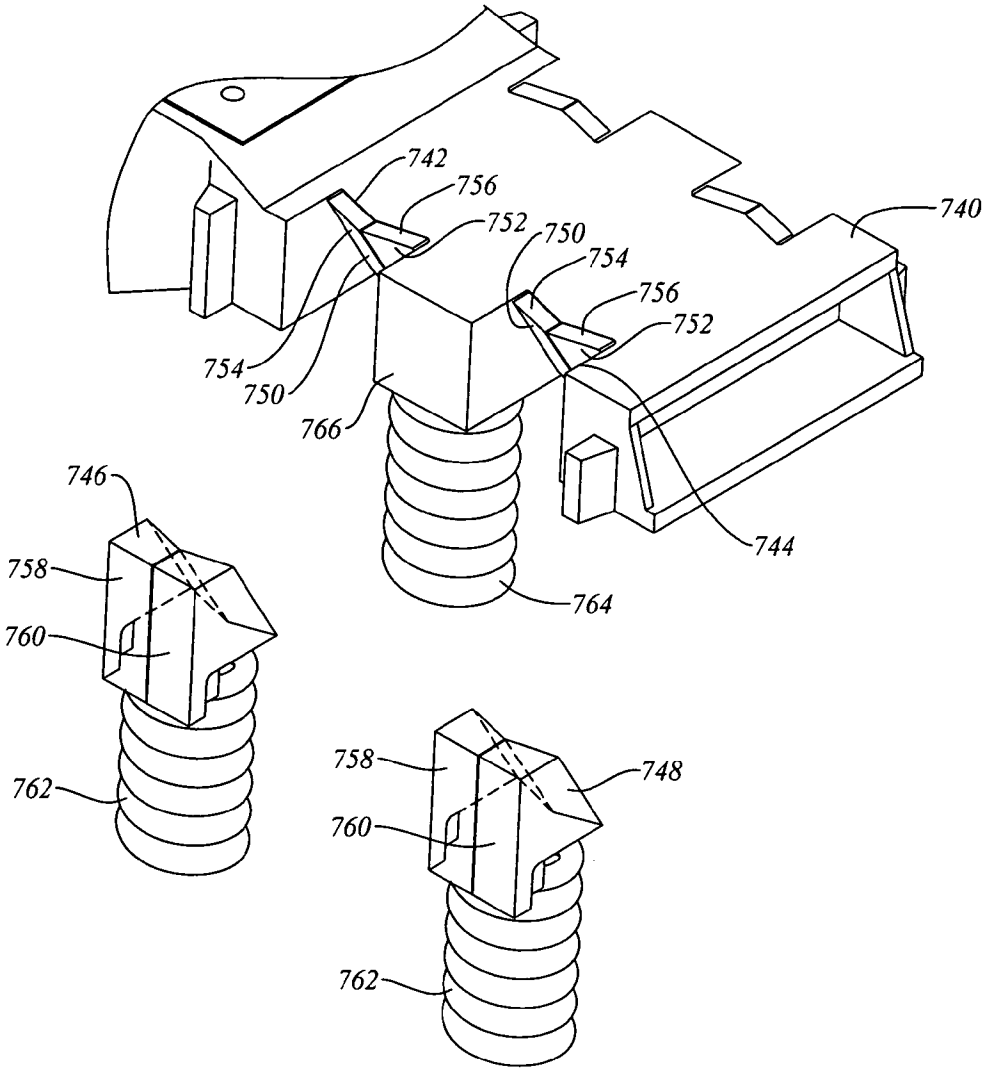
FIG. 11*d* shows an alternate bolster, similar to that of FIG. 11*c*, and split wedges.

The examples of FIGS. 11*a*, 11*b* and 11*c* are arranged in order of incremental increases in complexity. The Example of FIG. 11*d* again provides a further incremental increase in complexity. FIG. 11*d* shows a bolster 740 that is similar to bolster 710 except insofar as bolster pockets 742, 744 each accommodate a pair of split wedges 746, 748. Pockets 742, 744 each have a pair of bearing surfaces 750, 752 that are inclined at both a primary angle and a secondary angle, the secondary angles of surfaces 750 and 752 being of opposite hand to yield the damper separating forces discussed above. Surfaces 750 and 752 are also provided with linings in the nature of relatively low friction wear plates 754, 756. Each of pockets 742 and 744 accommodates a pair of split wedges 758, 760. Each pair of split wedges seats over a single spring 762. Another spring 764 bears against central land 766.

Figures 13A, 13B, 13C, 13D:
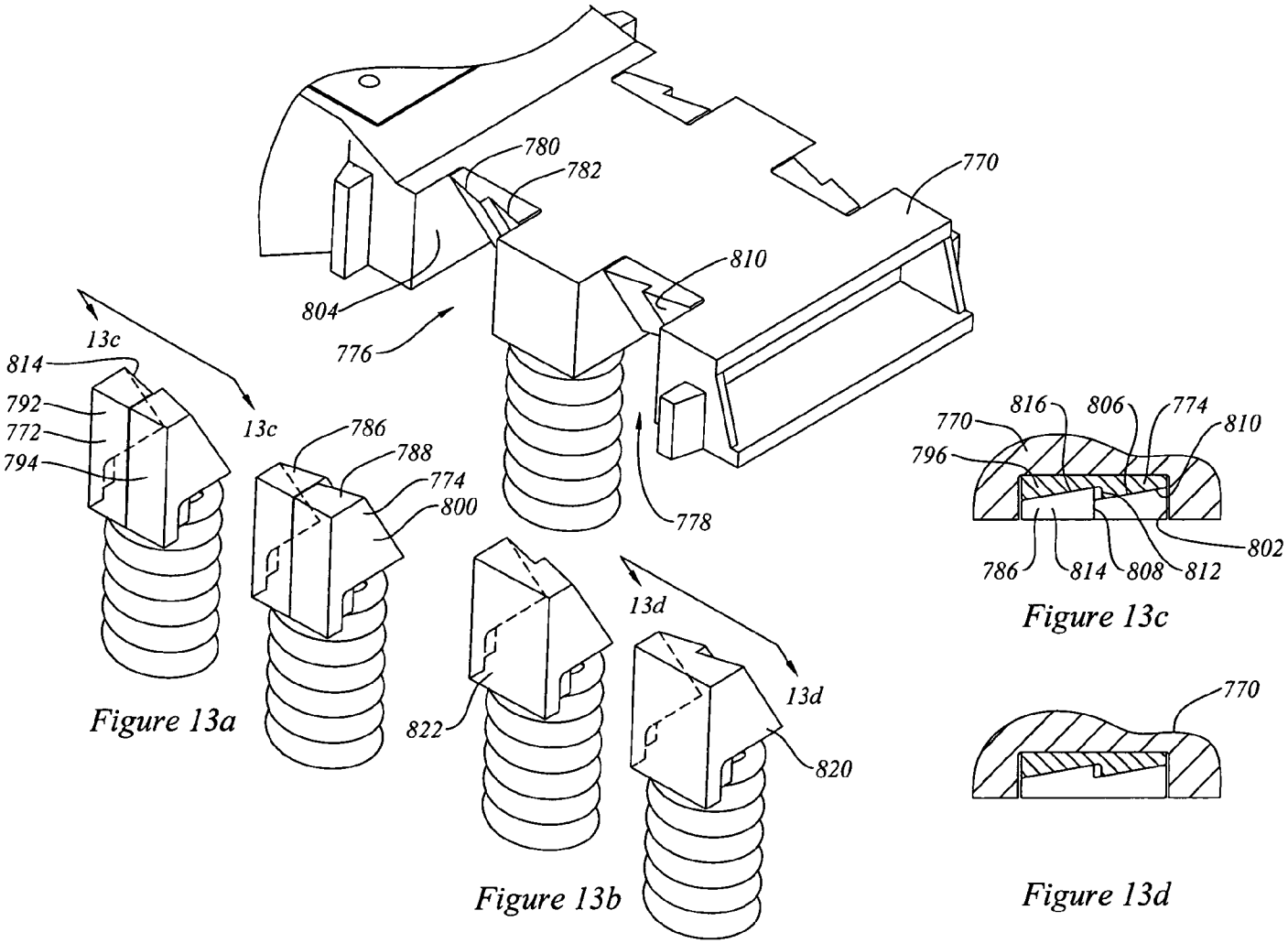
FIG. 13*a* shows a bolster similar to that of FIG. 11*c*, having a wedge pocket having primary and secondary angles and a split wedge arrangement for use therewith.
FIG. 13*b* shows an alternate stepped single wedge for the bolster of FIG. 13*a;*
FIG. 13*c* is a view looking along a plane on the primary angle of the split wedge of FIG. 13*a* relative to the bolster pocket.
FIG. 13*d* is a view looking along a plane on the primary angle of the stepped wedge of FIG. 13*b* relative to the bolster pocket.

The example of FIG. 13*a* shows a combination of a bolster 770 and biased split wedges 772, 774. Bolster 770 is the same as bolster 740 except insofar as bolster pockets 776, 778 are stepped pockets in which the steps, e.g., items 780, 782, have the same primary angle, and the same secondary angle, and are both biased in the same direction, unlike the symmetrical sliding faces of the split wedges in FIG. 11*d*, which are left and right handed. Thus the outboard pair of split wedges 784 has a first member 786 and a second member 788 each having primary angle α and secondary angle β, and are of the same hand such that in use both the first and second members will tend to be biased in the outboard direction (i.e. toward the distal end of bolster 770). Similarly, the inboard pair of split wedges 790 has a first member 792 and a second member 794 each having primary angle α, and secondary angle β, except that the sense of secondary angle β is in the opposite direction such that members 792 and 792 will tend in use to be driven in the inboard direction (i.e., toward the truck center).

As shown in the partial sectional view of FIG. 13*c*, a replaceable monolithic stepped wear insert 796 is welded in the bolster pocket 780 (or 782 if opposite hand, as the case may be). Insert 796 has the same primary and secondary angles α and β as the split wedges it is to accommodate, namely 786, 788 (or, opposite hand, 792, 794). When installed, and working, the more outboard of the wedges, 788 (or, opposite hand, the more inboard of the wedges 792) has a vertical and longitudinally planar outboard face 800 that bears against a similarly planar outboard face 802 (or, opposite hand, inboard face 804) These faces are preferably prepared in a manner that yields a relatively low friction sliding interface between them. In that regard, a low friction pad may be mounted to either surface, preferably the outboard surface of pocket 780. The hypotenuse face 806 of member 788 bears against the opposing outboard land 810 of insert 796. The overall width of outboard member 788 is greater than that of outboard land 810, such that the inboard planar face of member 788 acts as an abutment face to fend inboard member 786 off of the surface of the step 812 in insert 796.

In similar manner inboard wedge member 786 has a hypotenuse face 814 that bears against the inboard land portion 816 of insert 796. The total width of bolster pocket 780 is greater than the combined width of wedge members, such that a gap is provided between the inboard (non-contacting) face of member 786 and the inboard planar face of pocket 780. The same relationship, but of opposite hand, exists between pocket 782 and members 792, 794.

In an optional embodiment, a low friction pad, or surfacing, can be used at the interface of members 786, 788 (or 792, 794) to facilitate sliding motion of the one relative to the other.

In this arrangement, working of the wedges, i.e., members 786, 788 against the face of insert 796 will tend to cause both members to move in one direction, namely to their most outboard position. Similarly, members 792 and 794 will work to their most inboard positions. This may tend to maintain the wedge members in an untwisted orientation, and may also tend to maintain the moment arm of the restoring moment at its largest value, both being desirable results.

When a twisting moment of the bolster relative to the side frames is experienced, as in parallelogram deformation, all four sets of wedges will tend to work against it. That is, the diagonally opposite pairs of wedges in the outboard pocket of one side of the bolster and on the inboard pocket on the other side will be compressed, and the opposite side will be, relatively, relieved, such that a differential force will exist. The differential force will work on a moment arm roughly equal to the distance between the centers of the inboard and outboard pockets, or slightly more given the gap arrangement.

In the further alternative arrangement of FIGS. 13*b* and 13*d*, a single, stepped wedge 820 is used in place of the pair of split wedges e.g., members 786, 788. A corresponding wedge of opposite hand is used in the other bolster pocket.

Figures 14A, 14B, 14C, 14D:
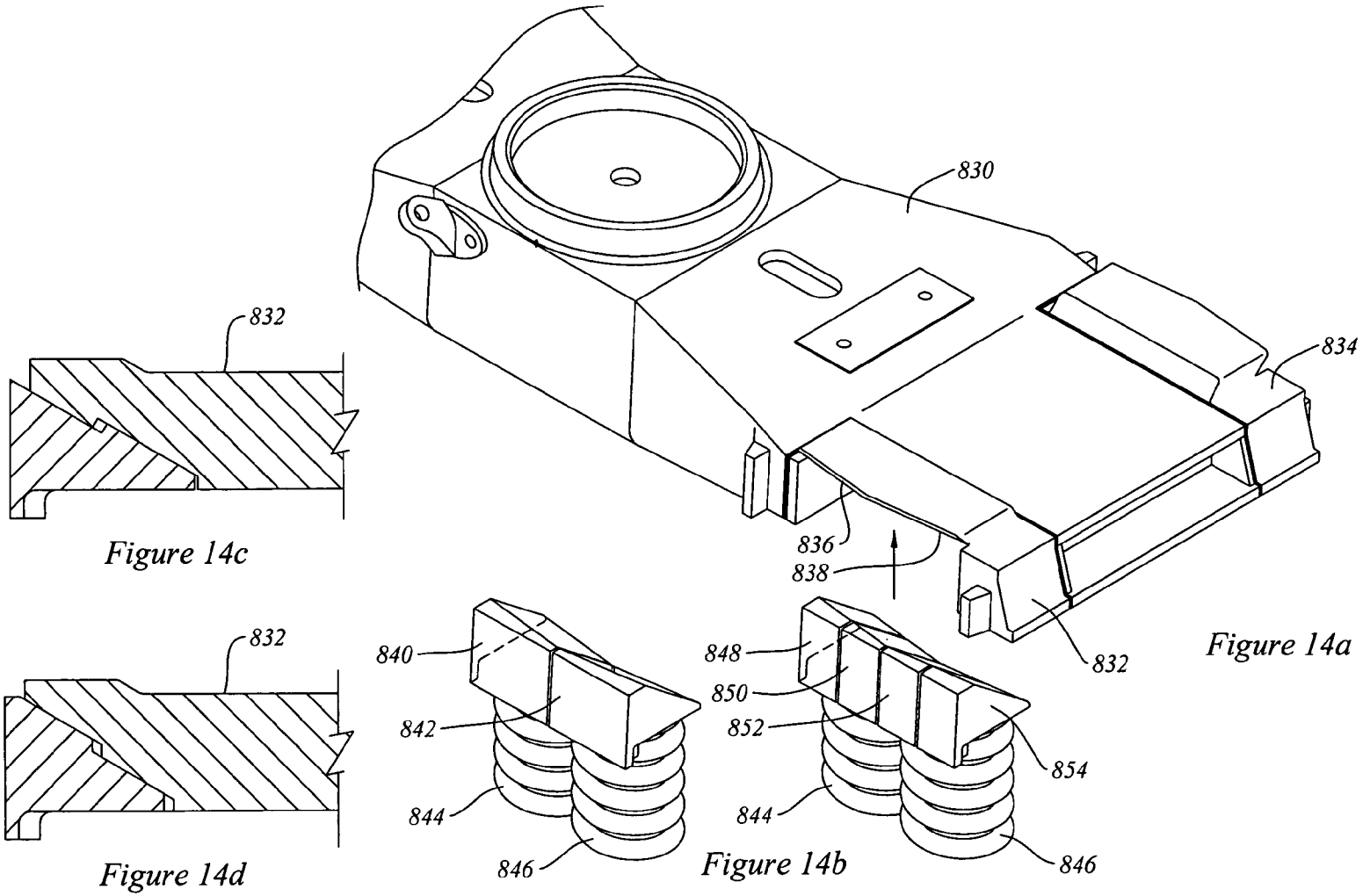
FIG. 14*a* shows an alternate bolster and wedge arrangement to that of FIG. 11*b*, having secondary wedge angles.
FIG. 14*b* shows an alternate, split wedge arrangement for the bolster of FIG. 14*a;*
FIG. 14*c* shows a cross-section of a stepped damper wedge for use with a bolster as shown in FIG. 14*a;*
FIG. 14*d* shows an alternate stepped damper to that of FIG. 14*c;*

In the further alternative embodiment of FIGS. 14*a*, a truck bolster 830 has welded bolster pocket inserts 832 and 834 of opposite hands welded into accommodations in its distal end. In this instance, each bolster pocket has an inboard portion 836 and an outboard portion 838. Inboard and outboard portions 836 and 838 share the same primary angle α, but have secondary angles β that are of opposite hand. Respective inboard and outboard wedges are indicated as 840 and 842, and each seats over a vertically oriented spring 844, 846. In this case bolster 830 is similar to bolster 680 of FIG. 11*a*, to the extent that the bolster pocket is continuous—there is no land separating the inner and outer portions of the bolster pocket. Bolster 830 is also similar to bolster 710 of FIG. 11*c*, except that rather than the bolster pockets of opposite hand being separated, they are merged without an intervening land.

In the further alternative of FIG. 14*b*, split wedge pairs 848, 850 (inboard) and 852, 854 (outboard) are employed in place of the single inboard and outboard wedges 840 and 842.

In some instances the primary angle of the wedge may be steep enough that the thickness of section over the spring might not be overly great. In such a circumstance the wedge may be stepped in cross section to yield the desired thickness of section as show in the details of FIGS. 14*c* and 14*d*.

Figure 15A:
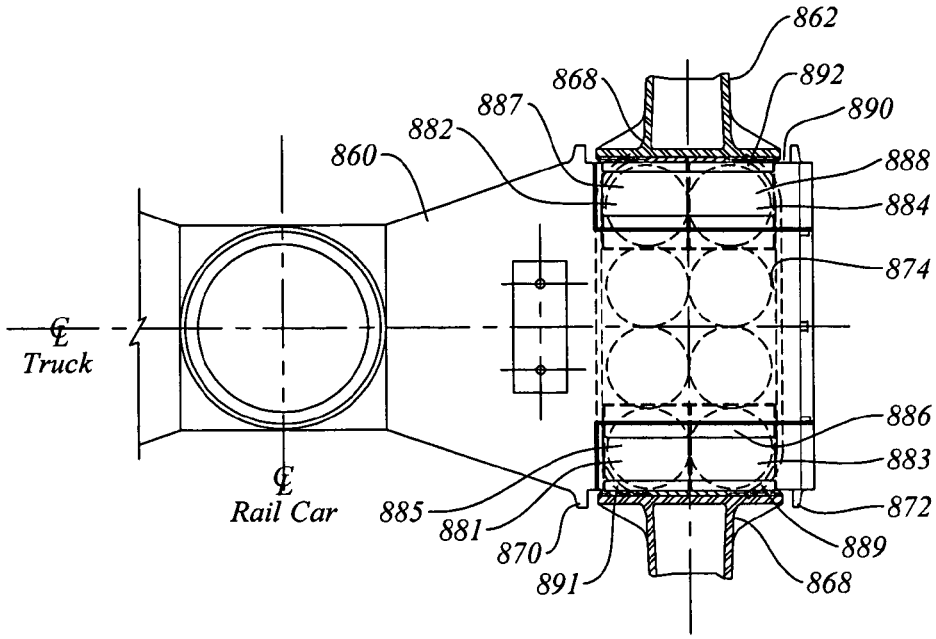
FIG. 15*a* is a section of FIG. 9*b* showing a replaceable side frame wear plate.
Figure 15B:
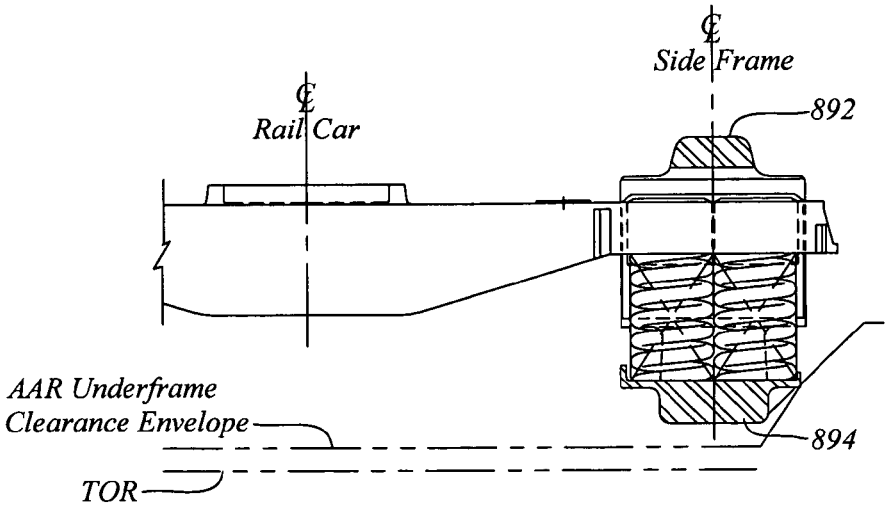
FIG. 15*b* is a sectional view on of the side frame of FIG. 15*a* with the near end of the side frame sectioned and the nearer wear plate removed to show the location of the wear plate of FIG. 15*a;*

FIG. 15*a* shows the placement of a low friction bearing pad for bolster 680 of FIG. 11*a*. it will be appreciated that such a pad can be used at the interface between the friction damper wedges of any of the embodiments discussed herein. In FIG. 15*a*, the truck bolster is identified as item 860 and the side frame is identified as item 862. Side frame 862 is symmetrical about the truck centerline, indicated as 864. Side frame 862 has side frame columns 868 that locate between the inner and outer gibs 870, 872 of truck bolster 860. The spring group is indicated generally as 874, and has eight relatively large diameter springs arranged in two rows, being an inboard row and an outboard row. Each row has four springs in it. The four central springs 876, 877, 878, 879 seat directly under the bolster end 880. The end springs of each row, 881, 882, 883, 884 seat under respective friction damper wedges 885, 886, 887, 888. Consumable wear plates 889, 890 are mounted to the wide, facing flanges 891, 892 of the side frame columns, 888. As shown in FIG. 15*b*, plates 889, 890 are mounted centrally relative to the side frames, beneath the juncture of the side frame arch 892 with the side frame columns. The lower longitudinal member of the side frame, bearing the spring seat, is indicated as 894.

Figure 15C:
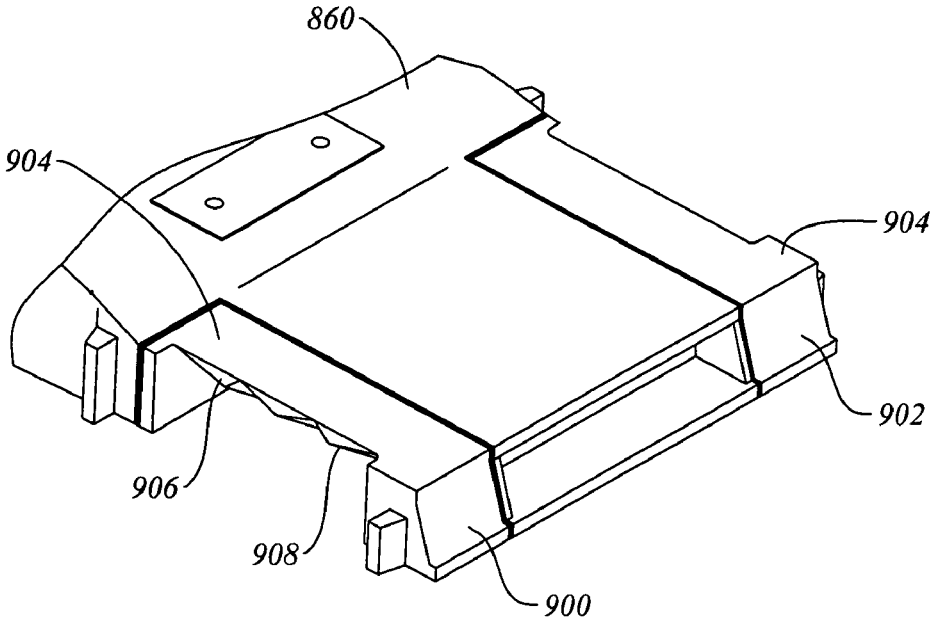
FIG. 15*c* shows a compound bolster pocket for the bolster of FIG. 15*a;*
Figure 15D:
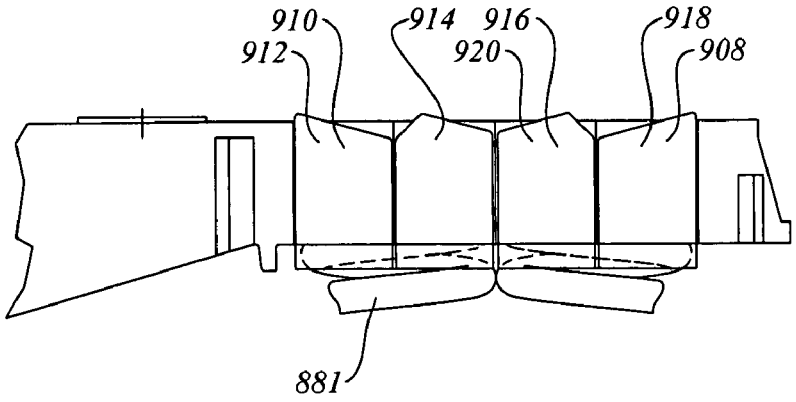
FIG. 15*d* shows a side view detail of the bolster pocket of FIG. 15*c*, as installed, relative to the main springs and the wear plate.
Figure 15F:
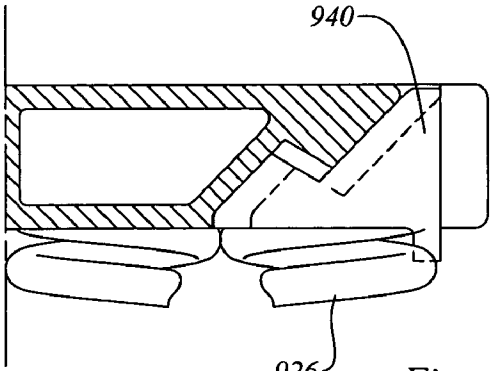
FIG. 15*f* shows an alternate, stepped steeper angle profile for the primary angle of the wedge of the bolster pocket of FIG. 15*d;*
Figure 15G:
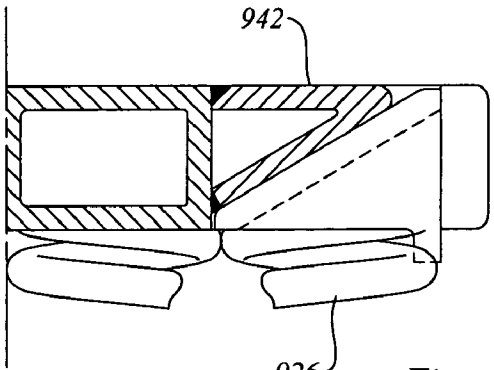
FIG. 15*g* shows a welded insert having a profile for mating engagement with the corresponding face of the bolster pocket of FIG. 15*d;*
Figure 15E:
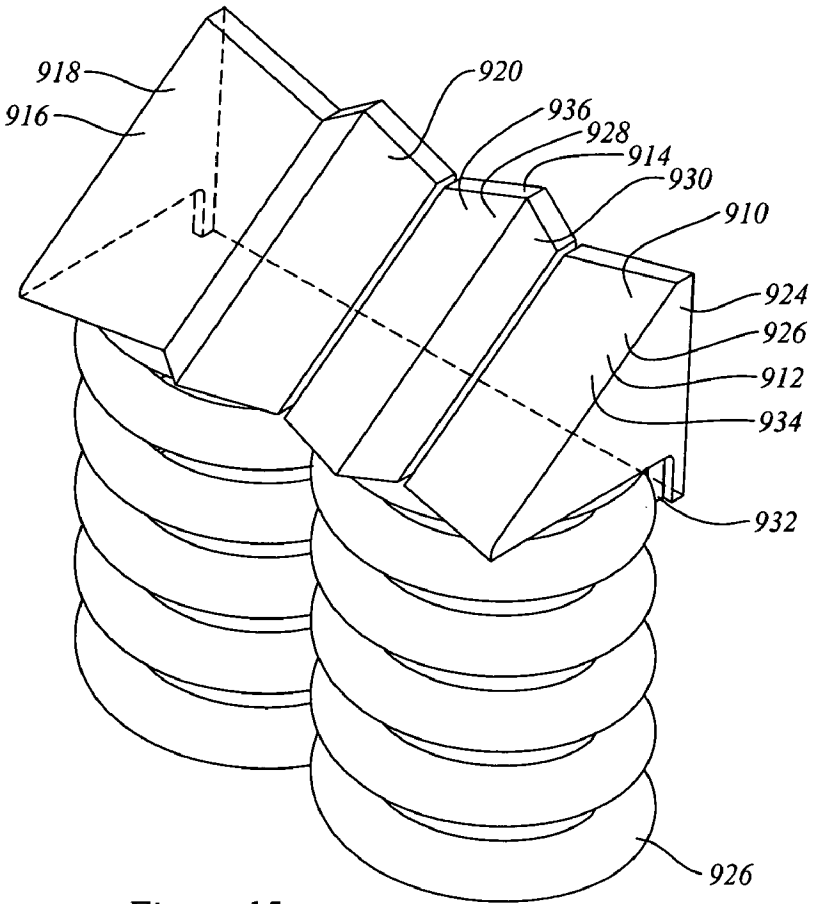
FIG. 15*e* shows an isometric view detail of a split wedge version and a single wedge version of wedges for use in the compound bolster pocket of FIG. 15*c;*

Referring now to FIGS. 15*c* and 15*e*, bolster 860 has a pair of left and right hand, welded-in bolster pocket assemblies 900, 902, each having a cast steel, replaceable, welded-in wedge pocket insert 904. Insert 904 has an inboard-biased portion 906, and an outboard-biased portion 908. Inboard end spring 882 (or 881) bears against an inboard-biased split wedge pair 910 having members 912, 914, and outboard end spring 884 (or 883) bears against an outboard-biased split wedge pair 916 having members 918, 920. As suggested by the names, the outboard-biased wedges will tend to seat in an outboard position as the suspension works, and the inboard-biased wedges will tend to seat in an inboard position.

Each insert portion 906, 908 is split into a first part and a second part for engaging, respectively, the first and second members of a commonly biased split wedge pair. Considering pair 910, inboard leading member 912 has an inboard planar face 924, that, in use, is intended slidingly to contact the opposed vertically planar face of the bolster pocket. Leading member 912 has a bearing face 926 having primary angle α and secondary angle β. Trailing member 914 has a bearing face 928 also having primary angle α and secondary angle β, and, in addition, has a transition, or step, face 930 that has a primary angle α and a tertiary angle ϕ.

Insert 904 has a corresponding an array of bearing surfaces having a primary angle α, and a secondary angle β, with transition surfaces having tertiary angle ϕ for mating engagement with the corresponding surfaces of the inboard and outboard split wedge members. As can be seen, a section taken through the bearing surface resembles a chevron with two unequal wings in which the face of the secondary angle β, is relatively broad and shallow and the face associated with tertiary angle ϕ is relatively narrow and steep.

In FIG. 15*e*, it can be seen that the sloped portions of split wedge members 918, 920 extend only partially far enough to overlie a coil spring 926. In consequence, wedge members 918 and 920 each have a base portion 928, 930 having a fore-and-aft dimension greater than the diameter of spring 926, and a width greater than half the diameter of spring 926. Each of base portions 928, 930 has a downwardly proud, roughly semi-circular boss 932 for seating in the top of the coil of spring 926. The upwardly angled portion 934, 936 of each wedge member 918, 920 is extends upwardly of base portion 928, 930 to engage the matingly angled portions of insert 904.

In a further alternate embodiment, the split wedges can be replaced with stepped wedges 940 of similar compound profile, as shown In FIG. 15*f*. In the event that the primary wedge angle is relatively steep (i.e., greater than about 45 degrees when measured from the horizontal, or less than about 45 degrees when measured from the vertical). FIG. 15*g* shows a welded in insert 942 having a profile for mating engagement with the corresponding wedge faces.

Figure 16B:
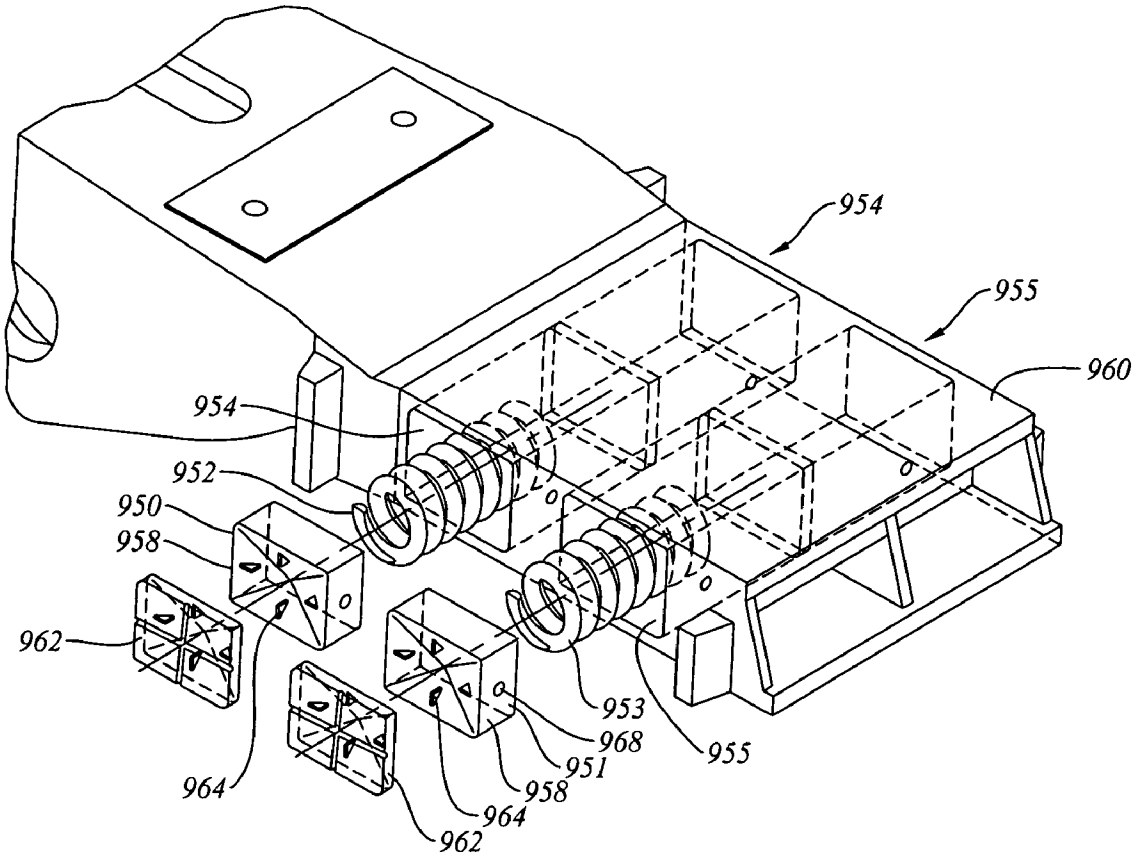
FIG. 16*b* shows a side-by-side double damper arrangement similar to that of FIG. 16*a;*

FIGS. 16*a* and 16*b* illustrate a bolster, side frame and damper arrangement in which dampers 960, 961 are independently sprung on horizontally acting springs 962, 963 housed in side-by-side pockets 964, 965 in the distal end of bolster 970. Although only two dampers are shown, it will be understood that a pair of dampers faces toward each of the opposed side frame columns. Dampers 960, 961 each include a block 968 and a consumable wear member 972, the block and wear member having male and female indexing features 974 to maintaining their relative position. An arrangement of this nature permits the damper force to be independent of the compression of the springs in the main spring group. A removable grub screw fitting 978 is provided in the spring housing to permit the spring to be pre-loaded and held in place during installation.

Figure 17B:
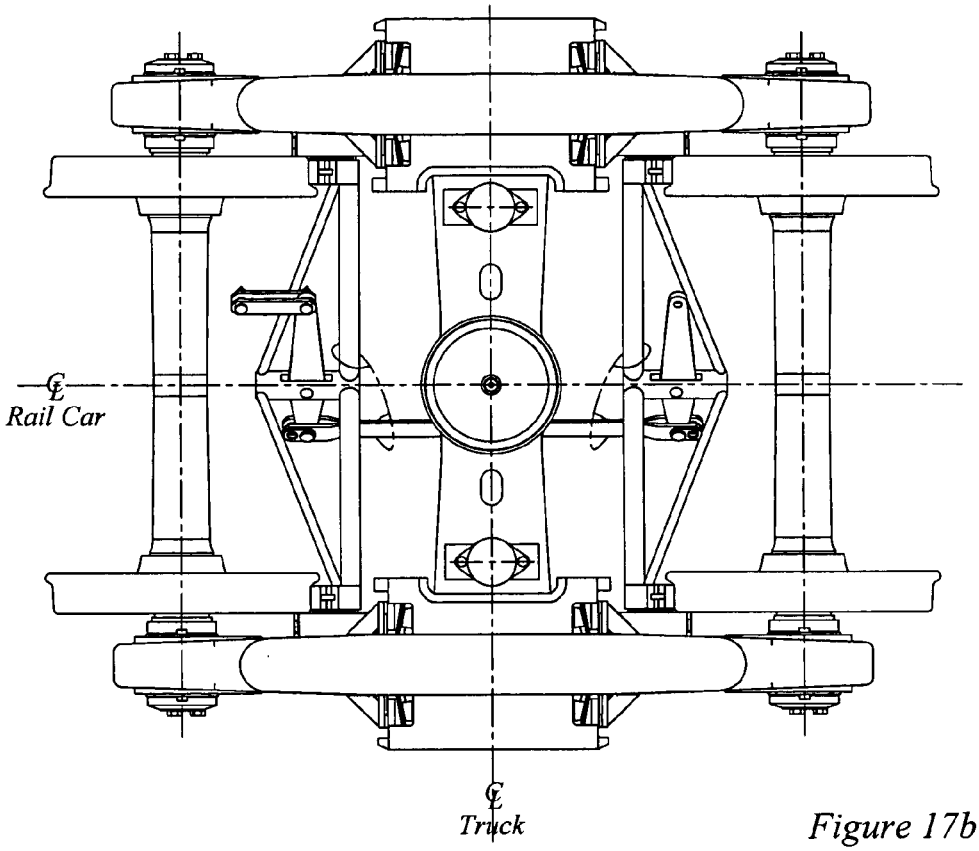
FIG. 17*b* shows a side view of the three piece truck of FIG. 17*a*.
Figure 17C:
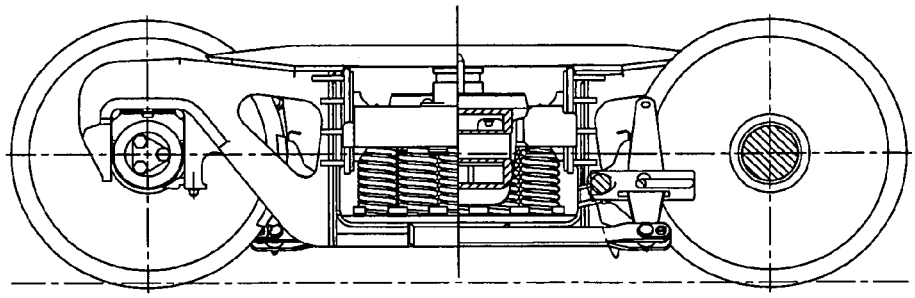
FIG. 17*c* shows a top view of the three piece truck of FIG. 17*a*.

FIGS. 17*a*, 17*b* and 17*c* show a preferred truck 970, having a bolster 972, a side frame 974, a spring group 976, and a damper arrangement 978. The spring group has a 5×3 arrangement, with the dampers being in a spaced arrangement generally as shown in FIG. 11*c*, and having a primary damper angle that may tend to be somewhat sharper given the smaller proportion of the total spring group that works under the dampers (i.e., 4/15 as opposed to 4/9 in FIG. 11*c*.

In one embodiment of truck 970, as might preferably be used in the location of end trucks 88, 206, 210, or 232, there may be a 5×3 spring group arrangement, the spring group including 11 coils each having a spring rate in the range of 550–650 lb./in, and most preferably about 580 lb./in; and 4 springs (under the dampers, in a four comer arrangement) having a spring rate in the range of 450–550 lb./in, most preferably about 500 lb./in, for which the dampers are driven by 20–25% of the force of the spring group, preferably about 24%. The dampers may have a primary angle of 35–45 deg., preferably about 40 deg. In this preferred end truck embodiment, the overall group vertical spring rate is in the range of 8,000 to 8,500 lb./in., in particular about 8380 lb./in.

In another embodiment of truck 970, such as might preferably be used in the location of internal truck 234, there may be a 5×3 spring group arrangement in which the spring group may include 11 outer springs having a spring rate of about 550–650 lb./in., and most preferably about 580 lb./in; 4 springs (under the dampers, in a four corner arrangement) having a spring rate in the range of 550–650 lb./in, and most preferably about 600 lb./in.; and six inner coils having a spring rate in the range of 250–300 lb./in., most preferably about 280 lb./in. The overall spring rate for the 5×3 group is in the range of 10,000–11,000 lb./in., and most preferably about 10,460 lb./in. The dampers are driven by about 20–25% of the total force of the spring group, preferably about 23%. The dampers have a primary angle in the range of 35–35 degrees, preferably about 40 degrees.

It will be appreciated that the values and ranges given for truck 970 depend on the expected empty weight of the railcar, the expected lading, the natural frequency range to be achieved, the amount of damping to be achieved, and so on, and may accordingly vary from the preferred ranges and values indicated above.

In the embodiments of FIGS. 2*a*, 2*b*, 3*a*, 3*b*, 4*a* and 4*b*, the ratio of the dead sprung weight, WD, of the rail car unit (being the weight of the car body plus the weight of the truck bolster) without lading to the live load, WL, namely the maximum weight of lading, be at least 1:1. It is advantageous that this ratio WD:WL lie in the range of 1:1 to 10:3. In one embodiment of rail car of FIGS. 2*a*, 2*b*, 3*a*, 3*b*, 4*a* and 4*b* the ratio can be about 1.2:1 It is more advantageous for the ratio to be at least 1.5:1, and preferable that the ratio be greater than 2:1.

The embodiments described herein have natural vertical bounce frequencies that are less than the 4–6 Hz. range of freight cars more generally. In addition, a softening of the suspension to 3.0 hz would be an improvement, yet the embodiments described herein, whether for individual trucks or for overall car response can employ suspensions giving less than 3.0 Hz in the unladen vertical bounce mode. That is, the fully laden natural vertical bounce frequency for one embodiment of rail cars of FIGS. 2*a*, 2*b*, 3*a*, 3*b*, 4*a* and 4*b* is 1.5 Hz or less, with the unladen vertical bounce natural frequency being less than 2.0 Hz, and advantageously less than 1.8 Hz. It is preferred that the natural vertical bounce frequency be in the range of 1.0 Hz to 1.5 Hz. The ratio of the unladen natural frequency to the fully laden natural frequency is less than 1.4:1.0, advantageously less than 1.3:1.0, and even more advantageously, less than 1.25:1.0.

In the embodiments described above, it is preferred that the spring group be installed without the requirement for pre-compression of the springs. However, where a higher ratio of dead sprung weight to live load is desired, additional ballast can be added up to the limit of the truck capacity with appropriate pre-compression of the springs. It is advantageous for the spring rate of the spring groups be in the range of 6,400 to 10,000 lbs/in per side frame group, or 12,000 to 20,000 lbs/in per truck in vertical bounce.

In the embodiments of FIGS. 9*a*, 11*a*, and 17*a*, the gibs are shown mounted to the bolster inboard and outboard of the wear plates on the side frame columns. In the embodiments shown herein, the clearance between the gibs and the side plates is desirably sufficient to permit a motion allowance of at least ¾" of lateral travel of the truck bolster relative to the wheels to either side of neutral, advantageously permits greater than 1 inch of travel to either side of neutral, and more preferably permits travel in the range of about 1 or 1⅛" to about 1⅝ or 1 9/16" inches to either side of neutral, and in one embodiment against either the inboard or outboard stop.

In a related feature, in the embodiments of FIGS. 9*a*, 11*a* and 17*a*, the side frame is mounted on bearing adapters such that the side frame can swing transversely relative to the wheels. While the rocker geometry may vary, the side frames shown, by themselves, have a natural frequency when swinging of less than about 1.4 Hz, and preferably less than 1 Hz, and advantageously about 0.6 to 0.9 Hz. Advantageously, when combined with the lateral spring stiffness of a spring group in shear, the overall lateral natural frequency of the truck suspension, for an unladen car, may tend to be less than 1 Hz for small deflections, and preferably less than 0.9 Hz.

The most preferred embodiments of this invention combine a four cornered damper arrangement with spring groups having a relatively low vertical spring rate, and a relatively soft response to lateral perturbations. This may tend to give enhanced resistance to hunting, and relatively low vertical and transverse force transmissibility through the suspension such as may give better overall ride quality for high value low density lading, such as automobiles, consumer electronic goods, or other household appliances, and for fresh fruit and vegetables.

While the most preferred embodiments combine these features, they need not all be present at one time, and various optional combinations can be made. As such, the features of the embodiments of the various figures may be mixed and matched, without departing from the spirit or scope of the invention. For the purpose of avoiding redundant description, it will be understood that the various damper configurations can be used with spring groups of a 2×4, 3×3, 3:2:3, 3×5 or other arrangement. Similarly, although the discussion involves trucks for rail road cars for carrying low density lading, it applies to trucks for carrying relatively fragile high density lading such as rolls of paper, for example, where ride quality is an important consideration although high density lading may tend to require a stiffer vertical response than automobiles. Further, while the improved ride quality features of the damper and spring sets are most preferably combined with a low slack, short travel, set of draft gear, for use in a "No Hump" car, these features can be used in cars having conventional slack and longer travel draft gear.

It will be understood that the features of the trucks of FIGS. 6*a*, 6*b*, 7*a*, 7*b*, 8, and 9*a*, 9*f* are provided by way of illustration, and that the features of the various trucks can be combined in many different permutations and combinations. That is, a 2×4 spring group could also be used with a single wedge damper per side. Although a single wedge damper per side arrangement is shown in FIGS. 6*a* and 7*a*, a double damper arrangement, as shown in FIGS. 8 and 9*a* may tend to provide enhanced squaring of the truck and resistance to hunting. A 3×3 or 3×5, or other arrangement spring set may be used in place of either a 3:2:3 or 2×4 spring set, with a corresponding adjustment in spring seat plate size and layout. Similarly, the trucks can use a wide sideframe window, and corresponding extra long wheel base, or a smaller window. Further, each of the trucks could employ a rocking bottom spring seat, as in FIG. 6*b*, or a fixed bottom spring seat, as in FIG. 7*a*, 8 or 9*a*.

As before, the upper rocker seats are inserts, typically of a hardened material, whose rocking, or engaging surface 480 has a radius of curvature of about five inches, with the center of curvature (when assembled) lying above the upper rockers (i.e., the surface is upwardly concave).

In each of the trucks shown and described herein, for a fully laden car type, the lateral stiffness of the sideframe acting as a pendulum is less than the lateral stiffness of the spring group in shear. In one embodiment, the vertical stiffness of the spring group is less than 12,000 Lbs./in, with a horizontal shear stiffness of less than 6000 Lbs./in. The pendulum has a vertical length measured (when undeflected) from the rolling contact interface at the upper rocker seat to the bottom spring seat of between 12 and 20 inches, preferably between 14 and 18 inches. The equivalent length $L_{eq}$, may be in the range of 8 to 20 inches, depending on truck size and rocker geometry, and is preferably in the range of 11 to 15 inches, and is most preferably between about 7 and 9 inches for 28 inch wheels (70 ton "special"), between about 8½ and 10 inches for 33 inch wheels (70 ton), 9½ and 12 inches for 36 inch wheels (100 or 110 ton), and 11 and 13½ inches for 38 inch wheels (125 ton). Although truck 520 or 600 may be a 70 ton special, a 70 ton, 100 ton, 110 ton, or 125 ton truck, it is preferred that truck 520 or 600 be a truck size having 33 inch diameter, or even more preferably 36 or 38 inch diameter wheels.

In the trucks described herein according to the present invention, $L_{resultant}$, as defined above, is greater than 10 inches, is advantageously in the range of 15 to 25 inches, and is preferably between 18 and 22 inches, and most preferably close to about 20 inches. In one particular embodiment it is about 19.6 inches, and in another particular embodiment it is about 19.8 inches.

In the trucks described herein, for their fully laden design condition which may be determined either according to the AAR limit for 70, 100, 110 or 125 ton trucks, or, where a lower intended lading is chosen, then in proportion to the vertical sprung load yielding 2 inches of vertical spring deflection in the spring groups, the equivalent lateral stiffness of the sideframe, being the ratio of force to lateral deflection measured at the bottom spring seat, is less than the horizontal shear stiffness of the springs. The equivalent lateral stiffness of the sideframe $k_{sideframe}$ is less than 6000 Lbs./in. and preferably between about 3500 and 5500 Lbs./in., and more preferably in the range of 3700–4100 Lbs./in. By way of an example, in one embodiment a 2×4 spring group has 8 inch diameter springs having a total vertical stiffness of 9600 Lbs./in. per spring group and a corresponding lateral shear stiffness $k_{spring\ shear}$ of 4800 lbs./in. The sideframe has a rigidly mounted lower spring seat. It is, used in a truck with 36 inch wheels. In another embodiment, a 3×5 group of 5½ inch diameter springs is used, also having a vertical stiffness of about 9600 lbs./in. in a truck with 36 inch wheels. It is intended that the vertical spring stiffness per spring group be in the range of less than 30,000 lbs./in., that it advantageously be in the range of less than 20,000 lbs./in and that it preferably be in the range of 4,000 to 12000 lbs./in, and most preferably be about 6000 to 10,000 lbs./in. The twisting of the springs has a stiffness in the range of 750 to 1200 lbs./in. and a vertical shear stiffness in the range of 3500 to 5500 lbs./in. with an overall sideframe stiffness in the range of 2000 to 3500 lbs./in.

In the embodiments of trucks in which there is a fixed bottom spring seat, the truck may have a portion of stiffness, attributable to unequal compression of the springs equivalent to 600 to 1200 Lbs./in. of lateral deflection, when the lateral deflection is measured at the bottom of the spring seat on the sideframe. Preferably, this value is less than 1000 Lbs./in., and most preferably is less than 900 Lbs./in. The portion of restoring force attributable to unequal compression of the springs will tend to be greater for a light car as opposed to a fully laden car, i.e., a car laden in such a manner that the truck is approaching its nominal load limit, as set out in the 1997 *Car and Locomotive Cyclopedia* at page 711.

The double damper arrangements shown above can also be varied to include any of the four types of damper installation indicated at page 715 in the 1997 *Car and Locomotive Cyclopedia*, whose information is incorporated herein by reference, with appropriate structural changes for doubled dampers, with each damper being sprung on an individual spring. That is, while inclined surface bolster pockets and inclined wedges seated on the main springs have been shown and described, the friction blocks could be in a horizontal, spring biased installation in a pocket in the bolster itself, and seated on independent springs rather than the main springs. Alternatively, it is possible to mount friction wedges in the sideframes, in either an upward orientation or a downward orientation.

The embodiments of trucks shown and described herein may vary in their suitability for different types of service. Truck performance can vary significantly based on the loading expected, the wheelbase, spring stiffnesses, spring layout, pendulum geometry, damper layout and damper geometry.

The principles of the present invention are not limited to auto rack rail road cars, but apply to freight cars, more generally, including cars for paper, auto parts, household appliances and electronics, shipping containers, and refrigerator cars for fruit and vegetables. More generally, they apply to three piece freight car trucks in situations where improved ride quality is desired, typically those involving the transport of relatively high value, low density manufactured goods.

Various embodiments of the invention have now been described in detail. Since changes in and or additions to the above-described best mode may be made without departing from the nature, spirit or scope of the invention, the invention is not to be limited to those details.

I claim:

1. A truck for a railroad freight car comprising:

wheelsets, a pair of first and second sideframes mounted to said wheelsets, and a bolster mounted cross-wise between said sideframes;

said sideframes being free of unsprung lateral connection interconnecting the sideframes; wherein, the lateral connection of which said side frame are being free is chosen from the set consisting of a transom, cross brace members, and lateral extending rods;

said bolster having a first end borne by a lower region of said first sideframe, and a second end borne by a lower region of said second sideframe;

a first group of friction dampers being mounted between said first end of said bolster and said first sideframe;

a second group of friction dampers being mounted between said second end of said bolster and said second sideframe;

said first group of dampers including a first friction damper and a second friction damper, said first and second friction dampers being independently sprung, and said first friction damper being located more laterally inboard than said second friction damper;

said sideframes having upper regions having pedestal fittings;

said wheelsets having bearing adapters mounted thereto, said bearing adapters being mounted in said pedestal fittings;

said bearing adapters and said pedestal fittings engaging each other at pairs of first and second surfaces that mate in rocking engagement to permit lateral swinging motion of said sideframes such that when said lower region of said first sideframe swings laterally outboard, said upper regions of said first sideframe rock laterally inboard;

said first surface having a first radius of curvature of less than 25 inches; and said second surface having a second radius of curvature lying in the range of ¼ to ¾ of said first radius of curvature.

2. An autorack rail road car having a car body unit supported by rail road car trucks for rolling motion along railway tracks wherein one of said trucks is a truck as claimed in claim 1.

3. The autorack rail road car of claim 2 wherein said car is ballasted.

4. The autorack rail road car of claim 3 wherein said rail road car includes at least two rail car unit bodies joined by an articulated connector, and at least one of said unit bodies is unevenly ballasted along its length.

5. The truck of claim 1 wherein said truck has an overall vertical spring rate of less than 30,000 Lbs./in.

6. The truck of claim 1 wherein said truck has an overall vertical spring rate of less than 20,000 Lbs./in.

7. The truck of claim 1 wherein said truck has an overall vertical spring rate in the range of 10,000 Lbs./in. to 25,000 Lbs./in.

8. The rail road car truck of claim 1 wherein one of said friction dampers is biased laterally inboard.

9. The rail road car truck of claim 1 wherein one of said friction dampers is biased laterally outboard.

10. The rail road car truck of claim 1 wherein said friction dampers are laterally biased in opposite directions.

11. The rail road car truck of claim 1 wherein said first friction damper is biased laterally inboard and said second friction damper is biased laterally outboard.

12. The rail road car truck of claim 1 wherein said first and second friction dampers are members of a damper group, and said damper group includes dampers mounted in a four-cornered arrangement at said first end of said truck bolster.

13. The rail road car truck of claim 1 wherein one of said friction dampers has a non-metallic friction surface.

14. A rail road car truck comprising:

first and second spaced apart sideframes, and a transversely oriented truck bolster extending between said sideframes;

said sideframes being free of unsprung lateral connection interconnecting the sideframes; wherein, the lateral connection of which said side frame are being free is chosen from the set consisting of a transom, cross brace members, and lateral extending rods;

wheelsets upon which said sideframes seat;

said wheelsets having bearing adapters;

said sideframes having mounting fittings to seat on said bearing adapters;

said sideframe mounting fittings and said bearing adapters meeting at respective pairs of co-operating surfaces in rolling contact to permit lateral swinging of the sideframe, one of said surfaces having a radius of curvature of less than 25 inches, the other surface having a radius of curvature in the range of ¼ to ¾ as large;

said sideframes being operable to rock such that when a lower region of said first sideframe swings laterally outboard, an upper region of said first sideframe rocks laterally inboard;

said truck bolster having a first end resiliently connected to said first side frame and a second end resiliently connected to said second side frame;

a first biasing member and a second biasing member and corresponding first and second friction dampers mounted to act between said first end of said truck bolster and said first sideframe, said first friction damper being mounted in a laterally inboard position relative to said second friction damper;

said first and second friction dampers being oriented to provide a squaring restorative moment couple to the bolster relative to the first side frame when said bolster is deflected about a vertical axis relative to said first side frame.

15. The autorack rail road car of claim 14 wherein said first and second biasing members are mounted to act to one longitudinal side of said bolster, and said truck has third and fourth biasing members oriented to act to the other longitudinal side of said bolster.

16. The rail road car truck of claim 14 wherein said first and second biasing members are parts of a group of biasing members arranged in a four-cornered arrangement.

17. The rail road ear truck of claim 14 wherein said sideframes have sideframe columns and said biasing members are mounted to work between said bolster and said sideframe columns.

18. The rail road car truck of claim 14 wherein said biasing members urge said friction dampers into a sliding friction engagement condition.

19. The rail road car truck of claim 18 wherein one of said friction dampers is biased laterally inboard.

20. The rail road car truck of claim 18 wherein one of said friction dampers is biased laterally outboard.

21. The rail road car truck of claim 18 wherein one of said friction dampers is biased laterally inboard, and another of said friction dampers is biased laterally outboard.

22. The rail road car truck of claim 18 wherein said friction dampers include a first friction damper driven by said first biasing member, and a second friction damper driven by said second biasing member, and said first friction damper is biased laterally inboard and said second friction damper is biased laterally outboard.

23. The rail road car truck of claim 18 wherein said dampers are members of a damper group, and said damper group includes dampers mounted in a four-cornered arrangement at said first end of said truck bolster.

24. The rail road car truck of claim 18 wherein one of said friction dampers has a non-metallic friction surface.

25. A rail road car truck comprising:

first and second spaced apart sideframes, and a transversely oriented truck bolster extending between said sideframes;

said sideframes being free of unsprung lateral connection interconnecting the sideframes; wherein, the lateral connection of which said side frame are being free is chosen from the set consisting of a transom, cross brace members, and lateral extending rods;

wheelsets upon which said sideframes seat;

said wheelsets having bearing adapters;

said sideframes having mounting fittings to seat on said bearing adapters;

said sideframe fittings and said bearing adapters meeting at respective pairs of co-operating surfaces in rolling contact to permit lateral swinging of the sideframe, one of said surfaces having a first radius of curvature of less than 25 inches, the other surface having a second radius of curvature in the range of ¼ to ¾ as large as said first radius of curvature;

said sideframes being operable to rock such that when a lower region of said first sideframe swings laterally outboard, an upper region of said first sideframe rocks laterally inboard;

said truck bolster having a first end resiliently connected to said first side frame and a second end resiliently connected to said second side frame;

a first friction damper and a second friction damper independently biased to act between said first end of said truck bolster and said first sideframe, said first friction damper being mounted in a laterally inboard position relative to said second friction damper;

said first and second friction dampers also being biased laterally.

26. The rail road car truck of claim 25 wherein one of said friction dampers is biased laterally inboard.

27. The rail road car truck of claim 25 wherein one of said friction dampers is biased laterally outboard.

28. The rail road car truck of claim 25 wherein said friction dampers are laterally biased in opposite directions.

29. The rail road car truck of claim 25 wherein said first friction damper is biased laterally inboard and said second friction damper is biased laterally outboard.

30. The rail road car truck of claim 25 wherein said first and second friction dampers are members of a damper group, and said damper group includes dampers mounted in a four-cornered arrangement at said first end of said truck bolster.

31. The rail road car truck of claim 25 wherein each of said friction dampers has a friction surface for sliding engagement with an opposed wear surface, and said friction surface includes a non-metallic pad.

* * * * *